US005987280A

United States Patent [19]

Sato et al.

[11] Patent Number: 5,987,280

[45] **Date of Patent: *Nov. 16, 1999**

[54] DEVELOPING DEVICE FOR ELECTROSTATIC LATENT IMAGE

[75] Inventors: Kunihiko Sato; Kenji Fuke, both of Kawasaki; Tsutomu Kawai, Kato-gun; Eiji Suzuki, Kawasaki; Shozo Tonai, Kawasaki; Yoshihiro Tonomoto, Kawasaki; Katsumi Sugimoto, Kawasaki; Keiko Tonai, Kawasaki; Hitoshi Yoshii, Kato-gun, all of Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/405,036

[22] Filed: Mar. 16, 1995

[30] Foreign Application Priority Data

Mar. 18, 1994 [JP] Japan ..... 6-049567

[51] Int. Cl.[6] ..... G03G 15/04

[52] U.S. Cl. ..... 399/119; 399/254; 399/263

[58] Field of Search ..... 355/200, 245, 355/251, 253, 259, 260, 254; 366/279, 292, 297, 300, 318; 118/653; 399/107, 110, 119, 222, 252, 256, 262, 263

[56] References Cited

U.S. PATENT DOCUMENTS

| | | | |
|---|---|---|---|
| 3,707,947 | 1/1973 | Reichart, Jr. | 188/637 |
| 4,113,371 | 9/1978 | Fraser et al. . | |
| 4,954,404 | 9/1990 | Inoue et al. | 430/45 |

(List continued on next page.)

FOREIGN PATENT DOCUMENTS

| | | |
|---|---|---|
| 56-49554 | 5/1981 | Japan . |
| 56-102560 | 8/1981 | Japan . |
| 57-78063 | 5/1982 | Japan . |

(List continued on next page.)

OTHER PUBLICATIONS

Patent Abstracts of Japan vol. 005, No. 191 (P–092), Dec. 5, 1981 and JP 56 114972 A (Ricoh Co Ltd), Sep. 9, 1981.

Patent Abstracts of Japan vol. 010, No. 084 (P–442), Apr. 3, 1986 and JP 60 218679 A (Konishiroku Shashin Kogyo KK), Nov. 1, 1985.

(List continued on next page.)

*Primary Examiner*—Sandra L. Brase

*Attorney, Agent, or Firm*—Armstrong, Westerman, Hattori, McLeland & Naughton

[57] ABSTRACT

A developing device for developing an electrostatic latent image with a two-component developer comprises a developer container (46) including a developer-accumulating chamber (50), and a developer-agitating chamber (56) provided above the developer-accumulating chamber. A communication passage (64) is provided between the developer-agitating chamber and the developer-accumulating chamber, and is opened to the developer-agitating chamber to define an overflow opening for the developer. The device also comprises a developer-carrying body (48) provided in the developer-accumulating chamber of the developer container, and the developer-carrying body is exposed to face an electrostatic latent image carrying body, and brings the developer from the developer-accumulating chamber to a facing zone therebetween for development of an electrostatic latent image formed on the electrostatic latent image carrying body. The device further comprises a developer-lifting means (68, 68', 70) for lifting the developer, brought to the facing zone by the developer-carrying body, to the developer-agitating chamber of the developer container, and a developer-agitating means (58) for agitating the developer in the developer-agitating chamber of the developer container, a part of the developer agitated by the developer-agitating means being fed to the developer-accumulating chamber through the overflow opening and the communication passage.

18 Claims, 55 Drawing Sheets

U.S. PATENT DOCUMENTS

| | | | |
|---|---|---|---|
| 4,982,691 | 1/1991 | Asanuma et al. | 355/215 X |
| 5,065,693 | 11/1991 | Yoshino et al. | 355/245 X |
| 5,077,583 | 12/1991 | Bhagat | 355/251 |
| 5,095,850 | 3/1992 | Komuro | 355/245 X |
| 5,142,333 | 8/1992 | Verbeek et al. | 355/245 |
| 5,179,414 | 1/1993 | Bhagat | 355/259 |

FOREIGN PATENT DOCUMENTS

| | | |
|---|---|---|
| 58-93944 U | 6/1983 | Japan . |
| 61-197026 | 9/1986 | Japan . |
| 62-6749 | 1/1987 | Japan . |
| 62-8176 | 1/1987 | Japan . |
| 1-282583 | 11/1988 | Japan . |
| 63-191357 | 12/1988 | Japan . |
| 1-82069 | 3/1989 | Japan . |
| 1-282583 | 11/1989 | Japan . |
| 2-54289 | 2/1990 | Japan . |
| 3-105370 | 5/1991 | Japan . |
| 3-196072 | 8/1991 | Japan . |
| 4-254878 | 10/1991 | Japan . |
| 4-168457 | 6/1992 | Japan . |
| 4-174471 | 6/1992 | Japan . |
| 4-253074 | 9/1992 | Japan . |
| 5-127537 | 5/1993 | Japan . |
| 5-313430 | 11/1993 | Japan . |
| 6-51633 | 2/1994 | Japan . |

OTHER PUBLICATIONS

Patent Abstracts of Japan vol. 018, No. 284 (P–1745), May 30, 1994 and JP 06 051633 A (Kyocera Corp), Feb. 25, 1994. Form listing the family patent member (US 4,982,691) related to Japanese application A–1–282583 (listed above as AM).

DEVELOPING DEVICE FOR ELECTROSTATIC LATENT IMAGE

BACKGROUND OF THE INVENTION

1) Field of the Invention

The present invention relates to a developing device for using in an electrostatic recording apparatus, such as an electrophotographic copying machine or an electrophotographic printer, and, more specifically, to a developing device suitable for use in a multicolor electrostatic recording apparatus for multicolor recording and provided with a plurality of recording units arranged in a line.

2) Description of the Related Art

In an electrostatic recording apparatus of the type as mentioned above, an electrostatic latent image is formed on an electrostatic latent image carrying body, such as a photosensitive body or a dielectric body, the electrostatic latent image is developed electrostatically as a charged toner image using a developer, the charged toner image is transferred electrostatically to a recording medium, such as a recording sheet of paper, and then the toner image is fixed to the recording medium by heat, pressure or light.

As a multicolor recording apparatus utilizing such electrostatic recording techniques, a single-drum type of multicolor recording apparatus is known. This recording apparatus comprises a single electrostatic image carrying body, i.e., a photosensitive drum, and a plurality of developing devices using different developers containing toner of different colors, respectively, and arranged between an electrostatic image writing location at which an electrostatic latent image is written on the photosensitive drum and a transfer charger. For example, a multicolor recording apparatus for a full-color recording is provided with four developing devices, which use a yellow developer containing yellow toner, a cyan developer containing cyan toner, a magenta developer containing magenta toner, and a black developer containing black toner, respectively. First, an electrostatic latent image is formed on the photosensitive drum on the basis of yellow image data, and is developed as yellow toner image using the yellow toner, and then the yellow toner image is transferred to and fixed on a recording sheet. Subsequently, an electrostatic latent image is formed on the photosensitive drum on the basis of cyan image data, and is developed as a cyan toner image using the cyan toner, and then the cyan toner image is transferred to and fixed on the sheet of paper carrying the yellow toner image previously fixed thereto. A similar process is repeated for each of magenta image data and black image data. Consequently, the four toner images are superposed on the sheet of paper, whereby a full-color recording is made. Although the single-drum multicolor recording apparatus is advantageous in that the same has a relatively compact construction, the single-drum multicolor recording apparatus is incapable of high-speed recording, because the same needs to form the toner images of the different colors on the single photosensitive drum.

Also, as a multicolor recording apparatus for the electrostatic recording techniques, the multi-drum type of multicolor recording apparatus is known, which comprises four electrostatic recording units aligned with each other along path for moving a recording sheet of paper. The respective electrostatic recording units includes developing devices which use a developer containing yellow toner, a developer containing cyan toner, a developer containing magenta toner, and a developer containing black toner. While a recording sheet of paper is moved along the path, an yellow toner image, a cyan toner image a magenta toner image and a black toner image sequentially is formed on the sheet of paper by the four electrostatic recording devices, whereby a full-color image is obtained on the sheet of paper.

Although the multi-drum type multicolor recording apparatus as mentioned above is advantageous in that a high-speed multicolor recording can be carried out, it has the most disadvantage in that a construction thereof is large due to the alignment of the electrostatic recording units.

Especially, as a developing device incorporated in a conventional electrostatic latent recording apparatus, a type of developing device comprising a developing roller and a developer-accumulating roller side by side is well known. The developing device of this type requires a relatively large area for installation thereof. Accordingly, the multi-drum multicolor electrostatic recording apparatus utilizing a plurality of developing devices of that type also has a large construction.

Recently, there is a demand for miniaturization of various apparatuses in the information processing market. Accordingly, as various companies or makers aim at miniaturizing computers, peripheral equipments therefor, and etc., there is a strong demand for miniaturization of even a recording apparatus provided with a monochromatic developing device and occupying a small area for installation thereof. Nevertheless, the above-mentioned developing device having the developing roller and the developer-accumulating roller arranged side by side unavoidably needs a relatively large area for installation thereof.

SUMMARY OF THE INVENTION

Accordingly, it is a principal object of the present invention to provide a developing device having a relatively small area for installation thereof.

Another object of the present invention is to provide a developing device suitable for use in a multicolor recording apparatus of the above-mentioned type and capable of contributing to a compact construction of the multicolor recording apparatus.

A developing device in accordance with the present invention uses a two-component developer for developing an electrostatic latent image, and comprises a developer container for holding the two-component developer. The developer container includes a developer-accumulating chamber and a developer-agitating chamber provided above the developer-accumulating chamber, and these chambers are in communication with each other through a communication passage which is opened to the developer agitating chamber to form an overflow opening for the developer. The developing device also comprises a developer carrying body provided within the developer-accumulating chamber of the developer container, and the developer carrying body is partially exposed therefrom and faces an electrostatic latent image carrying body to bring a developer from the developer-accumulating chamber to a facing zone therebetween for development of an electrostatic latent image formed on the electrostatic latent image carrying body. The developing device further comprising a developer-lifting means for lifting the developer, brought to the facing zone by the developer carrying body, to the developer-agitating chamber of the developer container, and a developer agitating means for agitating the developer in the developer-agitating chamber of the developer container, a part of the developer agitated by the developer-agitating means being fed to the developer-accumulating chamber through the overflow opening and the communication passage.

As is apparent from the above-mentioned arrangement, in the developing device according to the present invention, the developer container is divided into the developer-accumulating chamber and the developer agitating chamber, and the developer-agitating chamber is provided above the developer-accumulating chamber. Accordingly, the developer-accumulating chamber of the developer container has small dimensions.

BRIEF DESCRIPTION OF THE DRAWINGS

The above and other objects and advantages of the present invention will be better understood from the following description, with reference to the accompanying drawings in which.

DESCRIPTION OF THE PREFERRED EMBODIMENTS

Figure 1:
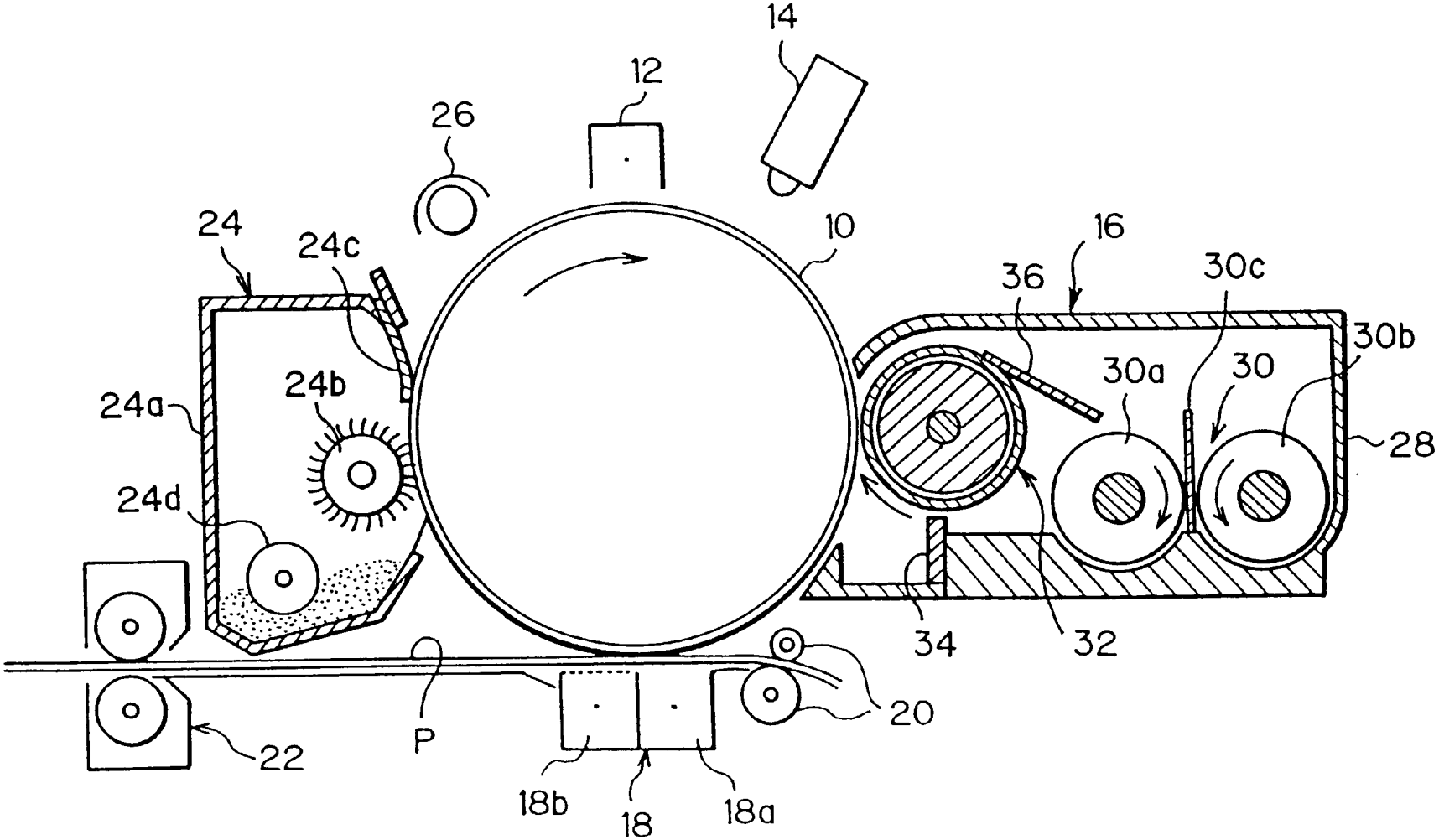
Fig. 1 PRIOR ART
FIG. 1 is a schematic view of an electrostatic recording unit having a conventional developing device incorporated therein.

Referring to FIG. 1, schematically showing a high-speed electro-photographic printer as a representative of an electrostatic recording apparatus, the printer comprises a photosensitive drum 10 as an electrostatic latent image carrying body. During the operation of the printer, the photosensitive drum 10 is rotated in a direction indicated by the arrow in the drawing. The photosensitive drum 10 is charged uniformly by a precharger 12, and an electrostatic latent image is written by an optical writing means 14 on a charged area of the photosensitive drum 10. Although the precharger 12 comprises a corona charger or a scorotron charger, it may be a conductive roller charger or a conductive brush charger. As the optical writing means, a laser beam scanner, an LED (light emitting diode) array, a liquid crystal shutter array etc. are known. The electrostatic latent image formed on the photosensitive drum 10 is electrostatically developed as a charged toner image by a developing device 16, and the charged toner image is electrostatically transferred to a recording medium such as a recording sheet of paper P by a transfer unit 18. Note, the developing device 16 shown in FIG. 1 is of a conventional type. The sheet of paper P is fed from a paper feeder unit not shown in the drawing, and is once sopped at a pair of register rollers 20. Then, the sheet of paper P is fed by the register rollers 20 into a clearance between the photosensitive drum 10 and the transfer unit 18 at a given timing in accordance with the writing of an electrostatic latent image, whereby the charged toner image is transferred from the photosensitive drum 10 to the sheet of paper P. In this example shown in FIG. 1, the transfer unit 18 comprises a transfer device 18*a* including a corona discharger or the like, and a charge eliminating device 18*b* including an AC eliminator or the like. The transfer device 18*a* gives the sheet of paper P a charge of a polarity opposite that of the charge of the charged toner image, to thereby transfer the charged toner image from the photosensitive drum 10 to the sheet of paper P, and the charge-eliminating device 18*b* partially eliminates the charge from the sheet of paper P just after the transfer of the charged toner image, whereby the sheet of paper P can be easily separated from the photosensitive drum 10. The sheet of paper P subjected to the transfer process is fed to a fixing device 22, at which the transferred toner image is fixed on the sheet of paper P.

Residual toner not transferred to the sheet of paper P and remaining on a surface of the photosensitive drum 10 is removed by a cleaning means 24. Of course, in the high-speed printer, the residual toner must be quickly and completely removed from the surface of the photosensitive drum 10, and a large quantity of the residual toner must be dealt with, before toner images can be recorded on a large number of recording sheets. Accordingly, in the high-speed printer, the cleaning means 24 of the type shown in FIG. 1 is used. In particular, the cleaning means 24 comprises a toner recovering container 24*a* having an inlet opening for receiving a part of the surface of the photosensitive drum 10, a fur brush 24*b* provided within the toner recovering container 24*a* so as to be close to the inlet opening, a toner-scraping blade 24*c* extending along an upper edge of the inlet opening, and a screw conveyor 24*d* disposed in the bottom of the toner-recovering container 24*a*. Naturally, the fur brush 26*b* brushes the residual toner off the surface of the photosensitive drum 10, and the toner scraping blade 24*c* scrapes off the residual toner which could not be removed by the fur brush 24*b*. The residual toner scraped off by the toner scraping blade 24*c* falls into the toner-recovering container 24*a*, and then the screw conveyor 24*d* conveys the recovered toner to a predetermined place. Thus, the cleaning means 24 of this type is relatively bulky. Note, after the surface of the photosensitive drum 10 is cleaned by removing the residual toner therefrom with the cleaning means 24, the cleaned surface is irradiated by a charge-eliminating lamp 26 to eliminate a residual charge therefrom.

As the developer used in the above-mentioned developing process, a two-component developer composed of toner component (fine particle of colored resin) and a magnetic carrier component (fine magnetic carriers) is well known. In general, the two-component developer is widely used in multicolor recording. As shown specifically in FIG. 2, the developing device 16 using the two-component developer comprises a developer container 28 for holding the two-component developer, an agitator 30 for agitating the two-component developer to cause the toner component and the magnetic carrier component to be subjected to triboelectrification, and a magnet roller or developing roller 32 for forming a magnetic brush therearound by magnetically attracting a part of the magnetic carrier component. The developing roller 32 is partially exposed from the developer container 28 and faces the photosensitive drum 10. The toner component is attracted electrostatically to the magnetic brush formed around the developing roller 32, and is brought to a facing zone or developing zone between the developing roller and the photosensitive drum due to the rotation of the developing roller, whereby development of an electrostatic latent image can be carried out. Since the density of a toner image obtained by developing an electrostatic latent image is dependent on a quantity of toner brought to the developing zone, the height of the magnetic brush is regulated by a doctor blade 34 to ensure evenness of the density of development. The developer which has passed through the developing zone, i.e., the developer having a reduced toner component, is scraped off the developing roller 32 by a scraper blade 36, and is then returned to the agitating unit 30.

Since the toner compartment is consumed continuously during the developing process, the two-component developer must be properly replenished with a toner component, to thereby maintain a quality of a developed toner image, therefore a recorded toner image, constant. Also, a uniform distribution of the toner component in the magnetic carrier component is an important factor in the quality of the recorded toner image, as well as a sufficient triboelectrification between the toner component and the magnetic carrier component. Further, in a high-speed printer, consumption of the developer in the developing process necessarily becomes larger, and thus the developer must be quickly and efficiently agitated. For this reason, in general, the agitator 30 is constituted as a circulation-type agitator as illustrated. In particular, the agitator 30 comprises a pair of screw conveyors 30*a* and 30*b*, and a partition plate 30*c* disposed therebetween, and the pair of screw conveyors 30*a* and 30*ba* is disposed in parallel with the developing roller 32 within the developer container 28. The pair of screw conveyors 30*a* and 30*b* are extended between the opposite side walls of the developer container 28, and a length of the partition plate 30*c* is smaller than those of the screw conveyors 30*a* and 30*b* such that each of the opposite ends of the partition plate 30*c* is spaced a predetermined distance apart from a corresponding side wall of the developer container 28. The screw conveyors 30*a* and 30*b* are driven so as to move the developer in opposite directions, to thereby produce a circulation path for the developer. In particular, when the screw conveyor 30*a* thrusts the developer one end thereof, the developer is moved to a corresponding end of the screw conveyor 30*b* around a corresponding end of the partition plate 30*c*. When the screw conveyor 30*b* thrusts the developer to the other end thereof, the developer is moved to the other end of the screw conveyor 30*a* around the other end of the partition plate 30*c*. Thus, the developer is circulated along the screw conveyors 30*a* and 30*b*. In the developing device provided with this type agitator 30, a large quantity of developer can be efficiently agitated. Nevertheless, an overall structure of the developing device is relatively large.

Figure 2:
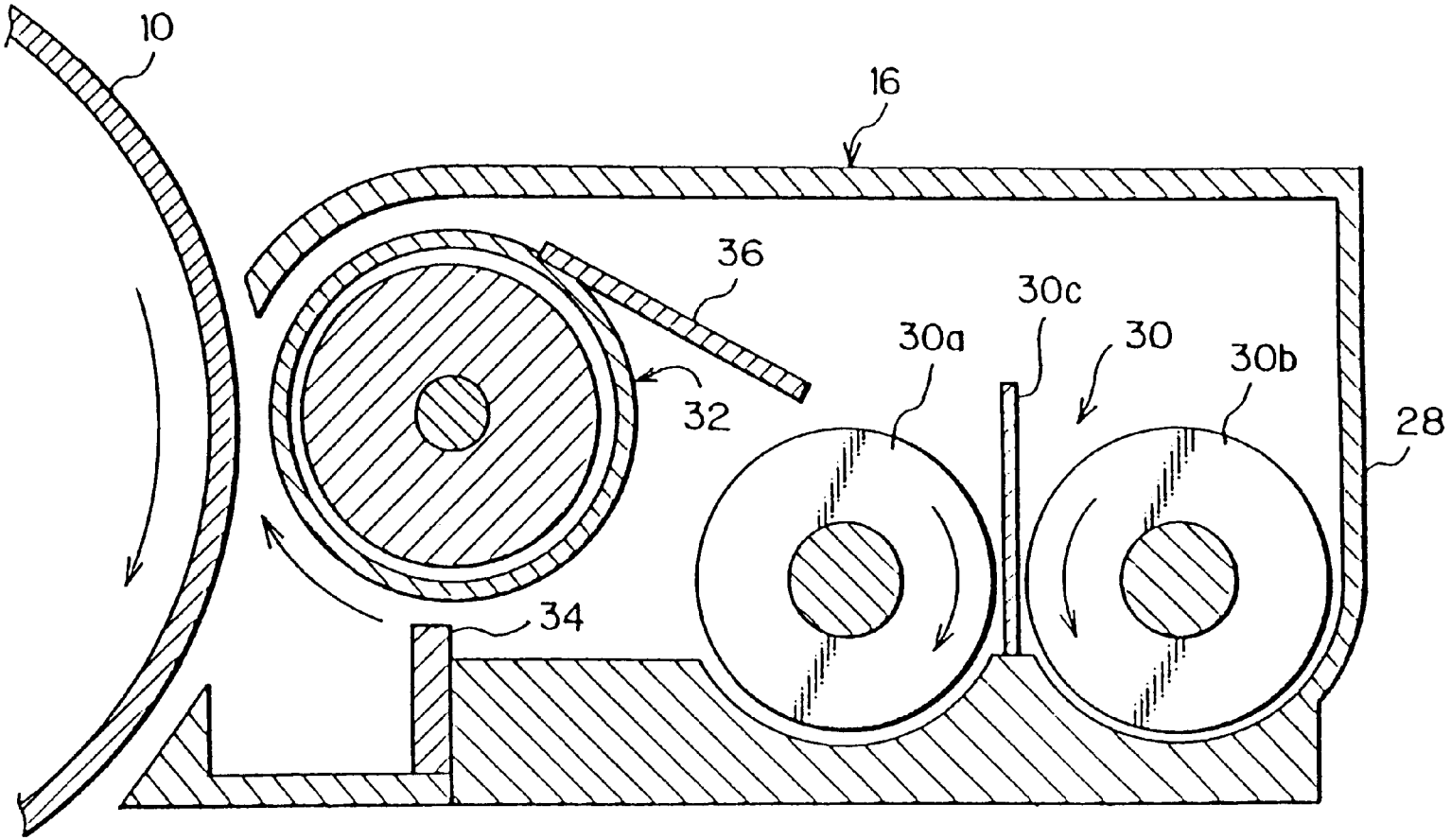
Fig. 2 PRIOR ART
FIG. 2 is an enlarged schematic view of the conventional developing device of FIG. 1.
Figure 3:
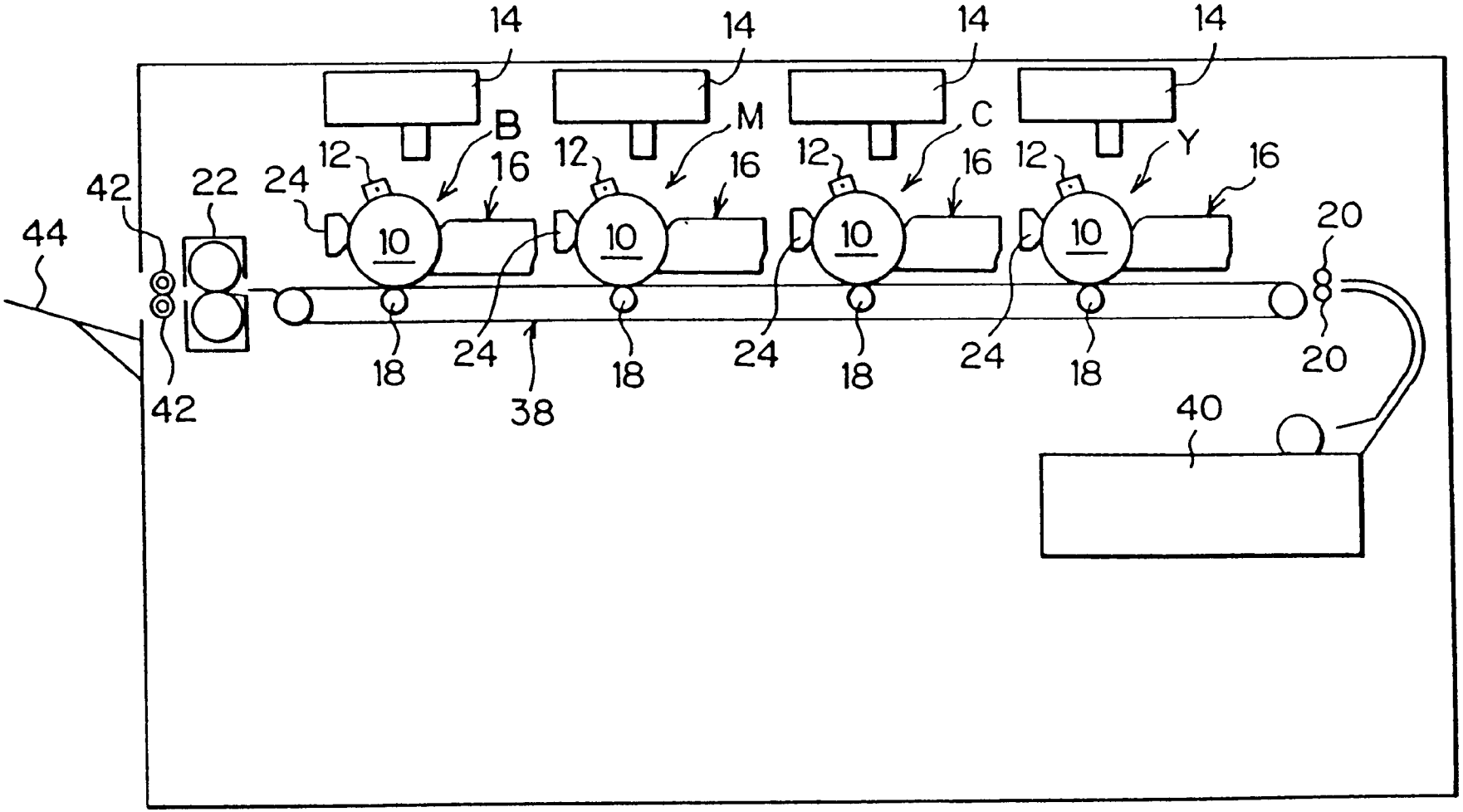
Fig. 3 PRIOR ART
FIG. 3 is a schematic view of a conventional multicolor recording apparatus provided with four electrostatic recording units of the type shown in FIG. 1.

FIG. 3 schematically shows an example of a multidrum type multicolor recording apparatus having electrostatic recording units of the type as shown in FIGS. 1 and 2. This multicolor recording apparatus is provided with four electrostatic recording units Y, C, M and B for full-color recording. The electrostatic recording units Y, C, M and B are identical with each other, and are aligned with along an endless conveyor belt means 38 for conveying a recording sheet of paper. In FIG. 3, elements like or corresponding to those shown in FIG. 1 are designated by the same references. Each of the electrostatic recording units or printers Y, C, M and B features a laser beam scanner used as the optical writing means 14, and a conductive transfer roller as the transfer unit 18. The conductive transfer roller 18 is pressed against a photosensitive drum 10 through the intermediary of an upper run of the endless conveyor belt means 38. The respective developing devices 16 of the electrostatic printers Y, C, M and B use a developer containing an yellow toner component, a developer containing a cyan toner component, a developer containing a magenta toner component and a developer containing a black toner component, respectively. The electrostatic printers Y, C, M and B record an yellow toner image, a cyan toner image, a magenta toner image, and a black toner image, respectively. A pair of register rollers 20 is provided near one end or the inlet end of the endless conveyor belt means 38. In a recording-operation, a recording sheet of paper fed from a sheet feeder unit 40 is once stopped to be on standby at the register rollers 20. Electrostatic latent images are written sequentially on the basis of color image data on the photosensitive drums 10 of the electrostatic printers Y. C, M and B. respectively, and the sheet of paper is sequentially passed through the electrostatic printers Y. C, M and B at a given timing, whereby an yellow toner image, a cyan toner image, a magenta toner image, and a black toner image are sequentially transferred to the sheet of paper to thereby form a full-color image. The sheet of paper carrying the full-color image is passed through a fixing device 22 provided near the other end or outlet end of the endless conveyor belt means 38, to thereby fix the full-color image on the sheet of paper. Thereafter, the sheet of paper is delivered by delivery rollers 42 onto a delivery tray 44 provided outside the multicolor recording apparatus.

As mentioned hereinbefore, the multi-drum multicolor recording apparatus is capable of high-speed multicolor recording operation, but it has a disadvantage in that the construction thereof is large due to the alignment of the electrostatic recording units. Especially, a multidrum type multicolor recording apparatus having high-speed electrostatic printers of the type as depicted in FIG. 1 has a very large construction, because the developing devices and the cleaning means are relatively bulky.

However, the application of a developing device in accordance with the present invention to a multi-drum multicolor recording apparatus as mentioned above enables the multi-drum type multicolor recording apparatus to be relatively small.

Figure 4:
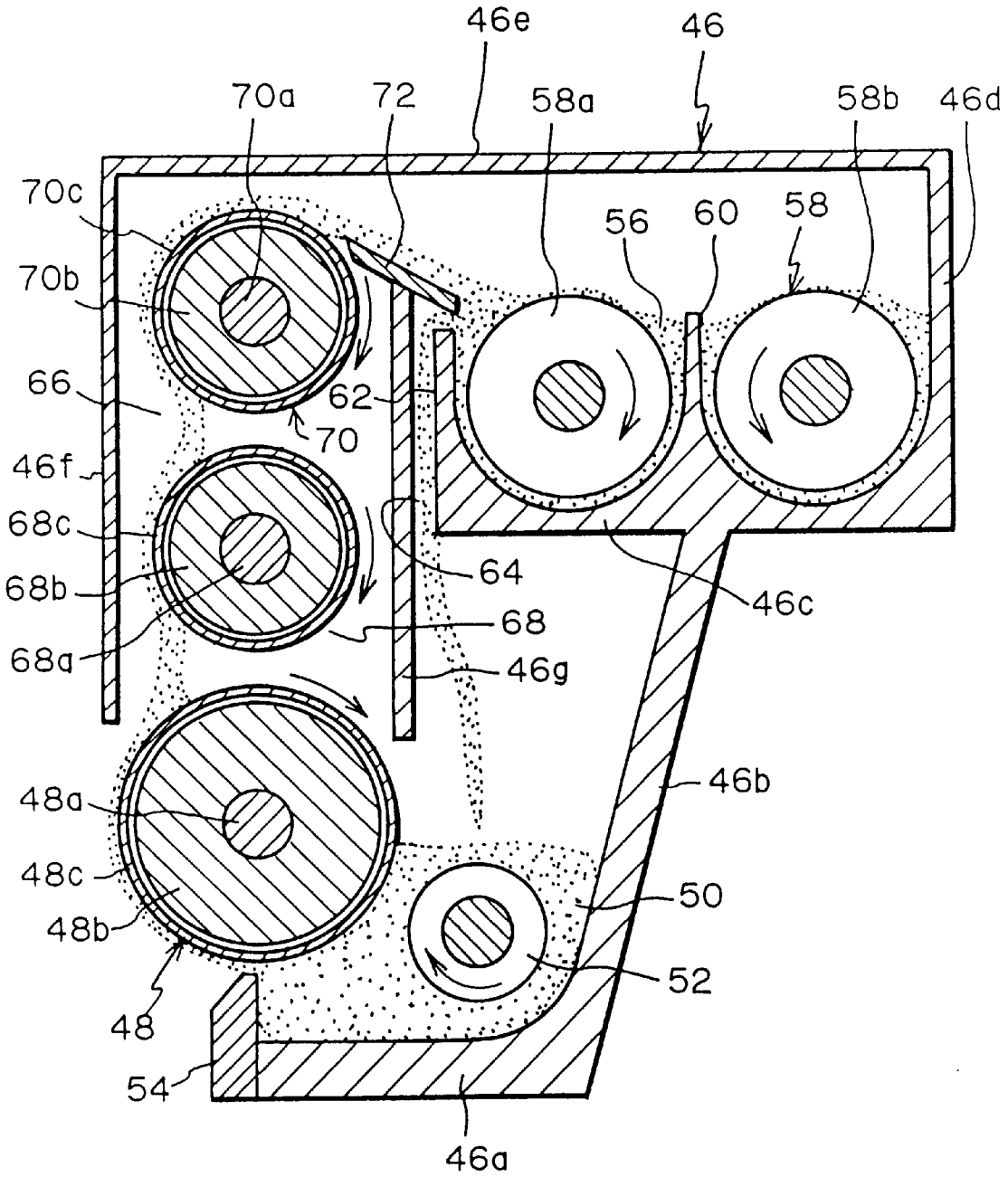
FIG. 4 is a schematic cross-sectional view showing a first embodiment of a developing device according to the present invention.
Figure 5:
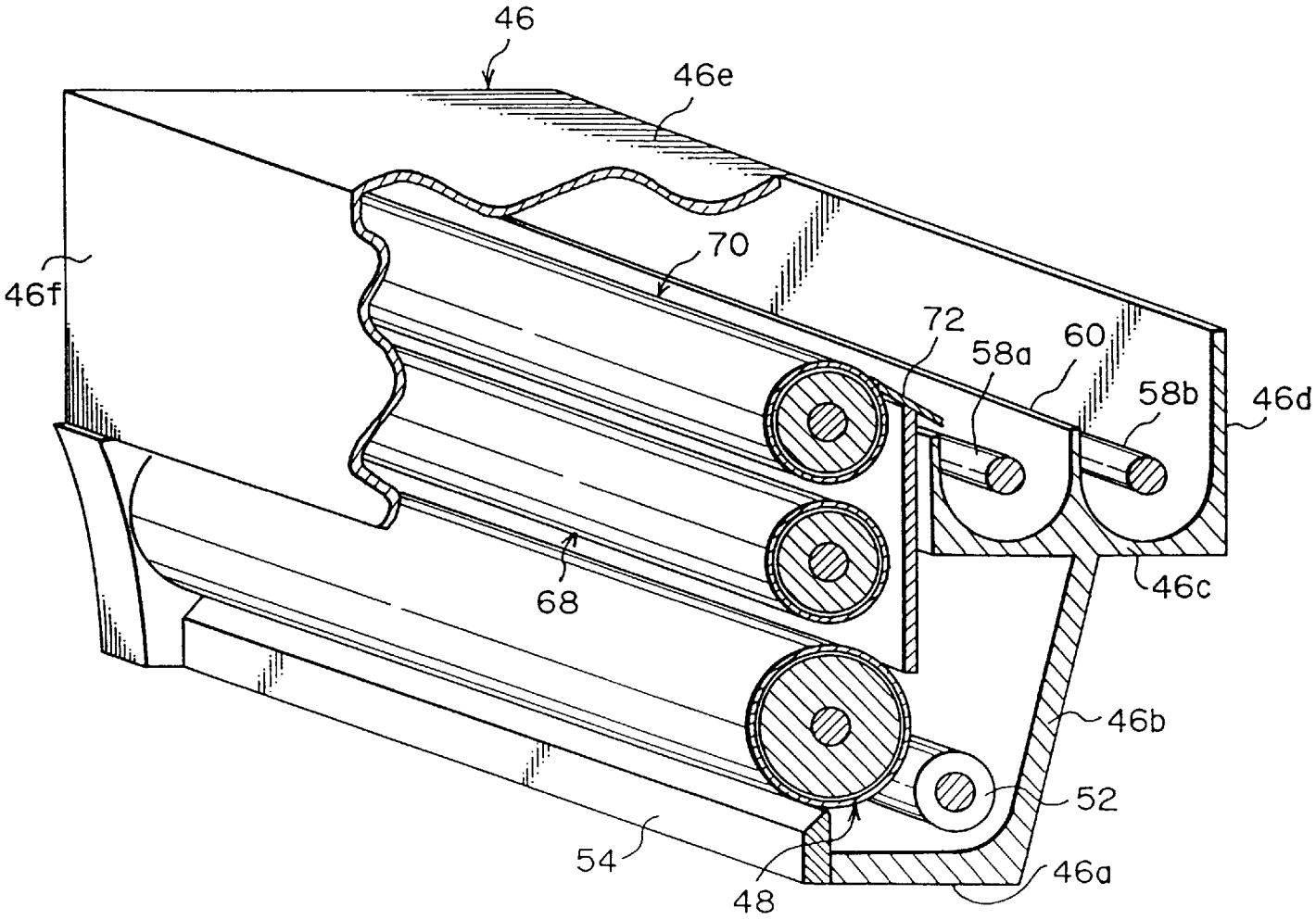
FIG. 5 is a perspective sectional view of the developing device of FIG. 4.

Referring now to FIGS. 4 and 5, there is shown a first embodiment of a developing device according to the present invention, which comprises a developer container 46 for holding a two-component developer. Note, in FIG. 4, the two-component developer held in the developer container 46 is represented by fine dots. The developer container 46 has a first bottom wall 46*a*, a first back wall 46*b* extending upward from a back end of the first bottom wall 46*a*, a second bottom wall 46*c* horizontally extending on the upper end of the first back wall 14*b*, a second back wall 46*d* extending upward from a back end of the second bottom wall 46*c*, a top wall 46*e* extending horizontally forward from an upper end of the second back wall 46*d*, and a front wall 46*f* extending downward from a front end of the top wall 46*e*. Opposite side walls (not shown) are integrally joined to the opposite ends of the walls 46*a* through 46*f*, respectively. Note, in this embodiment, the second back wall 46*d*, the top wall 46*e* and the front wall 46*f* are integrally formed as in a single piece, but the top wall 46*e* may be constituted as a detachable wall, if necessary.

As shown in FIGS. 4 and 5, the developer container 46 has an opening defined by a front end of the first bottom wall 46*a* and a lower end of the front wall 46*f*, and a magnetic roller or a developing roller 48 is disposed in the opening such that a part of a surface of the developing roller 48 is exposed therefrom. In this embodiment, the developing roller 48 comprises a shaft 48*a* fixedly supported on the opposite side walls of the developer container 46, a core 48*b* formed of a magnetic material and fixedly mounted on the shaft 48*a*, and a sleeve 48*c* formed of a nonmagnetic material such as aluminum and provided on the core 48*b* to be rotatable therearound. During an operation of the developing device, the sleeve 48*c* is rotationally driven in a direction indicated by the arrow in the drawing. When the developing device is incorporated in an electrostatic recording unit, the exposed surface of the developing roller 48 and with the exposed surface of the developing roller 48, therefore the exposed surface of the sleeve 48*c* faces and electrostatic latent image carrying body such as a photosensitive drum.

The first bottom wall 46*a* of the developer container 46 provides a developer-accumulating chamber 50, and a paddle roller 52 is extended in the developer-accumulating chamber 50. The paddle roller 52 is rotatably supported by the opposite side walls of the developer container 46, and is rotationally driven in a direction indicated by the arrow in the drawing during an operation of the developing device. The developer held in the developer-accumulating chamber 50 is fed to the developing roller 48 by the paddle roller 52, and is entrained by the developing roller 48 in the same manner as the developing roller 32 of FIG. 2, whereby the developer is brought to the facing zone or developing zone between the developing roller 48 and the electrostatic latent image carrying body or photosensitive drum. A doctor blade 54 is attached to the front edge of the first bottom wall 48*a* such that a quantity of developer to be brought to the developing zone by the developing roller 48 is regulated at a given extent.

The second bottom wall 46*c* of the developer container 46 provides a developer-agitating chamber 56 placed above the developer-accumulating chamber 50. A developer-agitating unit 58 is provided in the developer agitating chamber 56, and comprises a pair of screw conveyors 58*a* and 58*b* extended in parallel to each other between the opposite side walls of the developer container 46. As shown in FIGS. 4 and 5, the second bottom wall 46*c* has a pair of curved recesses formed in an upper surface thereof for receiving the helical screws of the screw conveyors 58*a* and 58*b*. Note, in FIG. 4, the helical screws of the screw conveyors 58*a* and 58*b* are represented by circles in FIG. 4, but, in FIG. 5, only the shafts of the screw conveyors 58*a* and 58*b* are shown, the helical screws thereof being omitted for simplicity. During an operation of the developing device, the shafts of the screw conveyors 58*a* and 58*b* are supported rotatably on the opposite side walls of the developer container 46, and are rotationally driven in directions indicted by the arrows in the drawing (i.e., in opposite directions), respectively. In this embodiment, both the helical screws of the screw conveyors 58*a* and 58*b* are formed as right-hand screws. Accordingly, in FIG. 4, the screw conveyor 58*a* thrusts the developer away from the viewer, and the screw conveyor 58*b* thrusts the developer toward the viewer. A partition plate 60 is extended upright from the second bottom wall 46*c* between the conveyor screws 58*a* and 58*b*. The length of the partition plate 60 is shorter than those of the screw conveyors 58*a* and 58*b*, and the opposite ends of the partition plate 60 are spaced a predetermined distance apart from the side walls of the developer container 46, respectively. Similarly to the screw conveyors 30*a* and 30*b* previously described with reference to FIG. 2, the screw conveyors 58*a* and 58*b* form a circulation path for the developer. Namely, when the screw conveyor 58*a* thrusts the developer to one end thereof, the developer is moved to a corresponding end of the screw conveyor 58*b* around a corresponding end of the partition plate 60. When the screw conveyor 58*b* thrusts the developer to the other end thereof, the developer is moved to the other end of the screw conveyor 58*a* around the other end of the partition plate 60. Thus, the developer is circulated along the screw conveyors 58*a* and 58*b*.

As shown in FIGS. 4 and 5, a vertical partition wall 46*g* is extended between the opposite side walls of the developer container 46, and is spaced from the front surface 62 of the second bottom wall 46*c* so as to form a space of a predetermined width there between. This space serves as a communication passage 64 for communicating the developer-agitating chamber 56 with the developer-accumulating chamber 56. An upper end of the communication passage 64 forms an overflow opening through which a part of the developer circulated by the developer-agitating unit 58 overflows into the communication passage 64, and the overflowing developer falls by gravity into the developer-accumulating chamber 50, whereby the developer can be suitably fed thereto.

A developer-lifting passage 66 is defined by the front wall 46*f* and the vertical partition wall 46*g* of the developer container 46 so as to be vertically extended just above the developing roller 48, as shown in FIG. 4. Two magnet rollers 68 and 70, which are substantially the same in construction as the developing roller 48 formed as the magnet roller, are vertically aligned with each other in the developer-lifting passage 64. The respective magnet rollers 68 and 70 comprise shafts 68*a* and 70*a* fixedly supported by the opposite side walls of the developer container 46, cores 68*b* and 70*b* formed of a magnetic material and fixedly mounted on the shafts 68*a* and 70*a*, and sleeves 68*c* and 70*c* formed of a nonmagnetic material such as aluminum and rotatably provided on the cores 68*b* and 70*b*. During an operation of the developing device, the sleeves 68*c* and 70*c* are rotationally driven in the same direction indicated the arrows in the drawing.

Figure 6:
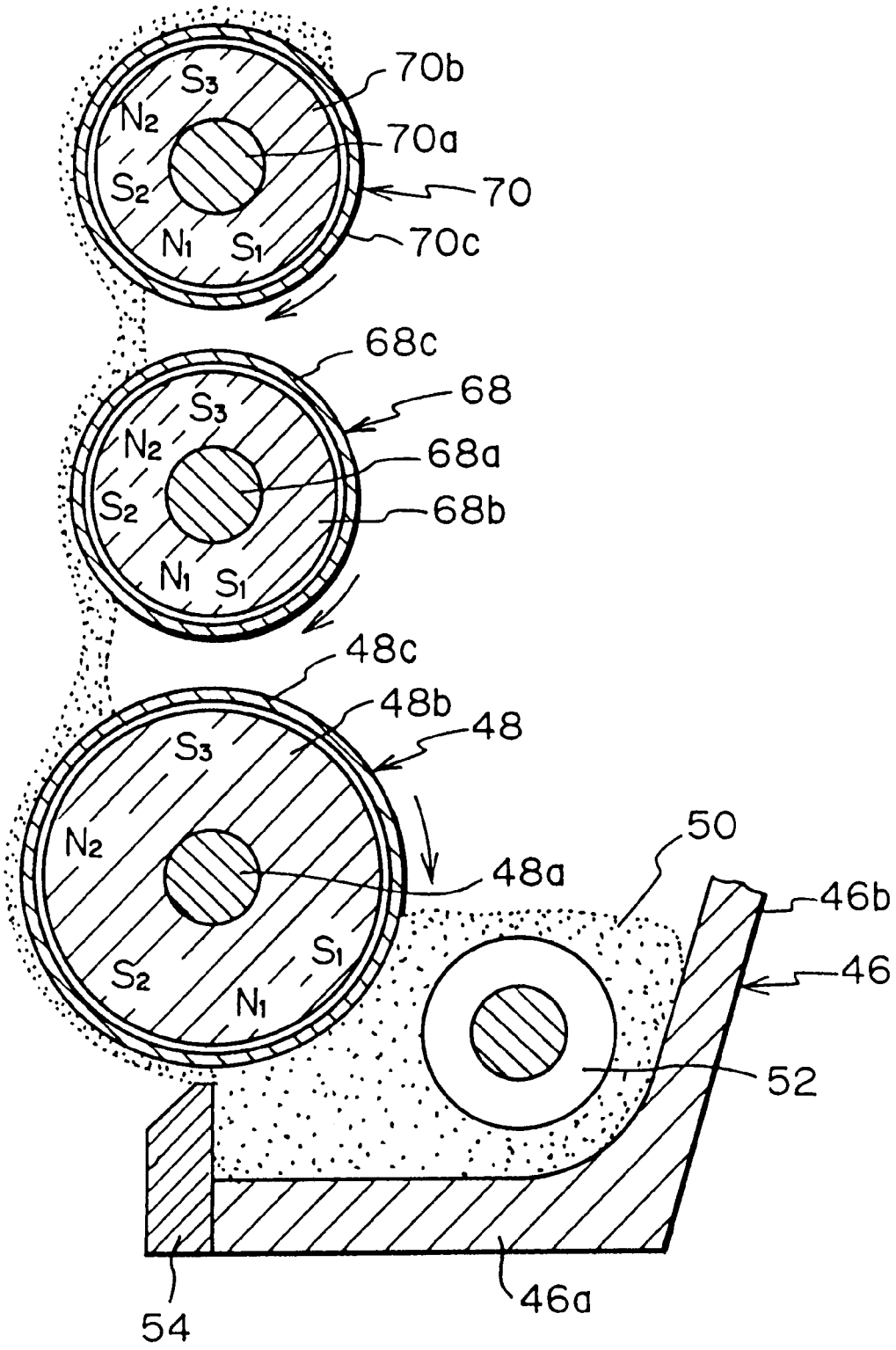
FIG. 6 is an enlarged sectional view of a part of the developing device of FIG. 4.

The respective cores 84*c*, 68*c*, and 70*c* of the developing roller 48 and the magnet roller 68 and the magnet roller 70 are locally magnetized as shown in FIG. 6, and this local magnetization can be performed by locally applying a magnetic field to the cores 48*c*, 68*c*, and 70*c*. As is apparent from FIG. 6, the core 48*c* has three S-poles $S_1$, $S_2$, and $S_3$ arranged at appropriate angular intervals on the surface thereof, and two N-poles $N_1$ and $N_2$ arranged between the adjacent ones of the three S-poles. The core 68*c* has three S-poles $S_1$, $S_2$, and $S_3$ arranged at appropriate angular intervals on the surface thereof, and two N-poles $N_1$ and $N_2$ arranged between the adjacent ones of the three S-poles, and the same is true for the core 70*c*.

Figure 7:
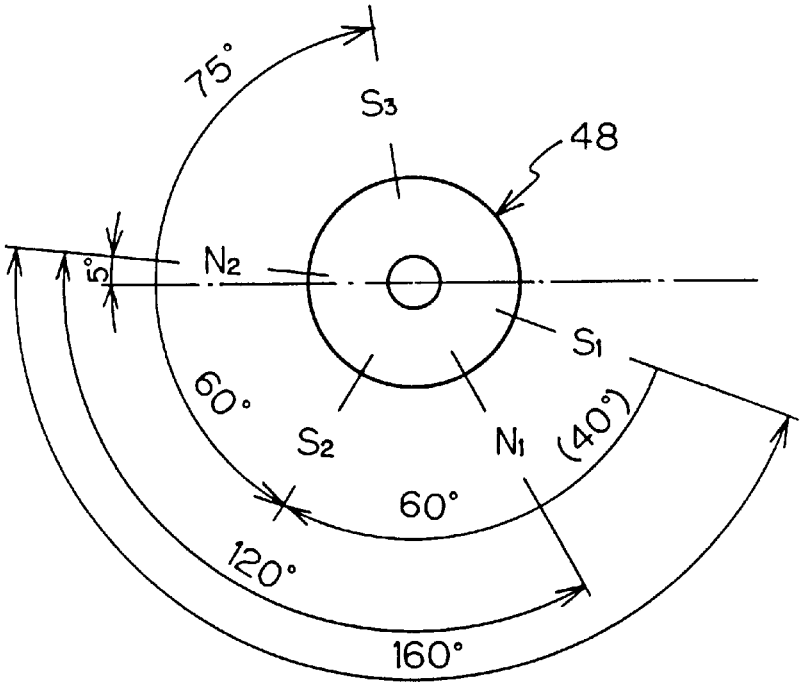
FIG. 7 is a diagrammatic view for explaining a positional relationship between magnetic poles of a developing roller, i.e., a magnet roller, used in the developing device of FIG. 4.
Figure 8:
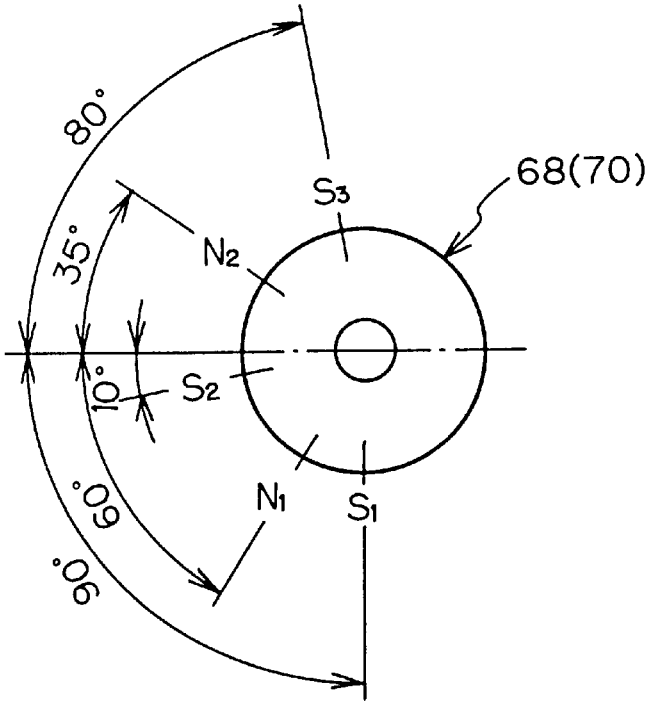
FIG. 8 is a diagrammatic view for explaining a positional relationship between magnetic poles of a developer lifting magnet roller used in the developing device of FIG. 4.

Referring to FIG. 7, a positional relationship between the magnetic poles of the developing roller 48 is diagrammatically shown by way of example. As apparent from this drawing, the N-pole $N_1$ is at an angular position of 5° measured clockwise from a horizontal plane including the central axis of the developing roller 48; the N-pole $N_2$ is at an angular position of 120° measured counterclockwise from the N-pole $N_1$; the S-pole $S_1$ is at an angular position of 160° separated counterclockwise from the N-pole $N_2$; the S-pole $S_2$ is at an angular position of 60° measured counterclockwise from the N-pole $N_2$; and the S-pole $S_3$ is at an angular position of 75° measured clockwise from the N-pole $N_2$. Referring to FIG. 8, a positional relationship between the magnetic poles of each of the magnet rollers 68 and 70 is diagrammatically shown by way of example. The N-pole $N_2$ is at an angular position of 35° measured clockwise from a horizontal plane including the central axis of the magnet roller; the N-pole $N_1$ is at an angular position of 60° measured counterclockwise from the horizontal plane; the S-pole $S_1$ is at an angular position of 90° counterclockwise from the horizontal plane, the S-pole $S_2$ is at an angular position of 10° measured from the horizontal plane; and the S-pole $S_3$ is at an angular position of 80° measured clockwise from the horizontal plane.

According to the positional relationship between the magnetic poles of the developing roller 48, a magnetic field is produced between the adjacent magnetic poles of the opposite polarities, and no magnetic field is produced between the S-poles $S_1$ and $S_3$. Similarly, according to the positional relationship between the magnetic poles of the magnetic roller 68, 70, a magnetic field is produced between the adjacent magnetic poles of the opposite polarities, and any magnetic field is not produced between the S-poles $S_1$ and $S_3$. Further, according to the positional relationship between the developing roller 48, the magnet roller 68, and the magnet roller 70, a production of a magnetic field is prevented between the developing roller 48 and the magnet roller 68 because the S-pole $S_3$ of the developing roller 48 is adjacent to the S-pole $S_1$ of the magnet roller 68, and also a production of magnetic field is prevented between the magnet rollers 68 and 70 because the S-pole $S_3$ of the magnet roller 68 is adjacent to the S-pole $S_1$ of the magnet roller 70. Thus, as is apparent from FIGS. 4 and 6, when the respective sleeves 48*c*, 68*c*, and 70*c* of the developing roller 48 and the magnet rollers 68 and 70 are rotationally driven, the developer brought to and passed through the developing zone by the developing roller 48 is lifted along the front sides of the magnet rollers 68 and 70 without being returned to the developer-accumulating chamber 50.

To ensure a smooth upward lift of the developer from the developing roller 48 to the magnet roller 68, for example, the respective magnetic poles of the developing roller 48 and the respective magnetic poles of the magnet roller 68 may be given magnetic flux densities, as tabulated in the following table:

| Polarity | Roller 48 | Roller 68 |
|---|---|---|
| $N_1$ | 590 G (Gauss) | 750 G (Gauss) |
| $N_2$ | 850 G (Gauss) | 700 G (Gauss) |
| $S_1$ | 510 G (Gauss) | 600 G (Gauss) |
| $S_2$ | 850 G (Gauss) | 700 G (Gauss) |
| $S_3$ | 650 G (Gauss) | 660 G (Gauss) |

In the above-table, it should be noted that the magnetic flux density (750 G) of the N-pole $N_1$ of the magnet roller 68 is greater than the magnetic flux density (650 G) of the S-pole $S_3$ of the developing roller 48, whereby the lift of the developer from the developing roller 48 to the magnet roller 68 can be facilitated. Although the magnetic flux densities of the magnetic poles of the magnet roller 70 are equal to those of the corresponding magnetic poles of the magnet roller 68, it is preferable to make the magnetic flux density of the N-pole $N_1$ of the magnet roller 70 to be greater than that of the S-pole $S_3$ of the magnet roller 68, similar to the relationship between the developing roller 48 and the magnet roller 68.

As shown in FIGS. 4 and 5, a scraper member 72 is attached to an upper end of the vertical partition wall 46*g* such that a front edge thereof is positioned slightly behind the S-pole $S_3$ of the magnet roller 70, whereby the developer lifted from the developing roller 48 to the magnet roller 70 can be separated from the surface of the magnet roller 70 so as to be fed to the developer-agitating chamber 56.

In short, the developer held in the developer container 46 is supplied from the developer-agitating chamber 56 through the communication passage 674 into the developer-accumulating chamber 50, and is then brought to and is passed through the developing zone by the developing roller 48. Thereafter, the developer is lifted from the developing roller 48 by the magnet rollers 68 and 70, and is then returned to the developer-agitating chamber 56 by the scraper member 72. In this way, during an operation of the developing device, the developer is continuously circulated in the developer container 46 to ensure tat the well mixed developer (i.e., the developer in which the toner component and the magnetic carrier component are sufficiently subject to triboelectrification, and in which the toner component is uniformly distributed in the magnetic carrier component) is continuously supplied to the developer-accumulating chamber 50.

Figure 9:
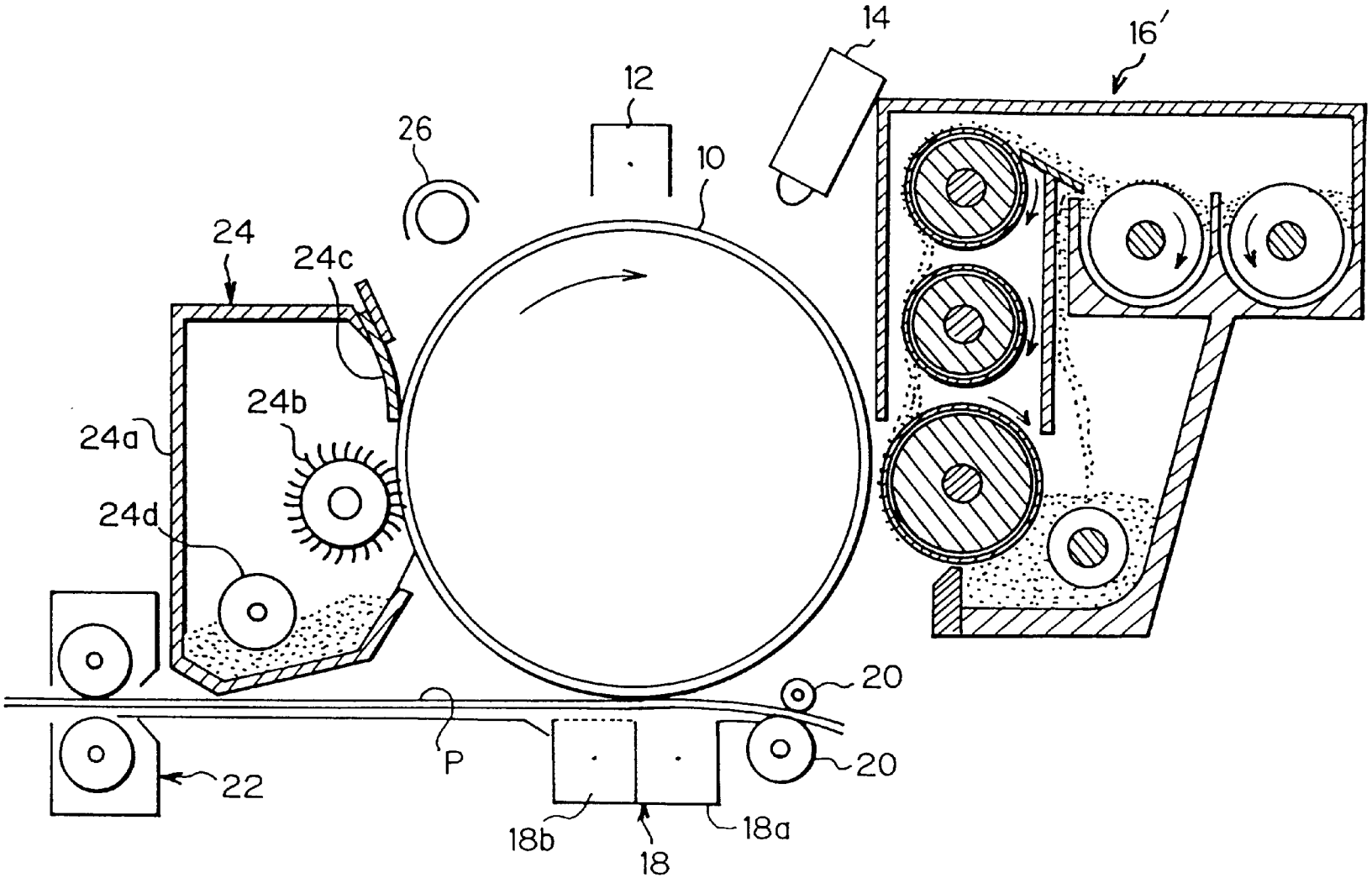
FIG. 9 is a schematic view of an electrostatic recording unit having the developing device of FIG. 4 incorporated therein.
Figure 10:
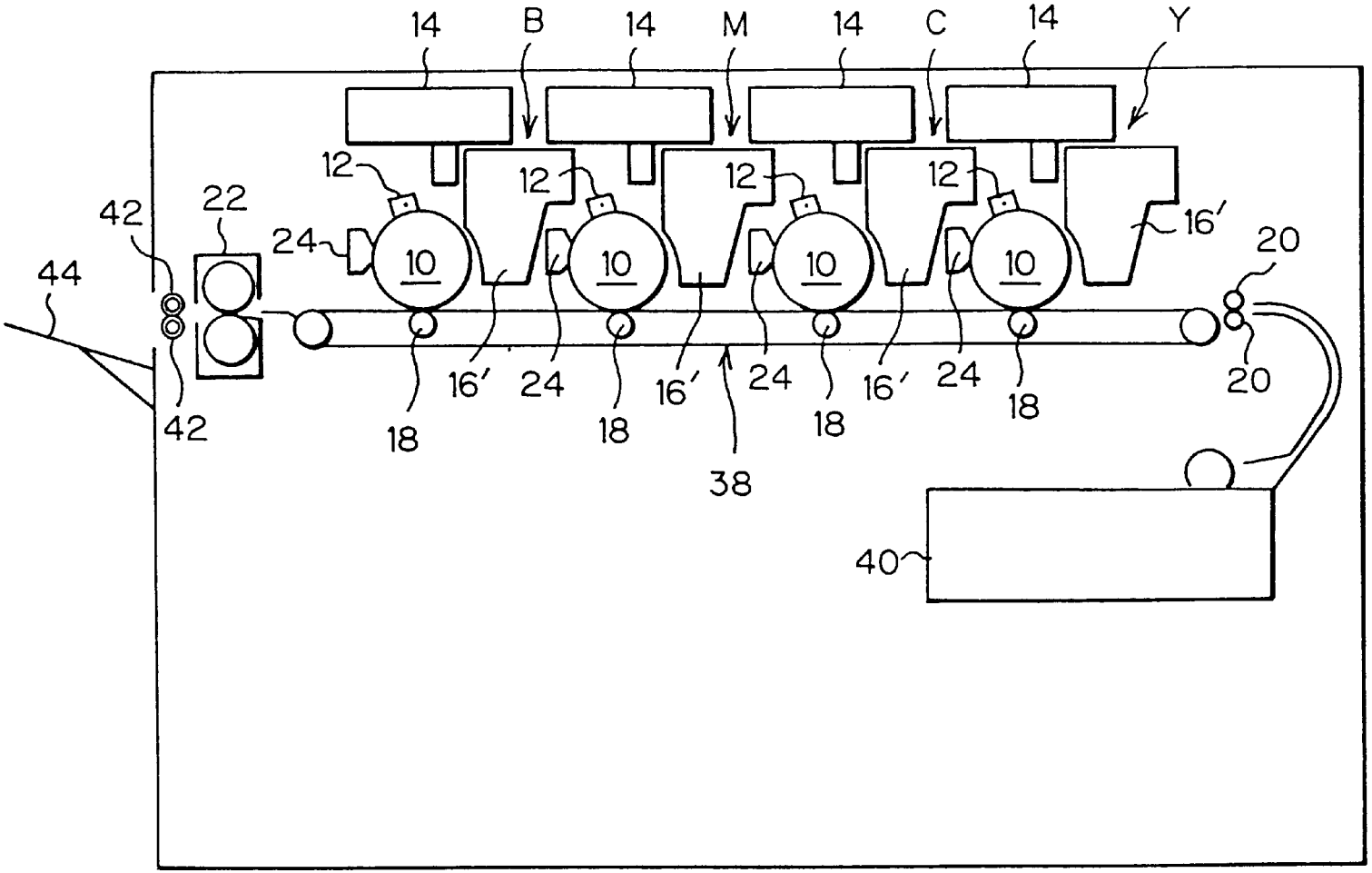
FIG. 10 is a schematic view of a multicolor recording apparatus provided with four electrostatic recording units of the type shown in FIG. 9.

Referring to FIG. 9 which is similar to FIG. 1 showing the electrostatic recording unit provided with the conventional developing device, an electrostatic recording unit provided with the developing device according to the present invention is shown. Note, in FIG. 9, elements like or corresponding to those shown in FIG. 1 are designated by the same references, and the developing device according to the present invention is designated by reference 16'. The developing device 16' features a structural arrangement in which a lower structural portion thereof (i.e., a structure below the second bottom wall 46*c*) has a substantially reduced size, and thus provides a large empty space, which has been occupied by a part of the arrangement of the conventional developing device 16. According to this structural feature, a multicolor recording apparatus can be substantially miniaturized, as shown in FIG. 3. FIG. 7 shows an embodiment of a multicolor recording apparatus, which is similar to the multicolor recording apparatus of FIG. 3, provided with four electrostatic recording units of the type as shown in FIG. 9. In FIG. 10, elements like or corresponding to those shown in FIG. 3 are designated by the same references, and the developing devices according to the present invention are indicated by reference 16'. As is apparent from FIG. 10, due to the fact that each of the developing devices 16' according to the present invention has a lower structure of a substantially reduced size, a cleaning means 24 included in one of the two adjacent electrostatic recording units can be disposed in a space below the second bottom wall 46*c* of the developer container 46 included in the other electrostatic recording unit, whereby a length of the alignment of the four electrostatic recording units Y, C, M, and B can be substantially reduced. As is apparent from the comparison of FIG. 10 with FIG. 3, an overall construction of the multicolor recording apparatus according to the present invention can be substantially miniaturized.

It should be understood that, although the polarities of all the magnetic poles of the developing roller 48 and the magnet rollers 68 and 70 are reversed in the above-mentioned first embodiment, the developer can be brought by the developing roller 48, and can be then lifted by the magnet rollers 68 in the same manner. Also, the arrangement of the magnetic poles shown in FIGS. 6 to 8 is merely illustrated by way of example, and it should be understood that the magnetic poles may be arranged in another arrangement. Furthermore, although, in the first embodiment, the periphery of the respective cores 48*b*, 68*b*, and 70*b* of the developing roller 48 and magnet rollers 68 and 70 are locally magnetized, a plurality of bar magnets may be fixedly arranged along the inner periphery of the sleeves 48*c*, 68*c*, and 70*c*, instead of the cores.

Figure 11:
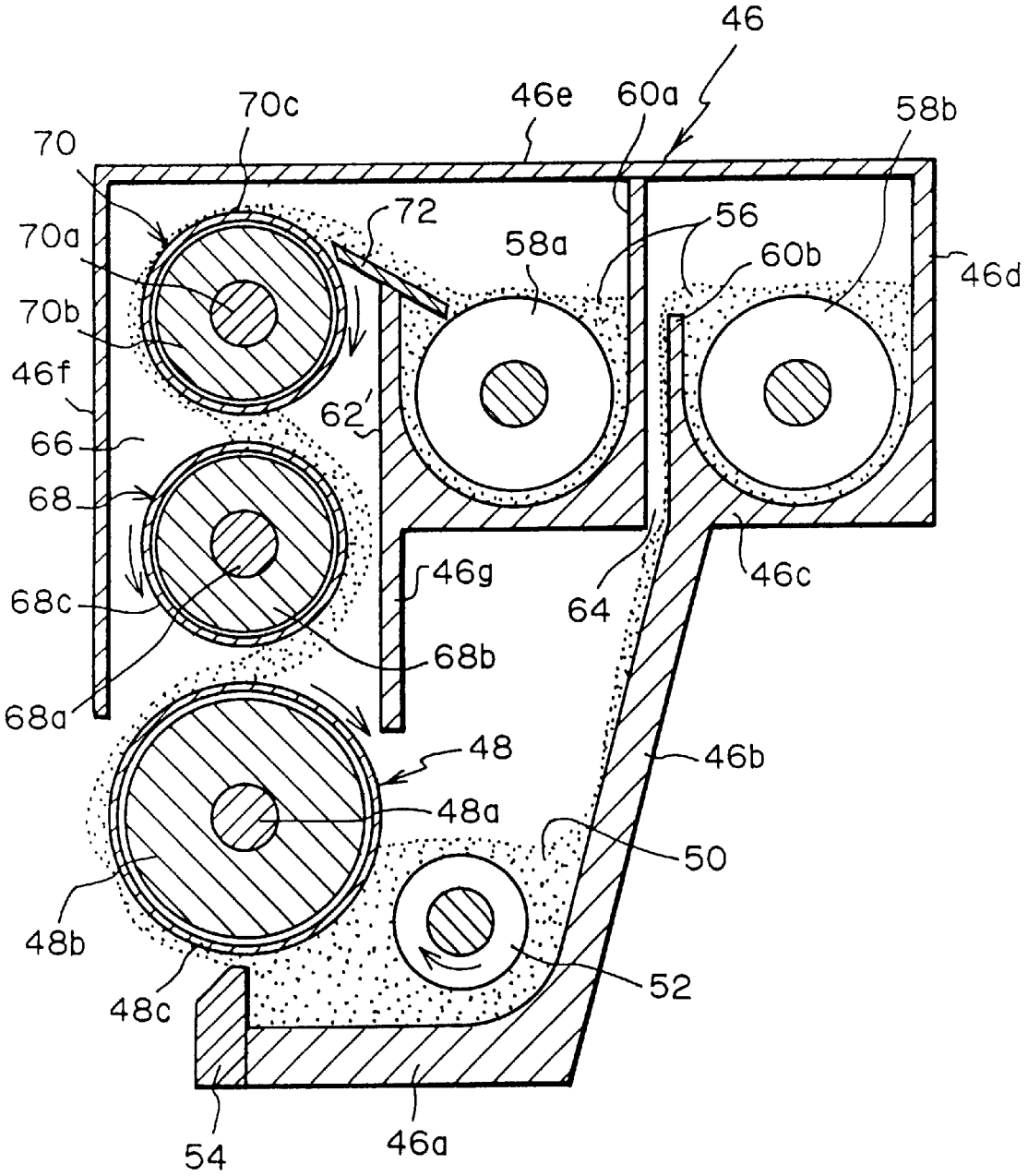
FIG. 11 is a schematic cross-sectional view of a second embodiment of a developing device according to the present invention.
Figure 12:
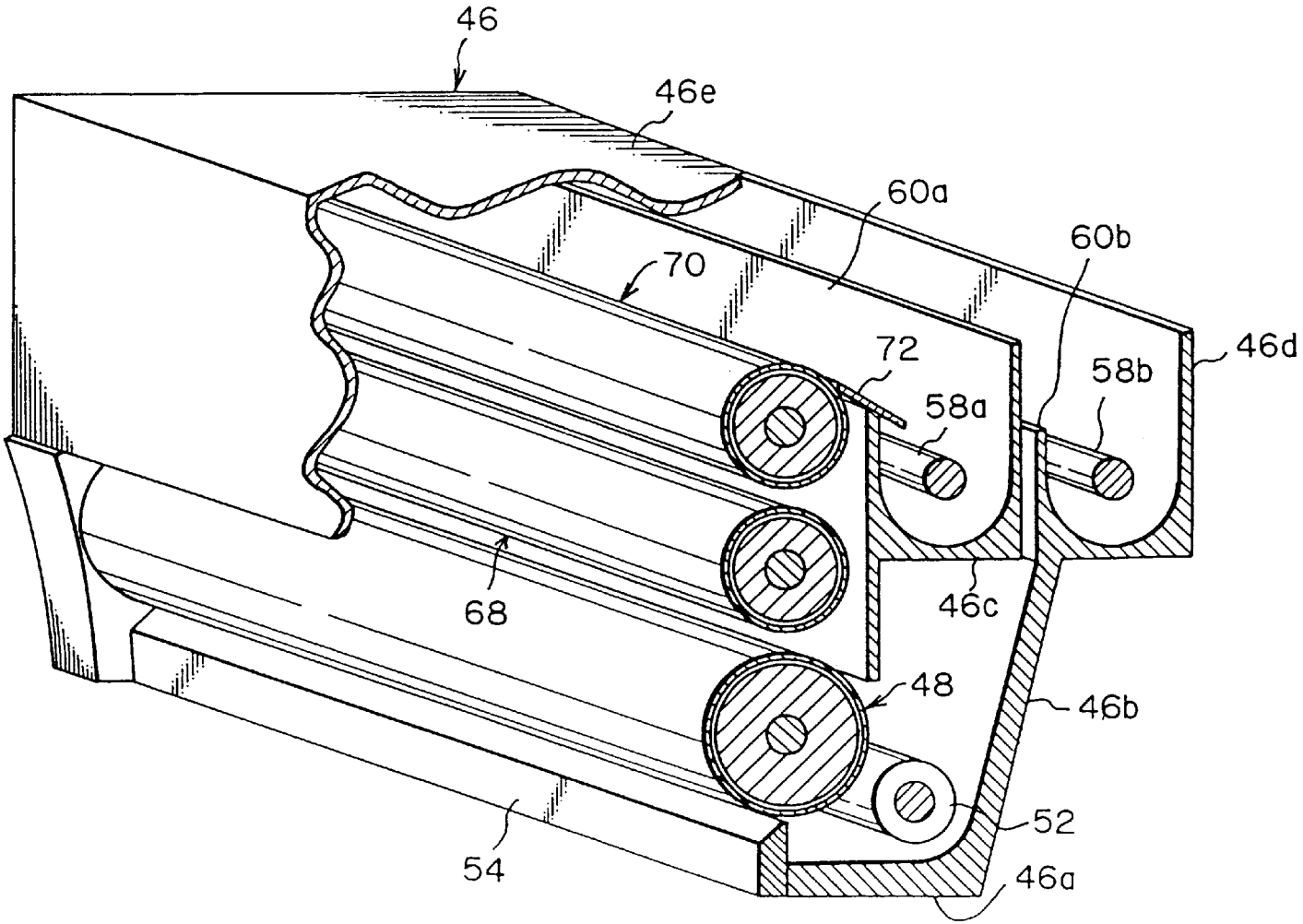
FIG. 12 is a perspective sectional view of the developing device of FIG. 11.

FIGS. 11 and 12 show a second embodiment of a developing device according to the present invention, which is constituted in substantially the same manner as the first embodiment as mentioned above. Note, in FIGS. 11 and 12, elements like or corresponding to those shown in FIGS. 4 and 5 are designated by the same references. As is apparent from FIG. 11, in the second embodiment, a communication passage 64 between a developer-agitating chamber 56 and a developer-accumulating chamber 50 is extended through a middle part of a second bottom wall 46*c*, and screw conveyers 58*a* and 58*b* are disposed on the opposite sides of the communication passage 64, respectively. The communication passage 64 is defined by a pair of partition plates 601 and 60*b* disposed between the screw conveyors 58*a* and 58*b*, and a length of the communication passage 64 is equal to those of the partition plates 60*a* and 60*b*. Similar to the above-mentioned partition plate 60, the lengths of the partition plates 60*a* and 60*b* are smaller than those of the screw conveyors 58*a* and 58*b*, and the opposite ends of the partition plates 60*a* and 60*b* are spaced a predetermined distance apart from the corresponding side walls of a developer container 46. Accordingly, similar to the first embodiment, the screw conveyors 58*a* and 58*b* of the second embodiment form a developer-circulating passage in the developer-agitating chamber 56. As is apparent from FIG. 11, one of the partition plates 60*a* and 60*b*, i.e., the partition plate 60*a* is extended to an upper wall 46*e*, whereas the other partition wall 60*b* has a height lower than a level of the respective tops of the screw conveyors 58*a* and 58*b*.

Accordingly, the upper end opening of the communication passage 64 forms an overflow opening for the developer contained in the developer-agitating chamber 56.

As is apparent from FIGS. 11 and 12, in the second embodiment, a vertical partition wall 46*g* is formed integrally with a front part 62' of the second bottom wall 46*c*, and a scraper member 72 is attached to the upper end of the front part 62'. The vertical partition wall 46*g* and the front part 62' of the second bottom wall 46*c* define a developer-lifting passage 66 together with a front wall 46*f*.

Figure 13:
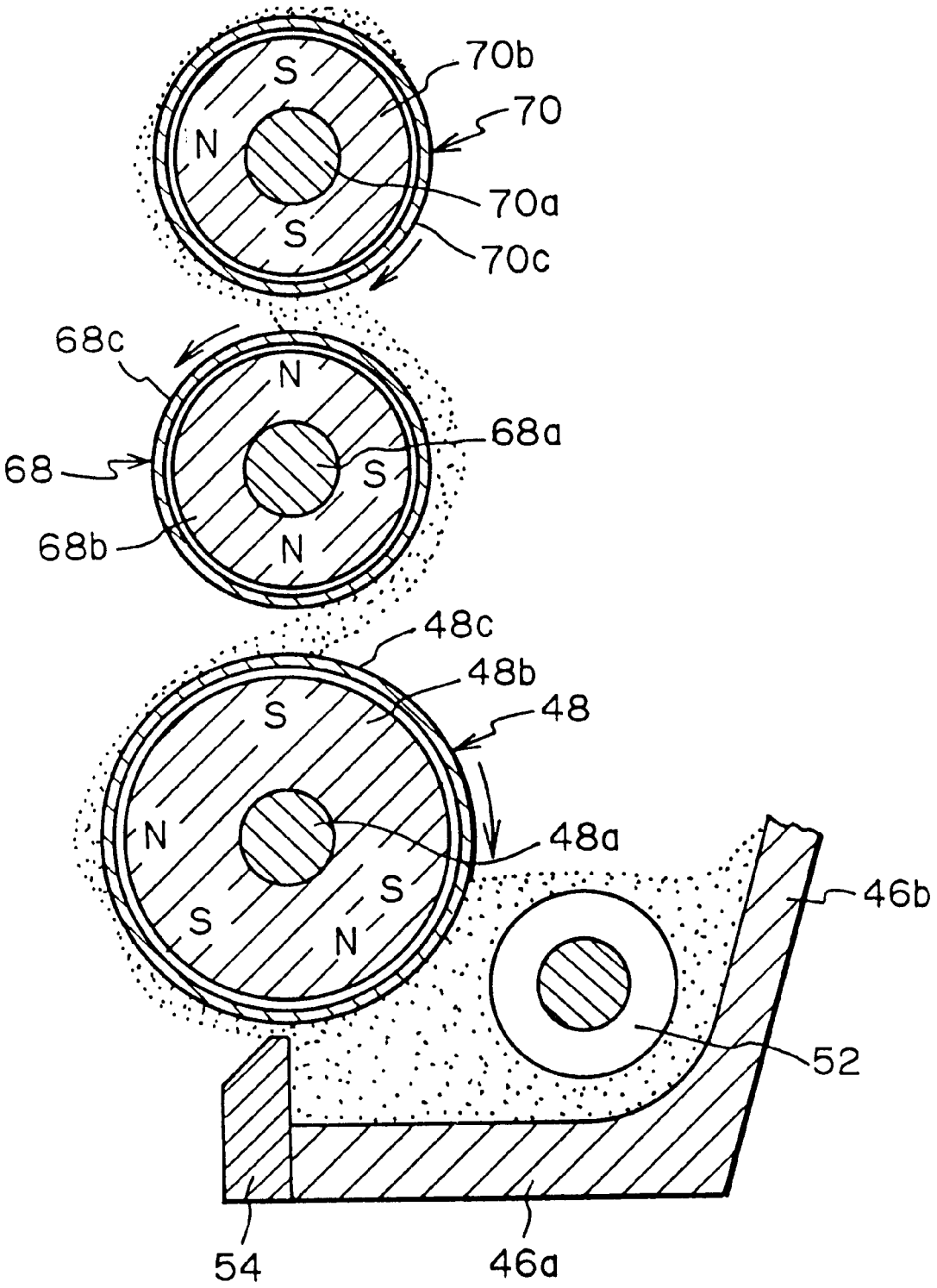
FIG. 13 is an enlarged view of a part of the developing device of FIG. 11.

As shown in FIG. 13, in the second embodiment, the magnetic poles of a developing roller 46 are arranged in substantially the same manner as the first embodiment, but the arrangement of the magnetic poles of the magnetic rollers 68 and 70 is different from that of the first embodiment. In the first embodiment, the magnet rollers 68 and 70 is substantially identical with each other in the arrangement of the magnetic poles. Nevertheless, in the second embodiment, the magnetic rollers 68 and 70 are analogous in the arrangement of the magnetic poles, but they are opposite to each other in the polarities of the magnetic poles. Further, although the developing roller 48, and the magnet rollers 68 and 70 of the first embodiment are rotated in the same direction, only the magnet roller 68 of the second embodiment is rotated in a direction opposite the direction in which the developing roller 48 and the magnet roller 70 thereof are rotated. Thus, as shown in FIGS. 12 and 13, in the second embodiment, the developer transported by the developing roller 48 is lifted along an S-shaped route by the magnet rollers 68 and 70.

Similar to the first embodiment, it is obvious that the second embodiment so constituted enables the miniaturization of the multicolor recording apparatus. Since, in the second embodiment, the developer transported by the developing roller 48 is lifted along the S-shaped route by the magnet rollers 68 and 70, the developer can bed relatively smoothly moved upward from the developing roller 48 to the magnet roller 68, and then upward from the magnet roller 68 to the magnet roller 70. This developer-lifting means (68 and 70) may be applied to the first embodiment. Nevertheless, before the developing-lifting means (68 and 70) may be applied to the first embodiment, the influence of the magnetic fields, produced by the magnet rollers 68 and 70 of the second embodiment, on the developer falling along the front surface of the second bottom wall 47*c* must be reduced as much as possible. Otherwise, the developer falling along the front surface 62 of the second bottom wall 46*c* is magnetically attracted to the vertical partition wall 46*g*, resulting a clogging of the communication passage 64 with the attracted developer.

Although, in each of the first and second embodiments, the developer-lifting means including two magnet rollers 68 and 70 is used for lifting the developer form the developing roller 48 and for returning the same to the developer-agitating chamber 56, it should be understood that the developer raising means may be provided with a single magnet roller or more than two magnet rollers, if necessary.

Figure 14:
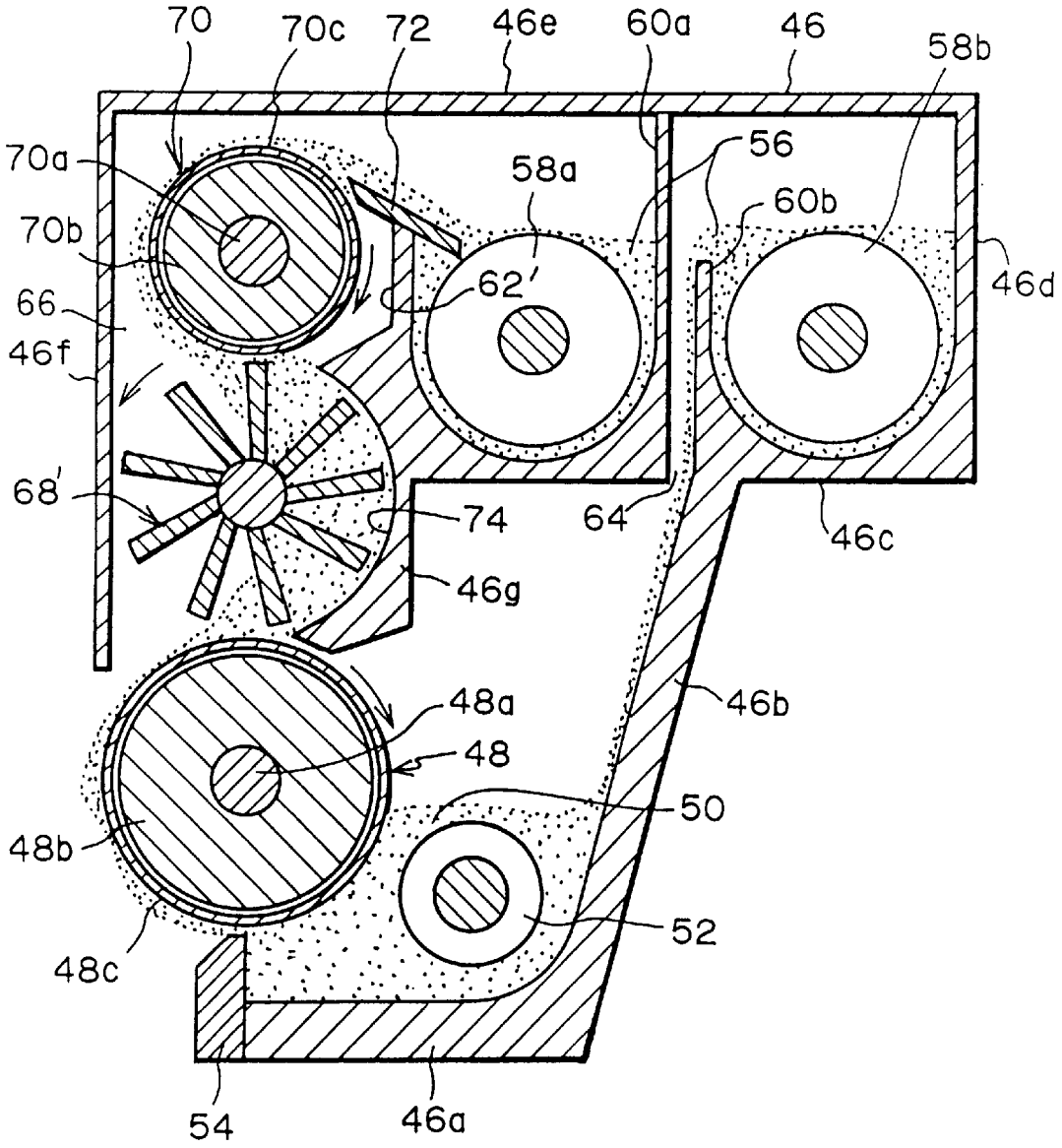
FIG. 14 is a schematic cross-sectional view of a modification of the developing device of FIG. 11.
Figure 15:
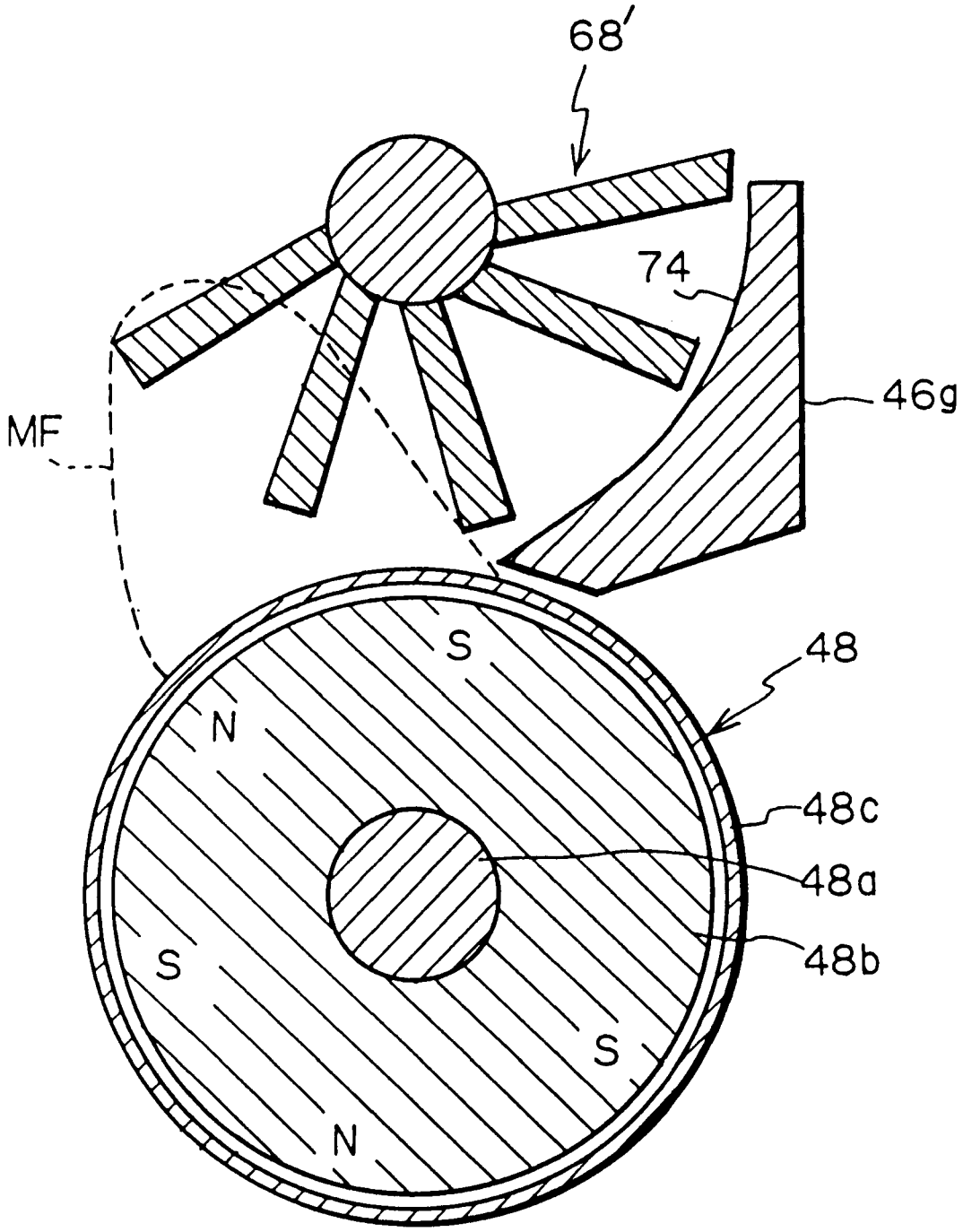
FIG. 15 is an enlarged sectional view of a part of the developing device of FIG. 14.

FIG. 14 shows a modification of the second embodiment, in which elements like or corresponding to those of the second embodiment are designated by the same references. As is apparent from FIG. 14, the developing device is provided with a mechanical developer-lifting means comprising a vane wheel 68', instead of the magnet roller 68. During operation of the developing device, the vane wheel 68' is rotationally supported by the opposite side walls of a developer container 46 so as to rotate in a direction indicated by the arrow in the drawing. A concave circular surface 74 is formed in the surface of a vertical partition wall 46*g* so as to conform to the shape of the vane wheel 68'. The developer is lifted from a developing roller 48, and it is moved to a magnet roller 70, by the cooperative action of the vane wheel 68' and the concave circular surface 74. The lower edge of the concave circular surface 74 must be located as shown in FIG. 15 in order to facilitate the action of raising the developer. In particular, when the core 48 of the developing roller 48 is locally magnetized, as shown in FIG. 15, so as to produce a magnetic field MF between an N-pole and an S-pole located near the vane wheel 68', as indicated by a broken line, the lower edge of the concave circular surface 74 is extended along a line at which the magnetic field MF disappears, whereby the vane wheel 68' can easily scrape the developer from the developing roller 48 without being affected by the magnetic field MF.

In the first embodiment shown in FIG. 4, the mechanical developer-lifting means, i.e., the vane wheel 68' as shown in FIG. 14, can be preferably used instead of the magnet roller 68, because the vane wheel 68' itself does not exert any magnetic influence on the developer falling down the communication passage 64.

Figure 16:
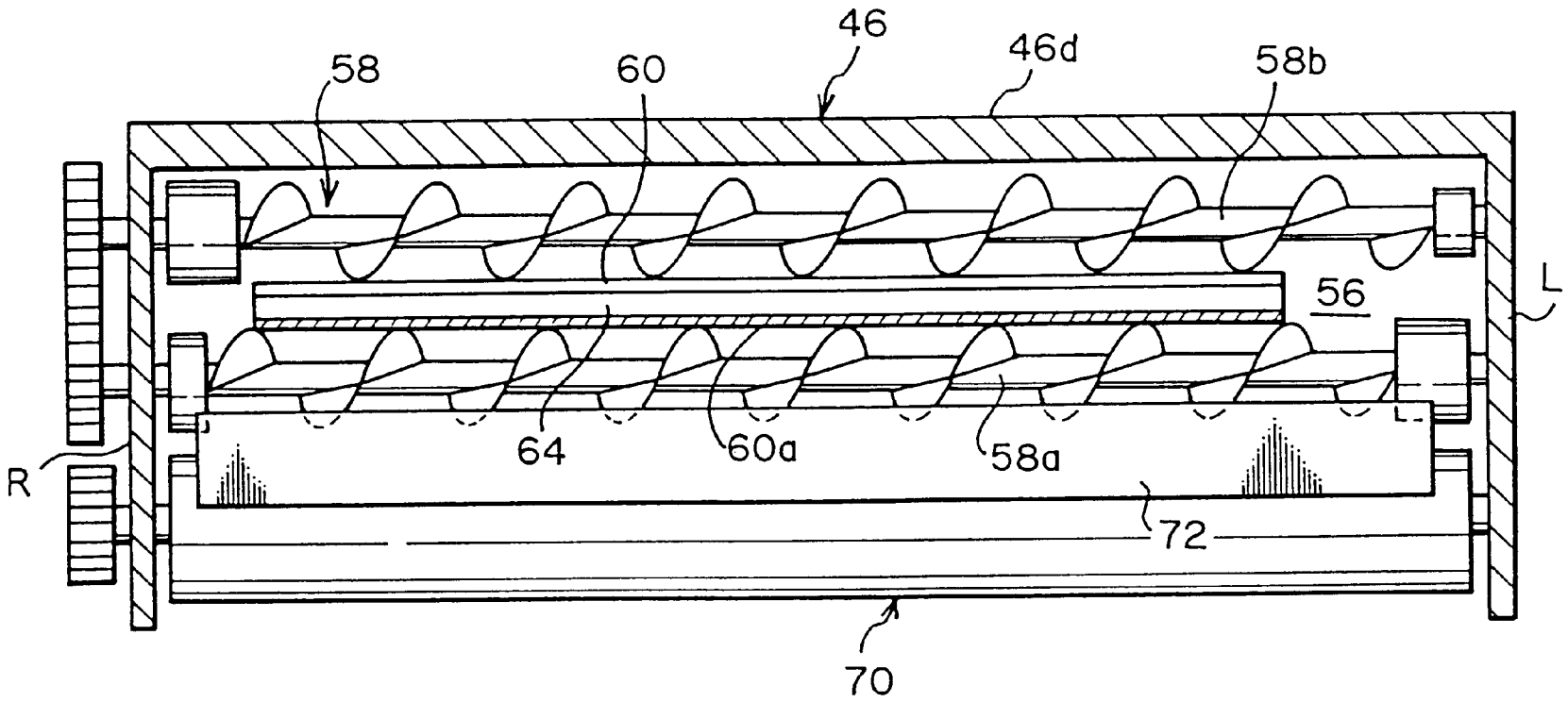
FIG. 16 is a plan view of the developing device of FIG. 11, in which a top wall and a front wall are removed to show an interior of the developing device.

In the second embodiment shown in FIGS. 11 to 13 and the modified embodiment thereof shown in FIGS. 14 and 15, the communication passage 64 for communicating the developer-accumulating chamber 50 and the developer-agitating chamber 56 with each other is formed in the second bottom wall 46*c* between the screw feeders 58*a* and 58*b*. With this arrangement, it is not possible to uniformly distribute the developer in the developer-accumulating chamber 50, the developer being supplied from the developer-agitating chamber 56 through the communication passage 64 into the developer-accumulating chamber 50. In particular, as shown in FIG. 16, when the developer circulates in the developer-agitating chamber 56 of the second embodiment, the first screw conveyor 58*a* placed on the front side thrusts the developer toward the right side wall R of the developer container, and the second screw conveyor 58*b* placed on the rear side thrusts the developer toward the left side wall L thereof. Accordingly, the developer returned by the scraper member 72 into the first screw conveyor 58*a* in the developer-agitating chamber 56 is concentrated near the side wall R of the developer container 46. Consequently, the quantity of the developer supplied into the developer-accumulating chamber 50 through a region of the communication passage 64 near the side wall R is relatively large, whereas the quantity of the developer supplied into the developer-accumulating chamber 50 through a region of the communication passage 64 near the side wall L is relatively small, and thus the developer is distributed unevenly in the developer-accumulating chamber 50. An excessively uneven distribution of the developer prevents the uniform formation of a magnetic brush on the developing roller 48, which makes it impossible to carry out the developing process properly.

Figure 17:
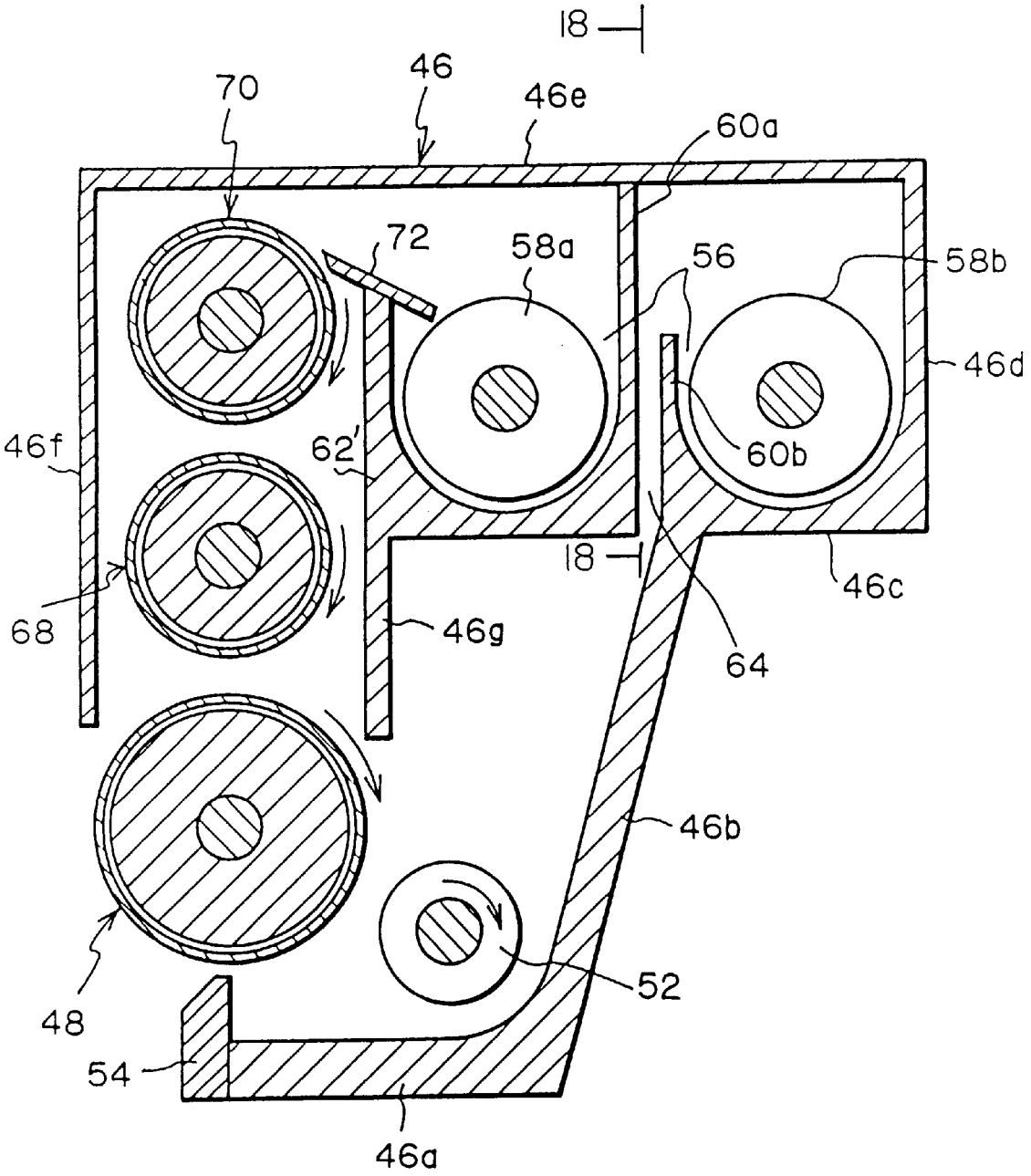
FIG. 17 is a schematic cross-sectional view of a third embodiment of a developing device according to the present invention.
Figure 18:
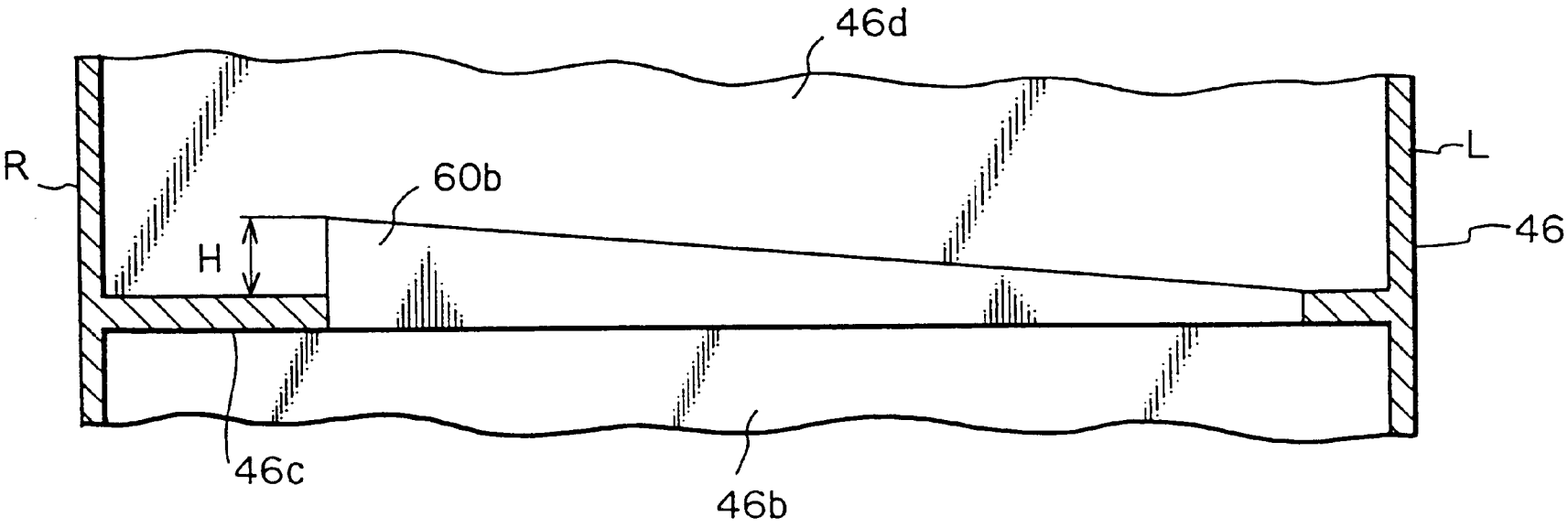
FIG. 18 is a sectional view taken along a line 18—18 of FIG. 17.

FIGS. 17 and 18 show a third embodiment of a developing device according to the present invention, which is constituted so as to obviate the uneven distribution of developer in a developer-accumulating chamber 50. In FIGS. 17 and 18, elements like or corresponding to those shown in FIGS. 4 and 5 are designated by the same references. The third embodiment is substantially identical with the second embodiment, except that the overflow edge of a partition plate 60*b* of the third embodiment is sloped in the length direction of the communication passage 64 whereas the partition plate 60*b* of the second embodiment has a uniform height. That is, as shown in FIG. 18, the overflow edge of the partition plate 60*b* of the third embodiment is gradually sloped down from one end on the side of the side wall R of a developer container 46 toward the other end on the side of the side wall L thereof. Accordingly, the quantity of the developer that overflows in to the communication passage 64 in a region, where the height of the overflow edge is large, is reduced, and thus the developer can be distributed uniformly in the developer-accumulating chamber.

In fact, the quantity of the developer accumulated in the developer-accumulating chamber 50 and the distribution of developer in the developer-accumulating chamber 50 are dependent on parameters including the total quantity of developer held in the developer container 46, the quantity of developer circulated in unit time in the developer container 46, and the speed of rotation of the screw conveyors 58*a* and 58*b*. The inventors actually fabricated a developing device corresponding to the third embodiment, and conducted experiments using the fabricated developing device to examine how the developer was distributed in the developer-accumulating chamber 50 in accordance with variations of the parameters. The details of the experiments will be described hereinafter.

The developing device fabricated for the experiments has following particulars:

(1) The longitudinal length of the developer container 46, i.e., the axial length of the developing roller 48 was 300 mm.

(2) The developing roller 48 was 40 mm in diameter and 300 in length.

(3) The screw conveyors 58*a* and 58*b* were 28 mm in diameter and 25 mm in screw pitch.

(4) The communication passage 64 was 4 mm in width (the ratio of the width to the diameter of the screw conveyors 58*a* and 58*b* was 0.14.).

(5) The maximum height H (FIG. 18) of the partition plate 60*b* was 14 mm (the ratio of the maximum height H to the diameter of the screw conveyors 58*a* and 58*b* was 0.5), and the minimum height of the same is zero. The angle of slope of the overflow edge of the partition plate 60*b* was 3.4°.

(6) The total quantity of developer held in the developer container 46 was 1.6 kg.

(7) The specific gravity of the developer was 1.85 g/cm.

Figure 19A:
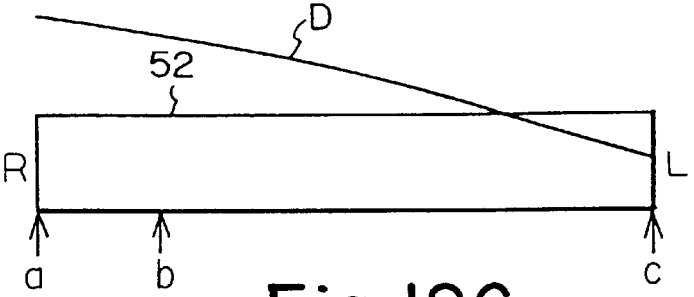
FIGS. 19A, 19B, 19C, 19D, 19E and 19F are diagrammatic views showing a distribution of an accumulated developer and an adhesion of developer to a developing roller in the developing device of FIG. 17 when a speed of rotation of the developer-agitating screw conveyors is set to be at 300 rpm and when the developer circulating rate is suitably varied.
Figure 19B:
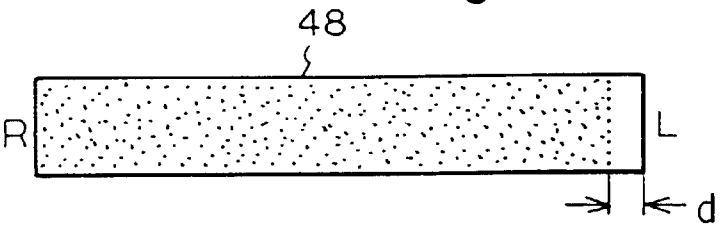

The screw conveyors 58*a* and 58*b* were rotated at 300 rpm, and the developer was circulated in the developer container 46 at each of developer-circulation rates of 6.3 g/s/cm (3.4 $cm^3$/s/cm as a developer circulation volume), 7.4 g/s/cm (4.0 $cm^3$/s/cm as a developer circulation volume), and 8.7 g/s/cm (4.7 $cm^3$/s/cm as a developer circulation volume) to examine how a distribution of the developer varies in the developer-accumulating chamber 50 in accordance with the variation of the developer-circulation rate. Note, the developer-circulation rate is defined as a quantity of developer returned by the scraper member 72 to the developer-agitating chamber 56 per unit length of the scraper member 72 at unit time or a quantity of developer transported from the developer-accumulating chamber 50 by the developing roller 48 per unit length of the developing roller 48 at unit time. The developer-circulation rate was adjusted by varying the respective speeds of rotation of the developing roller 48 and the magnet rollers 68 and 70. FIGS. 19A, 19B, 19C, 19D, 19E and 19F show the results of experiments, which are as follows:

When the developer-circulation rate was 6.3 g/s/cm, the height distribution of an accumulated developer relative to a paddle roller 52 in the developer-accumulating chamber 50, Fig. A, is represented by a curve D shown on FIG. 19A. Each of the arrows a, b and c under the paddle roller 52, FIGS. 19A represents a height of an accumulated developer at the location on paddle roller 52 at which the arrow is appended. The height of the accumulated developer at the right or R end of the paddle roller 52 above the arrow a FIG. 19A (corresponding to the right side wall R of the developer container), is 34 mm and represents a height of an accumulated developer at that location; and the arrow b represents a height of 27 mm, at a location near the right or R end of the paddle roller 52, represents a height of an accumulated developer at that location adjacent, but spared from the right end thereof; and the numerical value of 7 mm, appended to a location of a left or L end of the paddle roller 52, at arrow c (corresponding to the left side wall R of the developer container), indicates a height of an accumulated developer at that location of the left end thereof. The adhesion of developer to the developing roller 48, i.e., the formation of magnetic brush on the developing roller 48 is shown in the right-hand or R side of roller 48, FIG. 19B. A developer-adhesion region of the developing roller 48, in which the magnetic brush is formed, is illustrated as a fine-dotted region, whereas a non-=developer region between arrow d—d, in which no magnetic brush is formed, is illustrated as a blank region. the width of the non-developer region was about 15 mm from the left or L end of the developing roller 48.

Figure 19C:
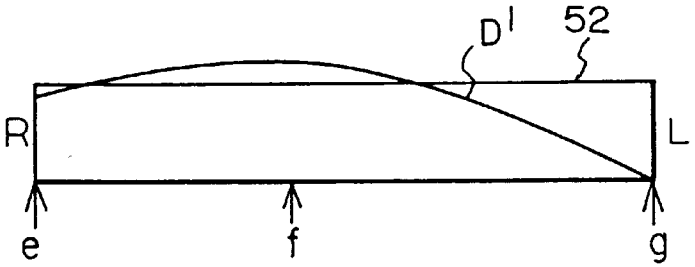
Figure 19D:
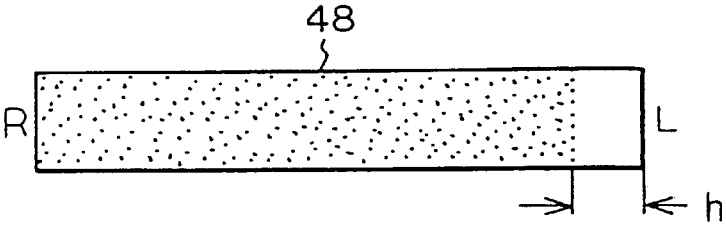

When the developer-circulation rate was 7.4 g/s/cm, FIGS. 19C, 19D a height distribution of an accumulated developer relative to the paddle roller 52 in the developer-accumulating chamber 50 is represented by a curve D1 shown on the left-hand side of FIG. 19C. Numerical values written under the paddle roller 52 at arrows e, f and g, FIG. 19C are similar to those explained with reference to FIG. 19A. In this case, the adhesion of developer to the developing roller 48 is shown on the right-hand side of FIG. 19D, and the width of a non-developer region between arrows f–h, FIG. 19D, was about 20 mm from the left end L of the developing roller 48.

Figure 19E:
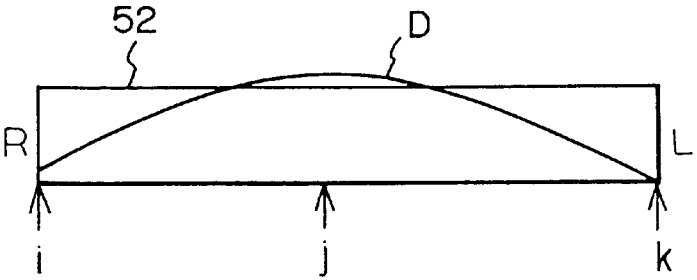
Figure 19F:
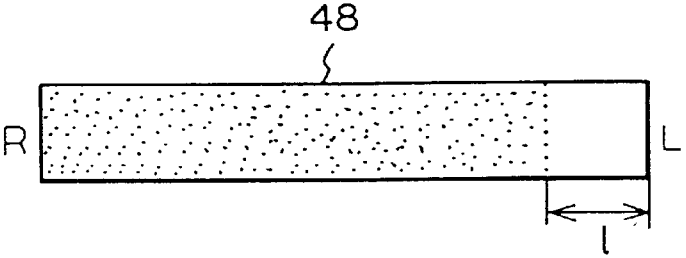

When the developer-circulation rate was 8.7 g/s/cm, a height distribution of an accumulated developer relative to the paddle roller 52 in the developer-accumulating chamber 50 is represented by a curve D shown on the left-hand side of FIG. 19E. Numerical values under the paddle roller 52, at arrows i, j and k, are similar to those explained with reference to FIGS. 19A and 19C. In this case, the adhesion of developer to the developing roller 48 is shown on the right-hand side of FIG. 19F, and the width of a non-developer region, as shown between arrows l—l, FIG. 19F, was about 35 mm from the left end L of the developing roller 48.

The screw conveyors 58*a* and 58*b* were rotated at 350 rpm, and the developer was circulated in the developer container 46 at each of developer-circulation rates of 6.3 g/s/cm (3.4 $cm^3$/s/cm as a developer circulation volume), 7.4 g/s/cm (4.0 $cm^3$/s/cm as a developer, circulation volume), and 8.7 g/s/cm (4.7 $cm^3$/s/cm as a developer circulation volume) to examine how a distribution of the developer varies in the developer-accumulating chamber 50 in accordance with the variation of the developer-circulation rate.

Figure 20A:
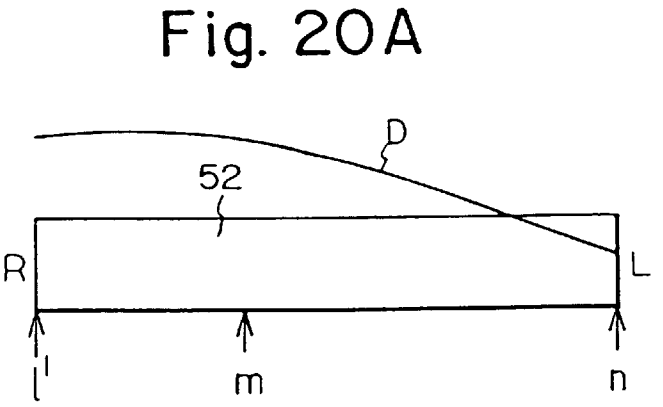
FIGS. 20A, 20B, 20C, 20D, 20E and 20F are diagrammatic views showing a distribution of an accumulated developer and an adhesion of developer to a developing roller in the developing device of FIG. 17 when a speed of rotation of the developer-agitating screw conveyors is set to be at 350 rpm and when the developer circulating rate is suitably varied.
Figure 20B:
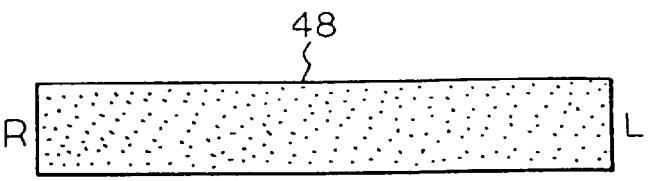

FIGS. 20A, 20B, 20C, 20D, 20E and 20F show the results of experiments, the details of which are as follows:

When the developer-circulation rate was 6.3 g/s/cm, FIGS. 20A and 20B the height distribution of the accumulated developer relative to the paddle roller 52 in the developer-accumulating chamber 50 is represented by a curve D shown FIG. 20A. Similar to the above-mentioned cases, the numerical values under the paddle roller 52 at arrows l, m and n, FIG. 20A represents the height of accumulated developer at the location at which that numerical value are, as follows. The adhesion of developer to the developing roller 48 as shown in FIG. 20B, and adhered to the entire surface of the developing roller 48.

Figure 20C:
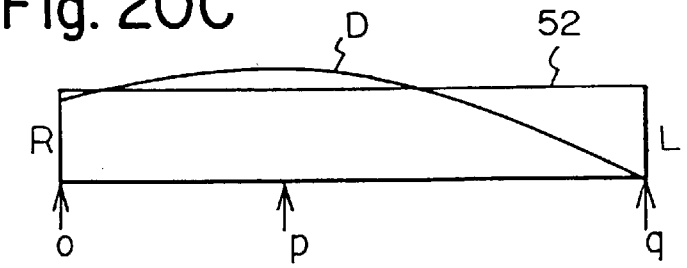
Figure 20D:
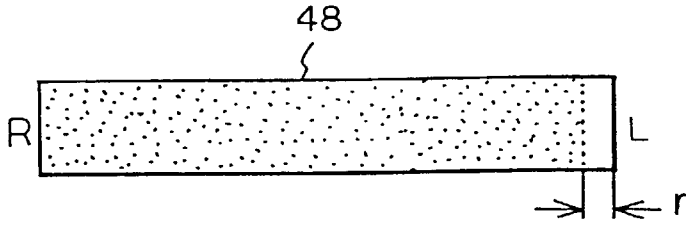

When the developer-circulation rate was 7.4 g/s/cm, FIGS. 20C and 20D, the height distribution of the accumulated developer relative to the paddle roller 52 in the developer-accumulating chamber 50 is represented by a curve D shown in FIG. 20C. Similar to the above-mentioned cases, the numerical values under the paddle roller 52 at arrows O, P and Q, FIG. 20C represents the height of accumulated developer, as follows: 15 mm, 17 mm and 1 mm. In this case, the adhesion of developer to the developing roller 48 is shown on the right-hand side of FIG. 20D, and the width of a non-developer region, between arrows r—r was about 15 mm from the left end L of the developing roller 48.

Figure 20E:
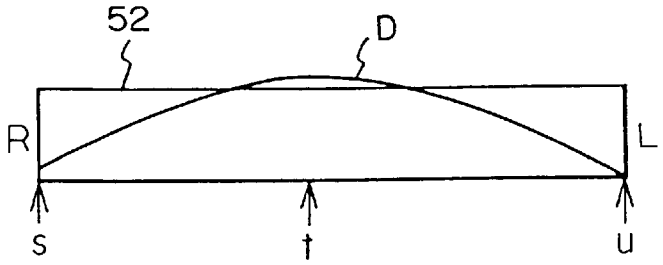
Figure 20F:
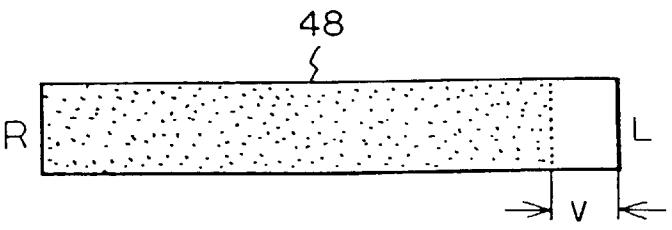

When the developer circulating rate was 8.7 g/s/cm, FIGS. 20E, 20F the height distribution of the accumulated developer relative to the paddle roller 52 in the developer-accumulating chamber 50 is represented by a curve D shown on the left-hand side of FIG. 20E. Similar to the above-mentioned cases, the numerical values at the arrows S, T and u under the paddle roller 52 represents the height of accumulated developer, as follows: 0 mm, 15 mm, 0 mm. In this case, the adhesion of developer to the developing roller 48 is shown on the right-hand side of FIG. 20F, and the width of a non-developer region, between the arrows v—v was about 23 mm from the left end L of the developing roller 48.

Figure 21A:
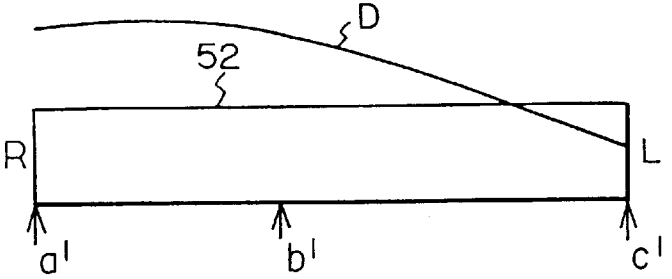
FIGS. 21A, 21B, 21C, 21D, 21E and 21F are diagrammatic views showing a distribution of an accumulated developer and an adhesion of developer to a developing roller in the developing device of FIG. 17 when a speed of rotation of the developer-agitating screw conveyors is set to be at 400 rpm and when the developer circulating rate is suitably varied.
Figure 21B:
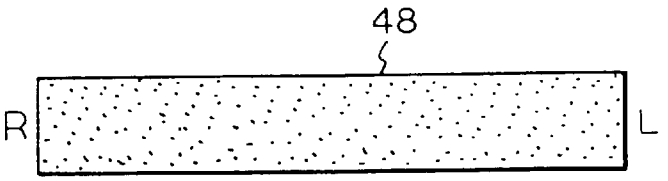

The screw conveyors 58*a* and 58*b* were rotated at 400 rpm, and the developer was circulated in the developer container 46 at each of developer-circulation rates of 6.3 g/s/cm (3.4 $cm^3$/s/cm as a developer circulation volume), 7.4 g/s/cm (3.4 $cm^3$/s/cm as a developer circulation volume), and 8.7 g/s/cm (4.7 $cm^3$/s/cm as a developer circulation volume) to examine how the distribution of developer varies in the developer-accumulating chamber 50 in accordance with the variation of the developer-circulation rate. FIGS. 21A, 21B, 21C, 21D, 21E and 21F show the results of experiments, the details of which are as follows:

When the developer circulating rate was 6.3 g/s/cm, FIGS. 21A and 21B, the height distribution of the accumulated developer relative to the paddle roller 52 in the developer-accumulating chamber 50 is represented by a curve D shown on FIG. 21A. Similar to the above-mentioned cases, the numerical values, under the paddle roller 52 at arrows $a^1$, $b^1$ and $c^1$ represents the height of accumulated developer at the location are, as follows: 34 mm, 29 mm and 8 mm. In this case, the adhesion of developer to the developing roller 48 is shown in FIG. 21B, and the developer was adhered to the entire surface of the developing roller 48.

Figure 21C:
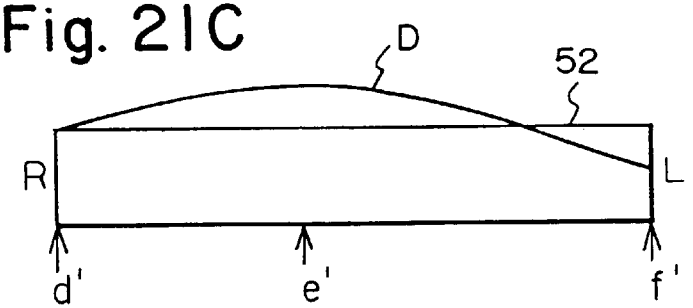
Figure 21D:
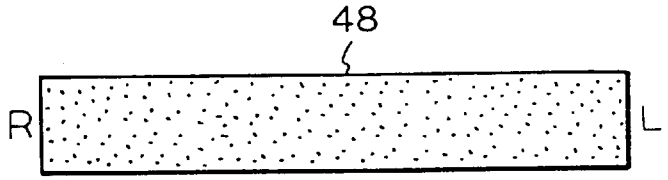

When the developer circulating rate was 7.4 g/s/cm, FIGS. 21C and 21D the height distribution of accumulated developer relative to the paddle roller 52 in the developer-accumulating chamber 50 is represented by a curve D shown in FIG. 21C. Similar to the above-mentioned cases, the numerical values under the paddle roller 52 at arrows $d^1$, $e^1$ and $f^1$ represent the height of accumulated developer at the location are, as follows: 15 mm, 17 mm and 1 mm. The adhesion of developer to the developing roller 48 as shown in FIG. 21D, and the developer was adhered to the entire surface of the developing roller 48.

Figure 21E:
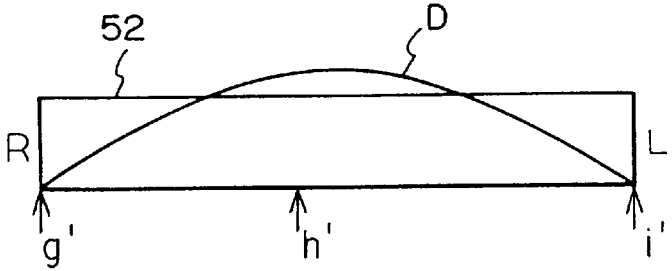
Figure 21F:
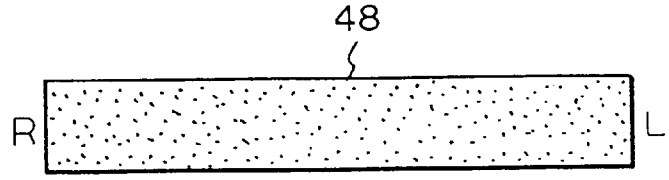

When the developer circulating rates was 8.7 g/s/cm, FIGS. 21E and 21F the height distribution of the accumulated developer relative to the paddle roller 52 in the developer-accumulating chamber 50 is represented by a curve D shown in FIG. 21E. Similar to the above-mentioned cases, the numerical values, under the paddle roller 52 at arrows $g^1$, $h^1$ and $i^1$ represents the height of accumulated developer at the location and are, as follows: 0 mm, 15 mm, and 0 mm. The adhesion of developer to the developing roller 48 is shown in FIG. 21F, and the developer was adhered to the entire surface of the developing roller 48.

Figure 23:
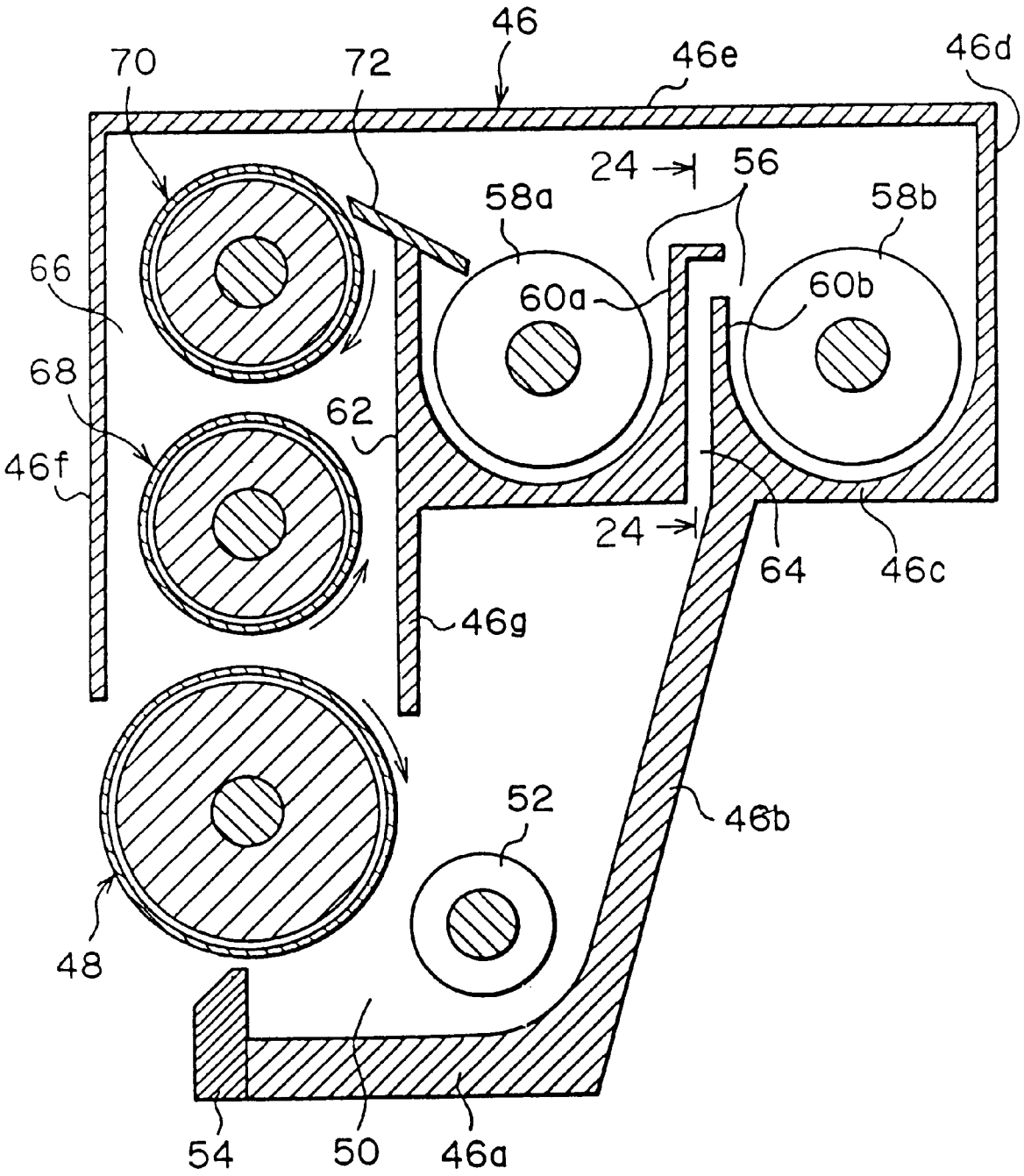
FIG. 23 is a schematic cross-sectional view of a fourth embodiment of a developing device according to the present invention.
Figure 24:
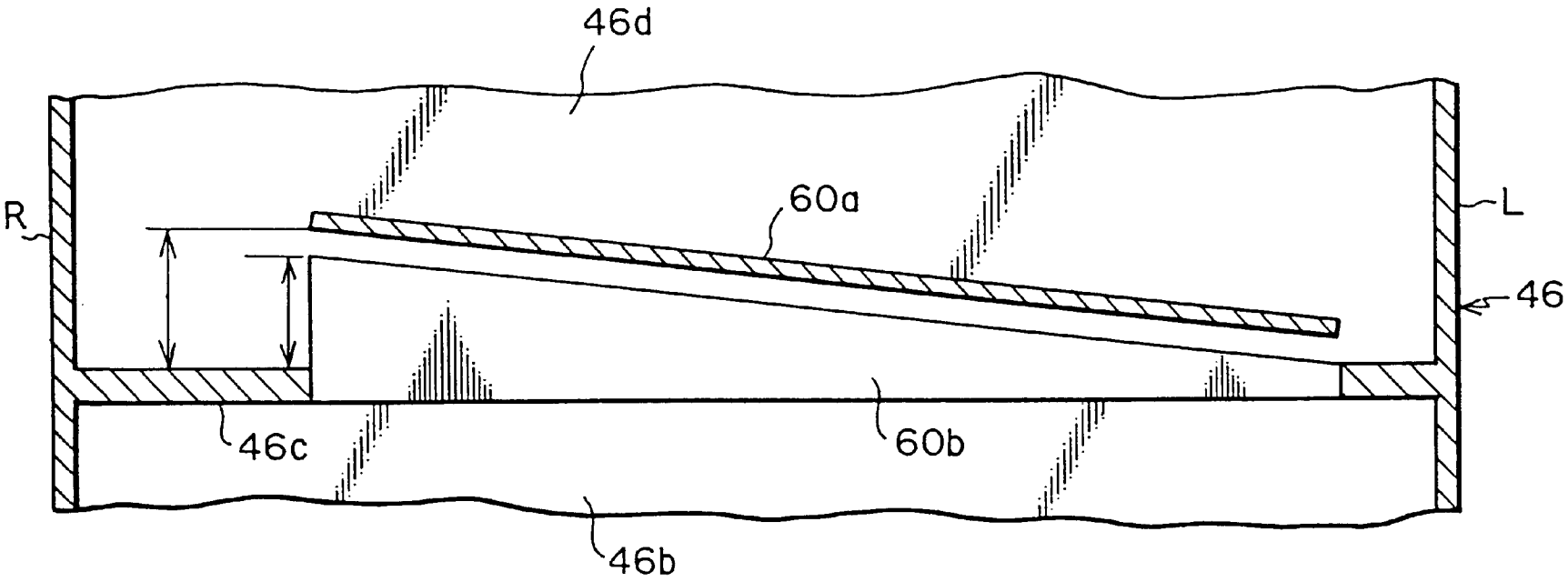
FIG. 24 is a sectional view taken along a line 24—24 of FIG. 23.

A sis apparent from the experimental results, in the third embodiment, when the maximum height of the sloped overflow edge of the partition plate 60*b*, FIGS. 23 and 24 is 0.5 times the diameter of the screw conveyors 58*a* and 58*b*, and when the speed of rotation of the screw conveyors 58*a* and 58*b* is set to be low, the developer-circulation rate must be set to be small, before the developer can be adhered to the entire surface of the developing roller 48. For example, when the speed of rotation of the screw conveyors 58*a* and 58*b* is set to be high, the developer-circulation rate can be increased. Note, in general, it is undesirable to rotate the screw conveyors 58*a* and 58*b* at an excessively-high speed, because in increment of rotational speed of the screw conveyors 58*a* and 58*b* for movement of the developer at a high speed results in a premature deterioration of the magnetic carrier component of the two-component developer.

As the total quantity of developer held in the developer container 46 is increase,d the quantity of developer accumulated in the developer-accumulating chamber 50 becomes large. Accordingly, it can be readily expected that an ability to adhere to the developer-accumulating chamber 50 becomes large. Accordingly, it can be readily expected that an ability to adhere the developer to the surface of the developing roller 48 can be improved due to the increment of the total quantity of developer. Experiments were conducted using the above-mentioned developing device to examine a relationship between a quantity of developer accumulated in the developer-accumulating chamber 50 and a total quantity of developer held in the developer container 46. Conditions for the experiments are as follows:

(1) The developer-circulation rate was 8.7 g/s/cm (4.7 $cm^3$/s/cm as a developer-circulation volume).

(2) The speed of rotation of the screw conveyors 58*a* and 58*b* was 400 rpm.

(3) The total quantity of developer was changed in the range of from 1.4 kg to 1.82 kg.

(4) The specific gravity of the developer is 1.85 g/cm.

Figure 22:
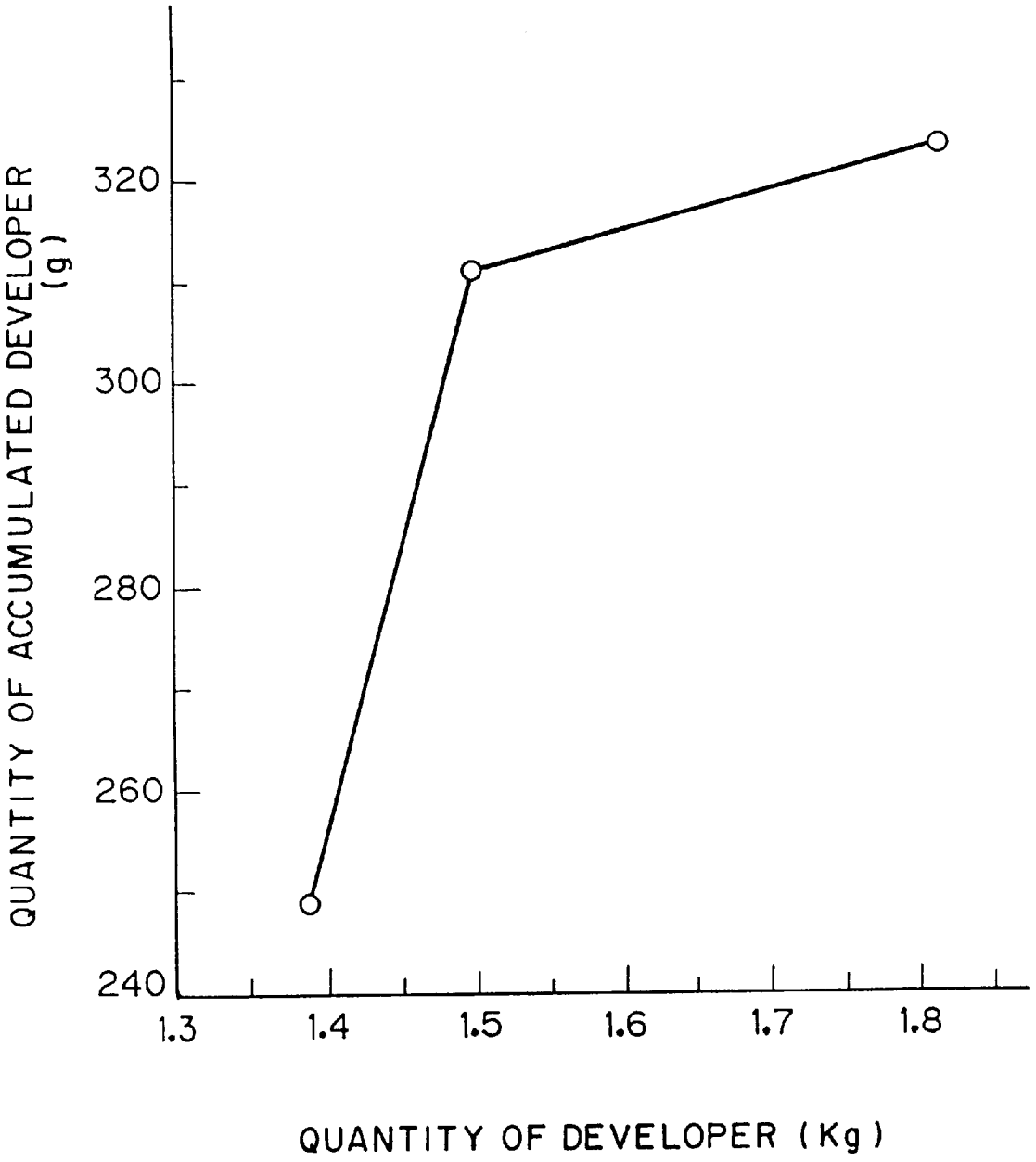
FIG. 22 is a graph showing a relationship between a total quantity of a developer and a quantity of developer accumulated in the developing device of FIG. 17.

The results of the experiments are shown in a graph of FIG. 22. As is apparent from this graph, when the total quantity of the developer was 1.4 kg, the quantity of the developer accumulated in the developer-accumulating chamber 50 was 250 g. When the total quantity of the developer was 1.82 kg, the quantity of the developer accumulated in the developer-accumulating chamber 50 was 330 g. When the quantity of the developer accumulated in the developer-accumulating chamber 50 was 250 g, the quantity of developer devoted to the developing roller 48 per unit length was 8 g/cm. When the quantity of the developer accumulated in the developer-accumulating chamber 50 was 330 g, the quantity of developer on the developing roller 48 per unit length was 11 g/cm.

FIGS. 23 and 24 show a fourth embodiment of a developing device according to the present invention, which, similar to the third embodiment, is constituted so as to obviate an uneven distribution of the accumulated developer in the developer-accumulating chamber 50. In FIGS. 23 and 24, elements like or corresponding to those shown in FIGS. 4 and 5 are designated by the same references. As is apparent from FIGS. 23 and 24, in the fourth embodiment, overflow edges of both partition plates 60*a* and 60*b* are sloped along a length of a communication passage 64, and an upper end portion of the partition plate 60*a* is horizontally bent and projected above the partition plate 60*b* so as to define an overflow opening of the communication passage 64 in a vertical plane. As shown in FIG. 24, each of the overflow edges of both the partition plates 60*a* and 60*b* is sloped down such that the height thereof is gradually reduced from the right side wall R of the developer container toward the left side wall L thereof. Accordingly, the quantity of developer that overflows into the communication passage 64 in a region, where the height of the overflow edge is large, is reduced, whereby the developer can be uniformly distributed in the developer-accumulating chamber.

A developing device according to the fourth embodiment was actually fabricated, and experiments were conducted to examine how the developer was distributed in the developer-accumulating chamber 50 in accordance with variation of relevant parameters. The details of experiments will be explained hereinafter. The developing device fabricated for the experiments has the following particulars:

(1) The longitudinal length of the developer container 46, i.e., the size along the axis of the developing roller 48 was 300 mm.

(2) The developing roller 48 was 40 mm in diameter and 300 mm in length.

(3) The screw conveyors 58*a* and 58*b* are 28 mm in diameter and 25 mm in screw pitch.

(4) The maximum height of a lower edge of a horizontal projection of the partition plate 60*a* was 26 mm (the ratio of the maximum height to the diameter of the screw conveyors 58*a* and 58*b* was 0.93), and the maximum height of an upper edge of the partition plate 60*b* was 22 mm (the ratio of the maximum height to the diameter of the screw conveyors 58*a* and 58*b* was 0.79). The lower edge of the horizontal projection of the partition plate 60*b* were extended in parallel with each other, and the minimum height of the lower edge of the partition plate 60*b* is zero.

(5) The specific gravity of the developer was 1.85 g/cm.

Figure 25B:
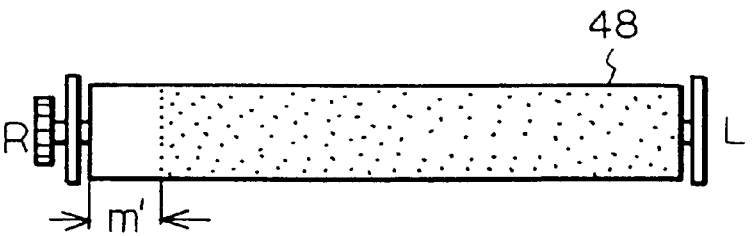
FIGS. 25A, 25B, 25C, 25D, 25E and 25F are diagrammatic views showing a distribution of an accumulated developer and an adhesion of developer to a developing roller in the developing device of FIG. 23 when a the total quantity of developer is set to be 1.4 kg and when the speed of rotation of the developer-agitating screw conveyors is suitably varied.
Figure 25D:
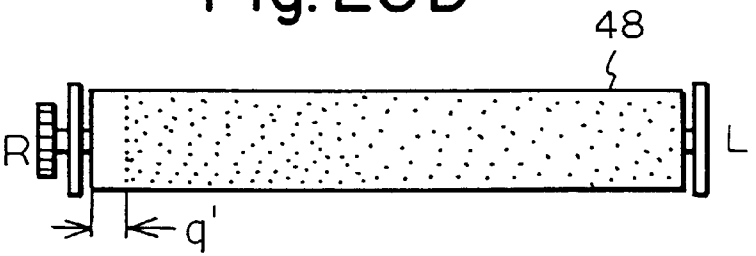
Figure 25F:
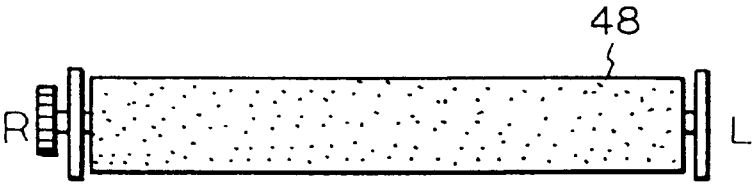
Figure 25A:
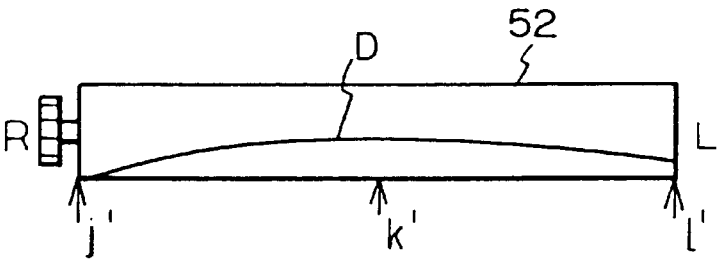

The total quantity of developer held in the developer container 46 was set to be 1.4 kg, and the developer-circulation rate was set to be 6.3 g/s/cm (3.4 $cm^3$/s/cm as the developer-circulation volume). The screw conveyors 58*a* and 58*b* were rotated at 150 rpm, 200 rpm, and 250 rpm to examine how a distribution of developer varies in the developer-accumulating chamber 50 in accordance with the variation of the speed of rotation of the screw conveyors 58*a* and 58*b*. FIGS. 25A, 25B, 25C, 25D, 25E and 25F show the results of the experiments, the details of which are as follows:

When the screw conveyors 58*a* and 58*b* were rotated at 150 rpm, FIGS. 25A and 25B a height distribution of the accumulated developer relative to a paddle roller 52 in the developer-accumulating chamber 50 is represented by a curve D, FIG. 25A. Similar to the above-mentioned case, the numerical values at arrows $j^1$, $k^1$ and $l^1$, FIG. 25A, represents the height of an accumulated developer at the location and are, as follows: 0 mm, 6 mm, and 3 mm. The adhesion of developer to the developing roller is shown, and a non-developer region between the arrows $m^1$—$m^1$ having the width of about 40 mm from the R end of the developing roller 48 was produced.

Figure 25C:
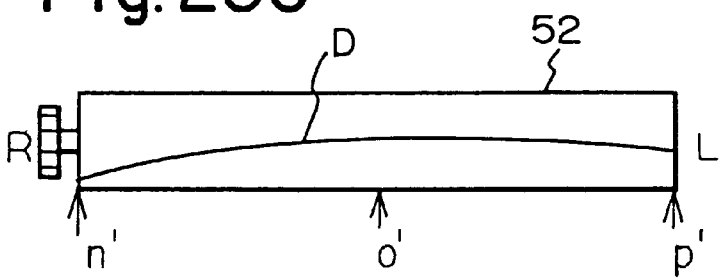
Figure 25E:
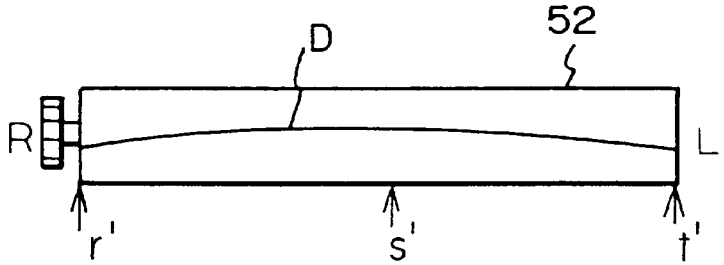

When the screw conveyors 58*a* and 58*b* were rotated at 200 rpm, FIGS. 25C and 25D, the height distribution of an accumulated developer relative to the paddle roller 52 in the developer-accumulating chamber 50 is represented by a curve D, FIG. 25C. Similar to the above-mentioned case, the numerical values at arrows $n^1$, $o^1$, and $p^1$ represents the height of an accumulated developer at the location and are, as follows: 2 mm, 8 mm and 5 mm. The adhesion of developer to the developing roller 48 is shown in FIG. 25D, and non-developer region between the arrows $Q^1$—$Q^1$ having the width of about 20 mm from the R end of the developing roller 48 was produced.

When the screw conveyors 58*a* and 58*b* were rotated at 250 rpm, FIGS. 25C and 25D, the height distribution of an accumulated developer relative to the paddle roller 52 in the developer-accumulating chamber 50 is represented by a curve D, FIG. 25C. Similar to the above-mentioned case, the numerical values at arrows $r^1$, $s^1$, and $t^1$ represents the height of an accumulated developer at the location and are, as follows: 5 mm, 8 mm and 6 mm. The adhesion of developer to the developing roller 48 is shown in FIG. 25F, and the developer was adhered to the entire surface of the developing roller 48.

Figure 26B:
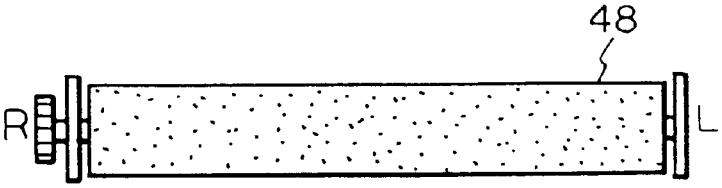
FIGS. 26A, 26B, 26C, 26D, 26E and 26F are diagrammatic views showing a distribution of an accumulated developer and an adhesion of developer to a developing roller in the developing device of FIG. 23 when a the total quantity of developer is set to be 1.6 kg and when the speed of rotation of the developer-agitating screw conveyors is suitably varied.
Figure 26D:
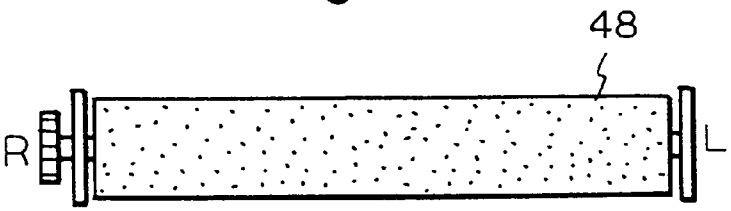
Figure 26F:
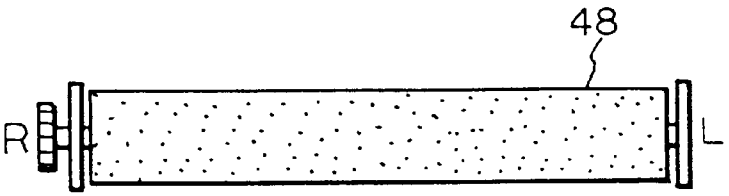
Figure 26A:
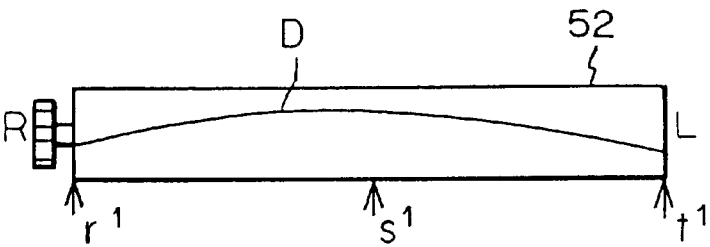

Then, the total quantity of the developer held in the developer container 46 was set to be 1.6 kg, the developer circulating rate was set to be 8.7 g/s/cm (4.7 $cm^3$/s/cm as the developer-circulation volume), and the screw conveyors 58*a* and 58*b* were rotated at 150 rpm, 200 rpm or 250 rpm to examine how the distribution of developer varies in the developer-accumulating chamber 50 in accordance with the variation of the speed of rotation of the screw conveyors 58*a* and 58*b*. FIGS. 26A, 26B, 26C, 26D, 26E and 26F show the results of the experiments, the details of which are as follows:

When the screw conveyors 58*a* and 58*b* were rotated at 150 rpm, FIGS. 26A and 26B the height distribution of the accumulated developer relative to a paddle roller 52 in the developer-accumulating chamber 50 is represented by a curve D, FIG. 26A. Similar to the above-mentioned cases, the numerical values under the paddle roller 52 at arrows $r^1$, $s^1$, $t^1$, represents the height of accumulated developer at the location and are, as follows: 6 mm, 10 mm and 5 mm. An adhesion of developer to the developing roller 48 is shown in FIG. 26B, and the developer was adhered to the entire surface of the developing roller 48.

Figure 26C:
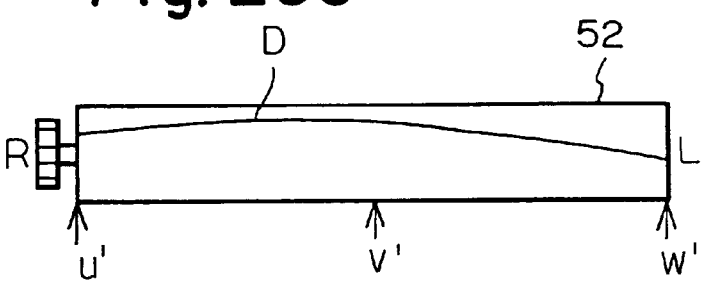

When the screw conveyors 58*a* and 58*b* were rotated at 200 rpm, FIGS. 26C and 26D, the height distribution of the accumulated developer relative to a paddle roller 52 in the developer-accumulating chamber 50 is represented by a curve D, FIG. 26C. Similar to the above-mentioned cases, the numerical values at arrows $u^1$, $v^1$, $w^1$, represents the height of accumulated developer at the location and are, as follows: 9 mm, 12 mm and 5 mm. The adhesion of developer to the developing roller 48 is shown in FIG. 26D, and the developer was adhered to the entire surface of the developing roller 48.

Figure 26E:
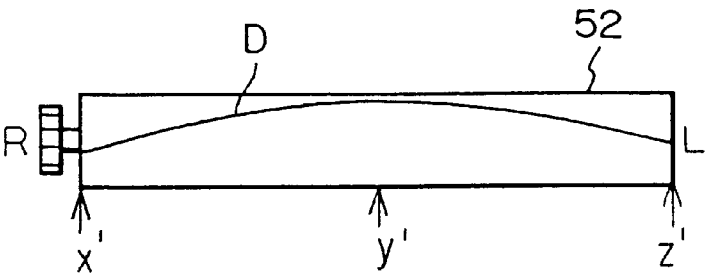

When the screw conveyors 58*a* and 58*b* were rotated at 250 rpm, FIGS. 26E and 26F, the height distribution of the accumulated developer relative to a paddle roller 52 in the developer-accumulating chamber 50 is represented by a curve D, FIG. 26E. Similar to the above-mentioned cases, the numerical values at arrows $x^1$, $y^1$, $z^1$, represents the height of accumulated developer at the location and are, as follows: 6 mm, 13 mm and 7 mm. The adhesion of developer to the developing roller 48 is shown in FIG. 26F, and the developer was adhered to the entire surface of the developing roller 48.

Figure 27B:
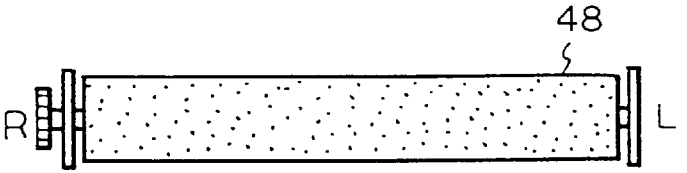
FIGS. 27A, 27B, 27C, 27D, 27E and 27F are diagrammatic views showing a distribution of an accumulated developer and an adhesion of developer to a developing roller in the developing device of FIG. 23 when a the total quantity of developer is set to be 1.8 kg and when the speed of rotation of the developer-agitating screw conveyors is suitably varied.
Figure 27D:
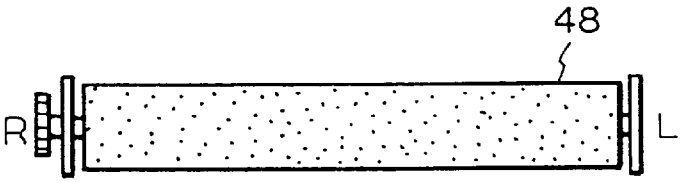
Figure 27F:
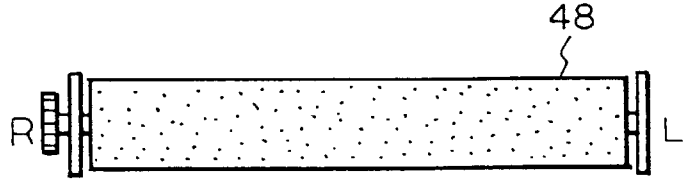
Figure 27A:
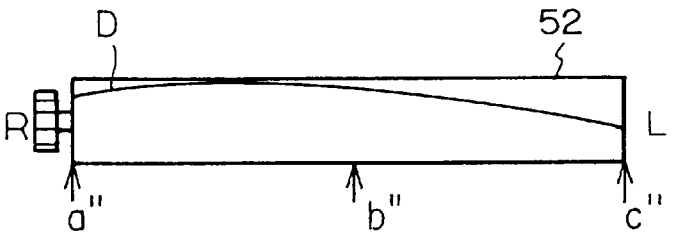

Further, the total quantity of developer held in the developer container 46 was set to be 1.8 kg, and the developer-circulation rate was set to be 8.7 g/s/cm (4.7 $cm^3$/s/cm as the developer-circulation volume). The screw conveyors 58*a* and 58*b* were rotated at 150 rpm, 200 rpm or 250 rpm to examine how the distribution of developer varies in the developer-accumulating chamber 50 in accordance with the variation of the speed of rotation of the screw conveyors 58*a* and 58*b*. FIGS. 27A, 27B, 27C, 27D, 27E and 27F show the results of the experiments, the details of which are as follows:

When the screw conveyors 58*a* and 58*b* were rotated at 150 rpm, the height distribution of the accumulated developer relative to a paddle roller 52 in the developer-accumulating chamber 50 is represented by a curve D, FIG. 27A. Similar to the above-mentioned cases, the numerical values at arrows $a^{11}$, $b^{11}$, $c^{11}$, represents the height of accumulated developer at the location and are, as follows: 10 mm, 12 mm and 6 mm. The adhesion of developer to the developing roller 48 is shown in FIG. 27B, and the developer was adhered to the entire surface of the developing roller 48.

Figure 27C:
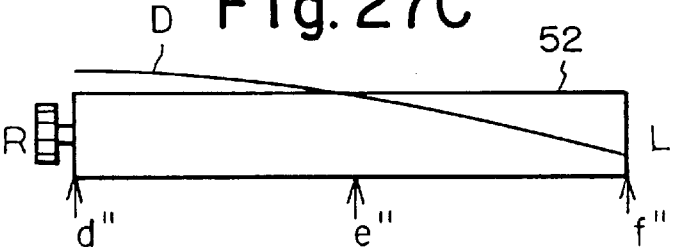

When the screw conveyors 58*a* and 58*b* were rotated at 200 rpm, a height distribution of the accumulated developer relative to a paddle roller 52 in the developer-accumulating chamber 50 is represented by a curve D, FIG. 27C. Similar to the above-mentioned cases, the numerical values at arrows $d^{11}$, $e^{11}$, $f^{11}$, represents the height of accumulated developer at the location and are, as follows: 17 mm, 14 mm and 5 mm. The adhesion of developer to the developing roller 48 is shown in FIG. 27D, and the developer was adhered to the entire surface of the developing roller 48.

Figure 27E:
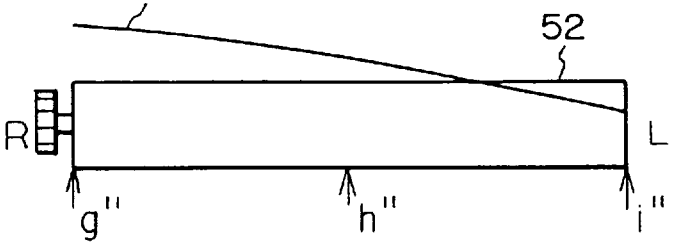

When the screw conveyors 58*a* and 58*b* were rotated at 250 rpm, the height distribution of the accumulated developer relative to a paddle roller 52 in the developer-accumulating chamber 50 is represented by a curve D, FIG. 27E. Similar to the above-mentioned cases, the numerical values at arrows $g^{11}$, $h^{11}$, $i^{11}$, represents the height of accumulated developer at the location and are, as follows: 26 mm, 17 mm and 8 mm. In this case, the adhesion of developer to the developing roller 48 is shown on the right-hand side of FIG. 27F, and the developer was adhered to the entire surface of the developing roller 48.

As is apparent from the results of the experiments, in the fourth embodiment, even if the speed of rotation of the screw conveyors 58*a* and 58*b* is relatively low, for example, as low as 150 rpm, it is possible to adhere the developer over the entire surface of the developing roller 48 by increasing the total quantity of the developer. As is obvious from the foregoing, a suppression of the speed of rotation of the screw conveyors 58*a* and 58*b* is preferable for prolongation of the life of the magnetic carrier component of the two-component developer.

Figure 28:
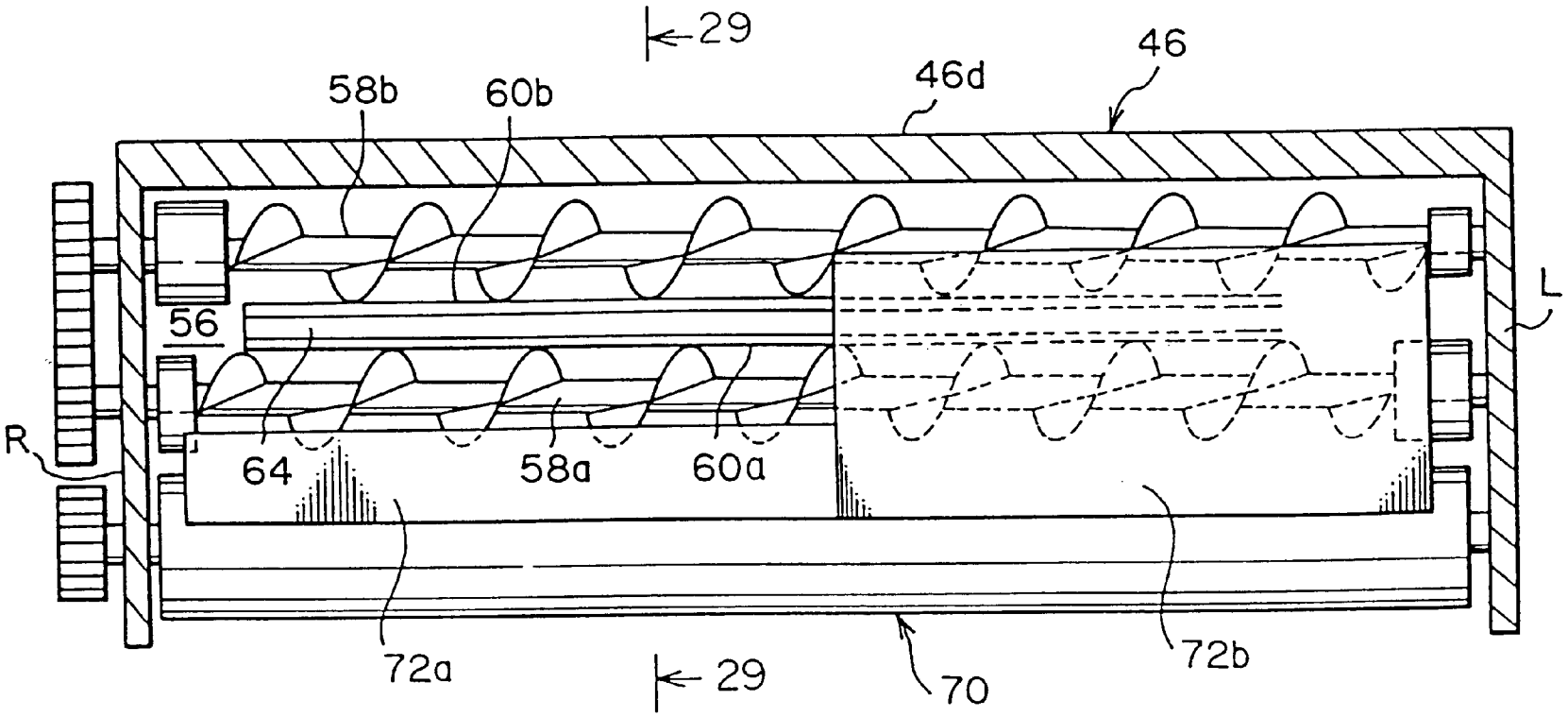
FIG. 28 is a plan view similar to FIG. 16, showing a fifth embodiment of a developing device according to the present invention.
Figure 29:
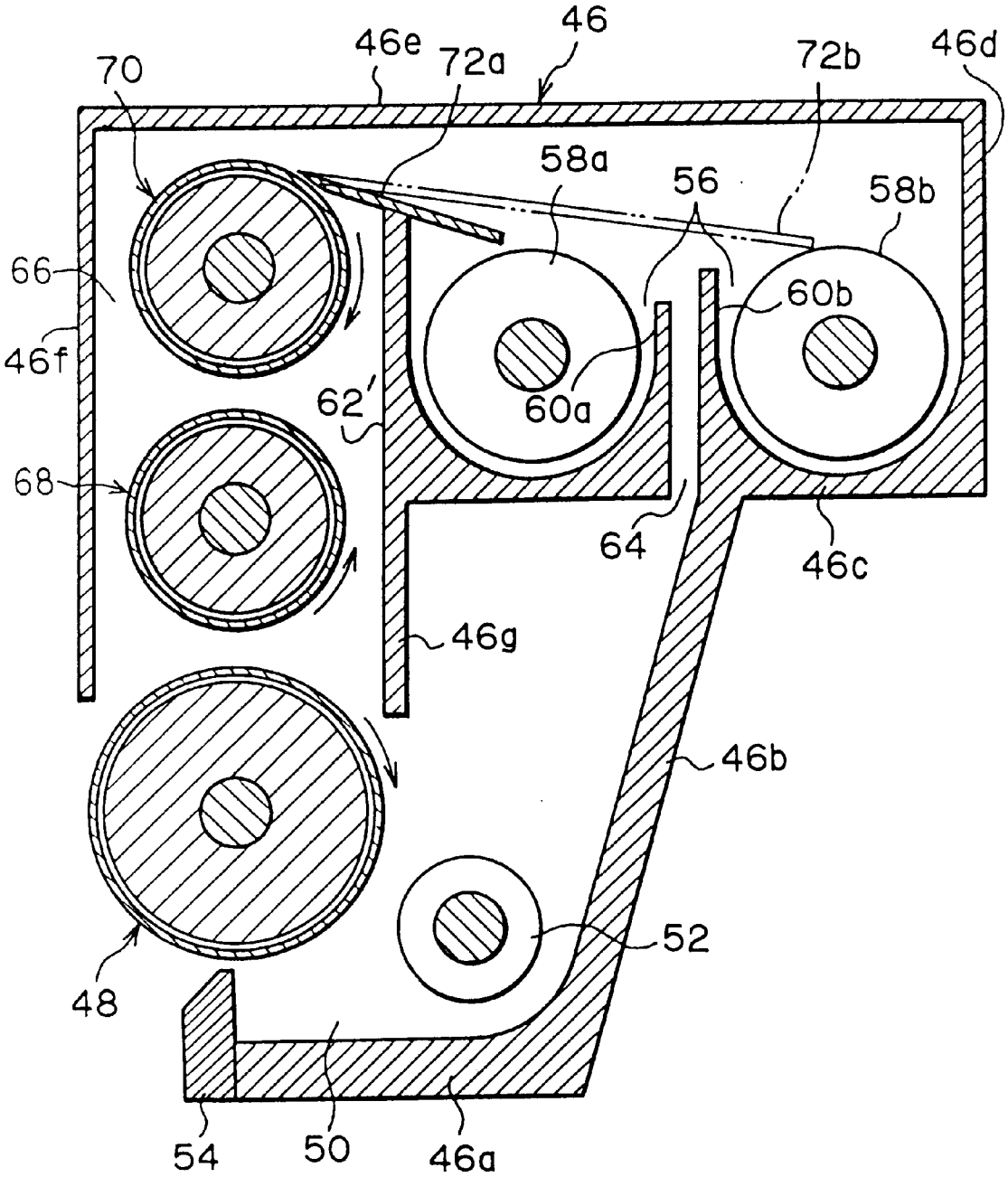
FIG. 29 is a sectional view taken along a line 29—29 of FIG. 28.
Figure 30:
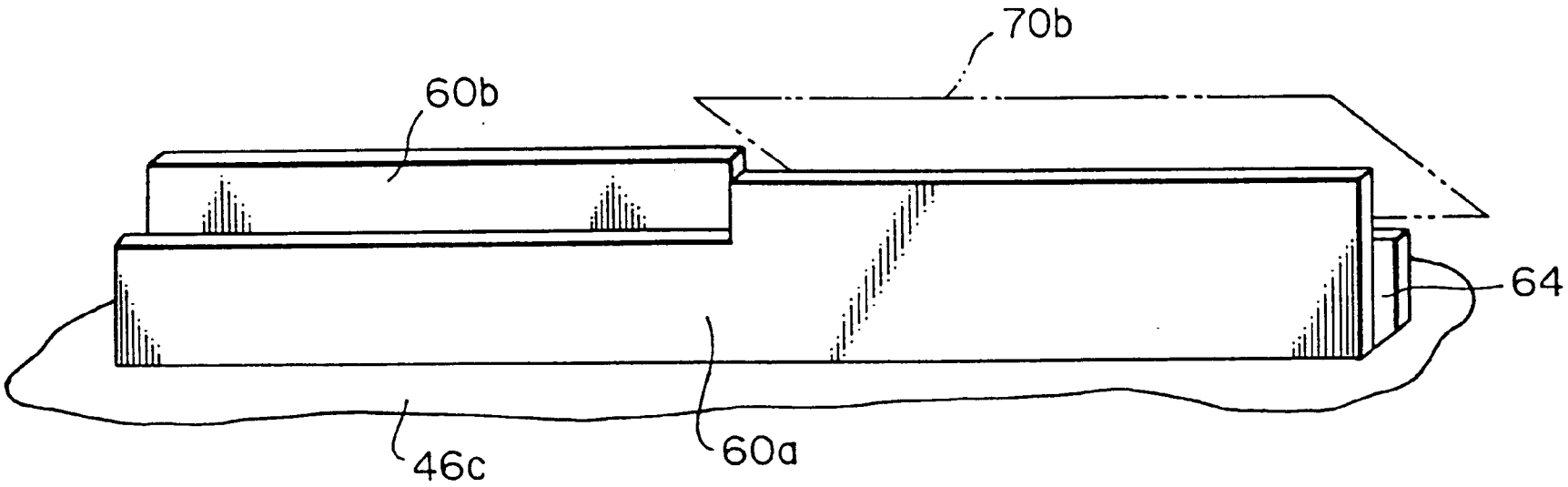
FIG. 30 is a partial perspective view showing a part of a developer-agitating chamber of the developing device of FIG. 28.

FIGS. 28–30 show a fifth embodiment of a developing device according to the present invention, which, similar to the third embodiment, is constituted so as to obviate an uneven distribution of the accumulated developer in the developer-accumulating chamber 50. In FIGS. 28–30, elements like or corresponding to those shown in FIGS. 4 and 5 are designated by the same references. As shown in FIGS. 28 and 29, in the fifth embodiment, the developing device is provided with two scraper members, i.e., a first scraper member 72*a* and a second scraper member 72*b*: the first scraper member 72*a* is disposed on the side of the left side wall R of a developer container 46, and the second scraper member 72*b* is disposed on the side of the right side wall L thereof. As is apparent from FIGS. 28 and 29, the width of the second scraper 72*b* is greater than that of the first scraper 72*a* such that the developer scraped off from a magnet roller 70 by the first scraper member 72*a* is supplied to a front screw conveyor 58*a* whereas the developer scraped off from the magnet roller by the second scraper 72*b* is supplied to a rear screw conveyor 58*b*. Both the scraper members 72*a* and 72*b* are attached to the upper end of a vertical partition wall 62' formed integrally with a second bottom wall 46*c*. The upper edge of the vertical partition wall 62' is suitably stepped such that the scraper members 72*a* and 72*b* can be sloped at different angles of inclination, respectively.

As shown in FIG. 30, in the fifth embodiment, one side section of a front partition plate 60*a* (placed on the side of the side wall L of the developer container 46) has a greater height than that of the other side section thereof, and a length equal to that of the second scraper member 72*b*. On the other hand, one section of a rear partition plate 60*b* (placed on the side of the side wall R of the developing container 46) has a greater height than that of the other side section thereof, and a length equal to that of the first scraper member 72*a*. In other words, the length of the lower section of the front partition plate 60*a* is equal to that of the first scraper member 72*a*, and the length of the lower section of the rear partition plate 60*b* is equal to that of the second scraper member 72*b*. During the circulation of the developer by the screw conveyors 58*a* and 58*b*, the respective upper edges of the lower sections of the front and rear partition plates 60*a* and 60*b* serve as overflow edges for the circulating developer. The developer thrust by the front screw conveyor 58*a* overflows the upper edge of the lower section of the front partition plate 60*a* into a communication passage 64, and the developer thrust by the rear screw conveyor 50*b* overflows the upper edge of the lower section of the rear partition plate 60*b* into the communication passage 64. With this arrangement, the developer recovered from the magnet roller 70 is prevented from being concentrated at a region near one of the side walls R and L of the developer container 46, resulting in a uniform distribution of developer in a developer-accumulating chamber 50.

The inventors of the present invention actually fabricated three types of developing devices in accordance with the fifth embodiment, and conducted experiments using these developing devices to examine how the developer devices to examine how the developer adhered to the developing rollers 48 in accordance with variation of relevant parameters. The details of the experiments will be explained thereafter. The developing device fabricated for the experiments has the following particulars:

(1) The length of the developer container 46, i.e., the length along the axis of the developing roller 48, was 300 mm.

(2) The developing roller 48 was 40 mm in diameter and 300 in length.

(3) The screw conveyors 58*a* and 58*b* were 28 mm in diameter and 25 mm in screw pitch.

(4) The developer-circulation rate, at which the developer is circulated in the developer container 46, was 8.7 g/s/cm (4.7 $cm^3$/s/cm as the developer-circulation volume).

(5) Although the above items (1) to (4) are common to the three types of developing devices: the second scraper member 60*b* of the first-type developing device was 140 mm in length (the length ratio of the second scraper 60*b* to the developing roller 48 was 0.47); the second scraper member 60*b* of the second-type developing device was 175 mm in length (the length ratio of the second scraper 60*b* to the developing roller 48 was 0.58); and the second scraper 60*b* of the third-type developing device was 210 mm in length (the length ratio of the second scraper 60*b* to the developing roller 48 was 0.7).

(6) The specific gravity of the developer was 1.85 g/cm.

Figure 31A:
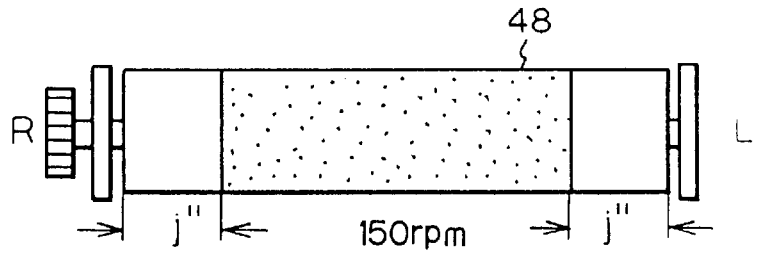
FIGS. 31A, 31B and 31C are diagrammatic views showing an adhesion of developer to a developing roller in the developing device of FIG. 28 when the length of a second scraper is set to be 140 mm and when the speed of rotation of developer-agitating screw conveyors is suitably varied.
Figure 31B:
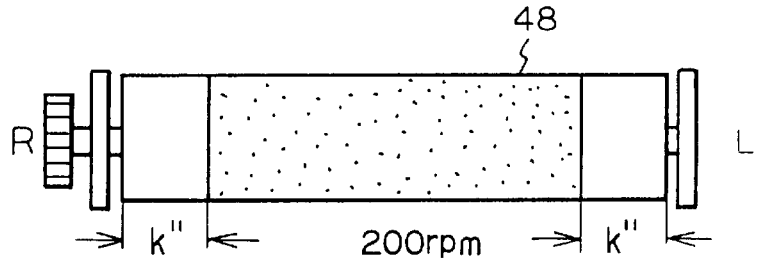
Figure 31C:
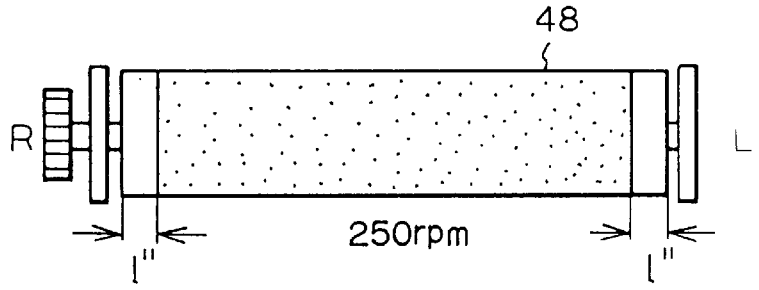

First, in the first-type developing device (the second scraper 60*b* of 140 mm in length), the developer-circulation rate was set to be 8.7 g/s/cm (4.7 $cm^3$/s/cm as the developer-circulation volume), and the screw conveyors 58*a* and 58*b* were rotated at 150 rpm, 200 rpm, and 250 rpm to examine how distribution of developer varies in the developer-accumulating chamber 50 in accordance with the variation of the speed of rotation of the screw conveyors 58*a* and 58*b*. FIGS. 31A, 31B and 31C show the results of the experiments, the details of which are as follows:

When the screw conveyors 58*a* and 58*b* were rotated at 150 rpm, the adhesion of developer to the developing roller 48 was as shown in FIG. 31A, and non-developer regions (shown as blank regions between arrows $j^{11}$—$j^{11}$) of about 40 mm in width at the opposite ends of the developing roller 48 were produced.

When the screw conveyors 58*a* and 58*b* were rotated at 200 rpm, the adhesion of developer to the developing roller 48 was as shown in FIG. 31B, and non-developer regions (shown as blank regions between arrows $h^{11}$–$k^{11}$) of about 35 mm in width at the opposite ends of the developing roller 48 were produced.

When the screw conveyors 58*a* and 58*b* were rotated at 250 rpm, the adhesion of developer to the developing roller 48 was as shown in FIG. 31C, and non-developer regions (shown as blank regions between arrows $l^{11}$—$l^{11}$) of about 15 mm in width at the opposite ends of the developing roller 48 were produced.

Figure 32A:
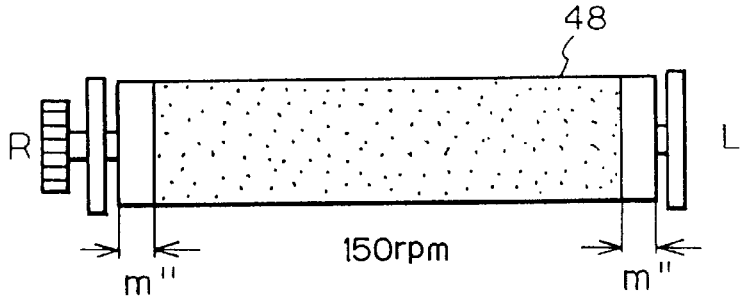
FIGS. 32A, 32B and 32C are diagrammatic views showing an adhesion of developer to a developing roller in the developing device of FIG. 28 when the length of a second scraper is set to be 175 mm and when the speed of rotation of developer-agitating screw conveyors is suitably varied.
Figure 32B:
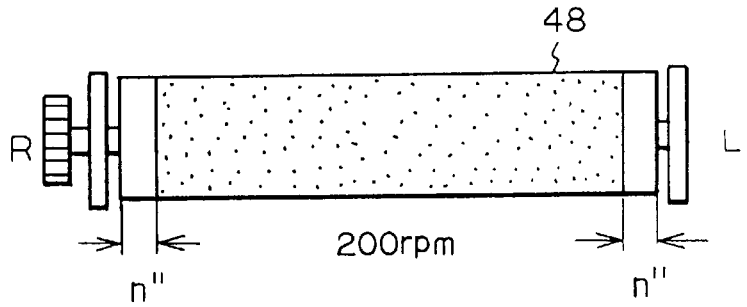
Figure 32C:
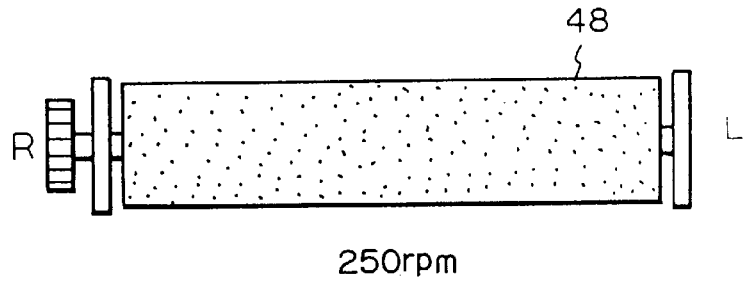

Then, in the second-type developing device (the second scraper 60*b* of 175 mm in length), the developer-circulation rate was set to be 8.7 g/s/cm (4.7 $cm^3$/s/cm as the developer-circulation volume), and the screw conveyors 58*a* and 58*b* were rotated at 150 rpm, 200 rpm, and 250 rpm to examine how distribution of developer varies in the developer-accumulating chamber 50 in accordance with the variation of the speed of rotation of the screw conveyors 58*a* and 58*b*. FIGS. 32A, 32B and 32C show the results of the experiments, the details of which are as follows:

When the screw conveyors 58*a* and 58*b* were rotated at 150 rpm, the adhesion of developer to the developing roller 48 was as shown in FIG. 32A, and non-developer regions (shown as blank regions between arrows $m^{11}$—$m^{11}$) of about 15 mm in width at the opposite ends of the developing roller 48 were produced.

When the screw conveyors 58*a* and 58*b* were rotated at 200 rpm, the adhesion of developer to the developing roller 48 was as shown in FIG. 32B, and non-developer regions (shown as blank regions between arrows $n^{11}$—$n^{11}$) of about 10 mm in width at the opposite ends of the developing roller 48 were produced.

When the screw conveyors 58*a* and 58*b* were rotated at 250 rpm, the adhesion of developer to the developing roller 48 was as shown in FIG. 32C, and the developer was adhered to the entire surface of the developing roller 48.

Figure 33A:
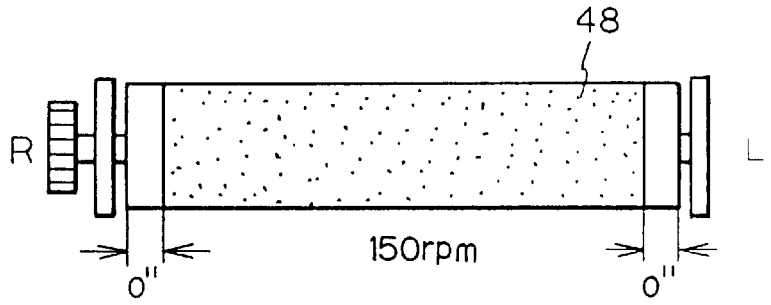
FIGS. 33A, 33B and 33C are diagrammatic views showing an adhesion of developer to a developing roller in the developing device of FIG. 28 when the length of a second scraper is set to be 210 mm and when the speed of rotation of developer-agitating screw conveyors is suitably varied.
Figure 33B:
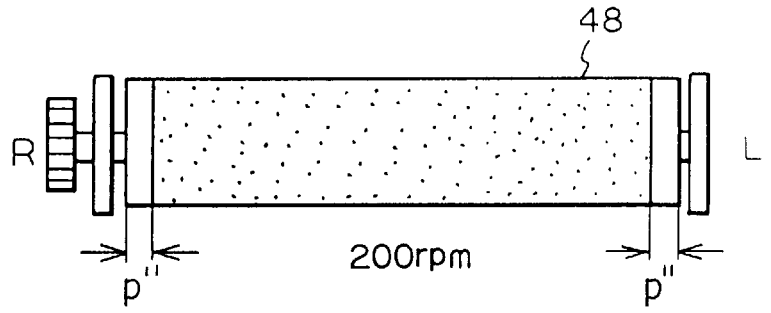
Figure 33C:
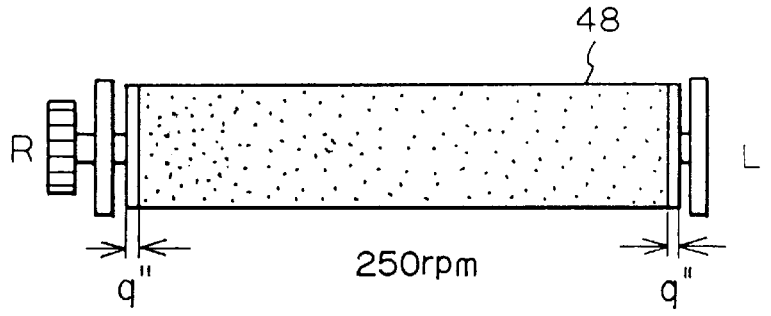

Further, in the third-type developing device (the second scraper 60*b* of 210 mm in length), the developer-circulation rate was set to be 8.7 g/s/cm (4.7 $cm^3$/s/cm as the developer-circulation volume), and the screw conveyors 58*a* and 58*b* were rotated at 150 rpm, 200 rpm or 250 rpm to examine how distribution of developer varies in the developer-accumulating chamber 50 in accordance with the variation of the speed of rotation of the screw conveyors 58*a* and 58*b*. FIGS. 33A, 33B and 33C show the results of the experiments, the details of which are as follows:

When the screw conveyors 58*a* and 58*b* were rotated at 150 rpm, the adhesion of developer to the developing roller 48 was as shown in FIG. 33A, and non-developer regions (shown as blank regions) between arrows $O^{11}$—$O^{11}$ of about 15 mm in width at the opposite ends of the developing roller 48 were produced.

When the screw conveyors 58*a* and 58*b* were rotated at 200 rpm, the adhesion of developer to the developing roller 48 was as shown in FIG. 33B, and non-developer regions (shown as blank regions) between arrows $p^{11}$—$p^{11}$ of about 12 mm in width at the opposite ends of the developing roller 48 were produced.

When the screw conveyors 58*a* and 58*b* were rotated at 250 rpm, the adhesion of developer to the developing roller 48 was as shown in FIG. 33C, and non-developer regions (shown as blank regions) between arrows $Q^{11}$—$Q^{11}$ of about 5 mm in width at the opposite ends of the developing roller 48 were produced.

As is apparent from the results of the above-mentioned the experiments, in the fifth embodiment, the length of the second scraper 72*b* must be about half that of the developing roller 48 and the speed of rotation of the screw conveyors 58*a* and 58*b* must be more than 250 rpm, before the developer can be adhered to the entire surface of the developing roller 48.

Figure 34:
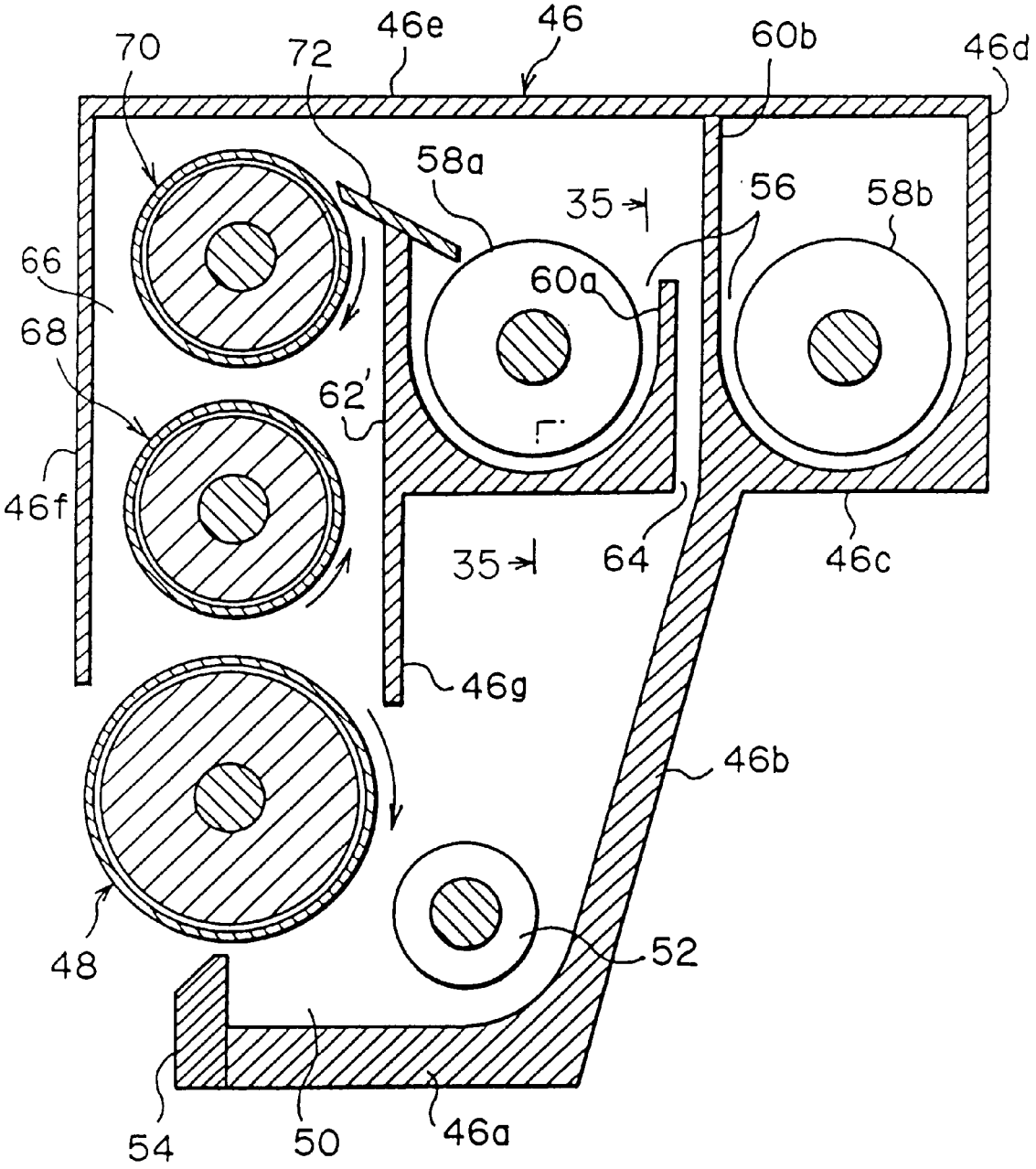
FIG. 34 is a schematic sectional view of a sixth embodiment of a developing device according to the present invention.
Figure 35:
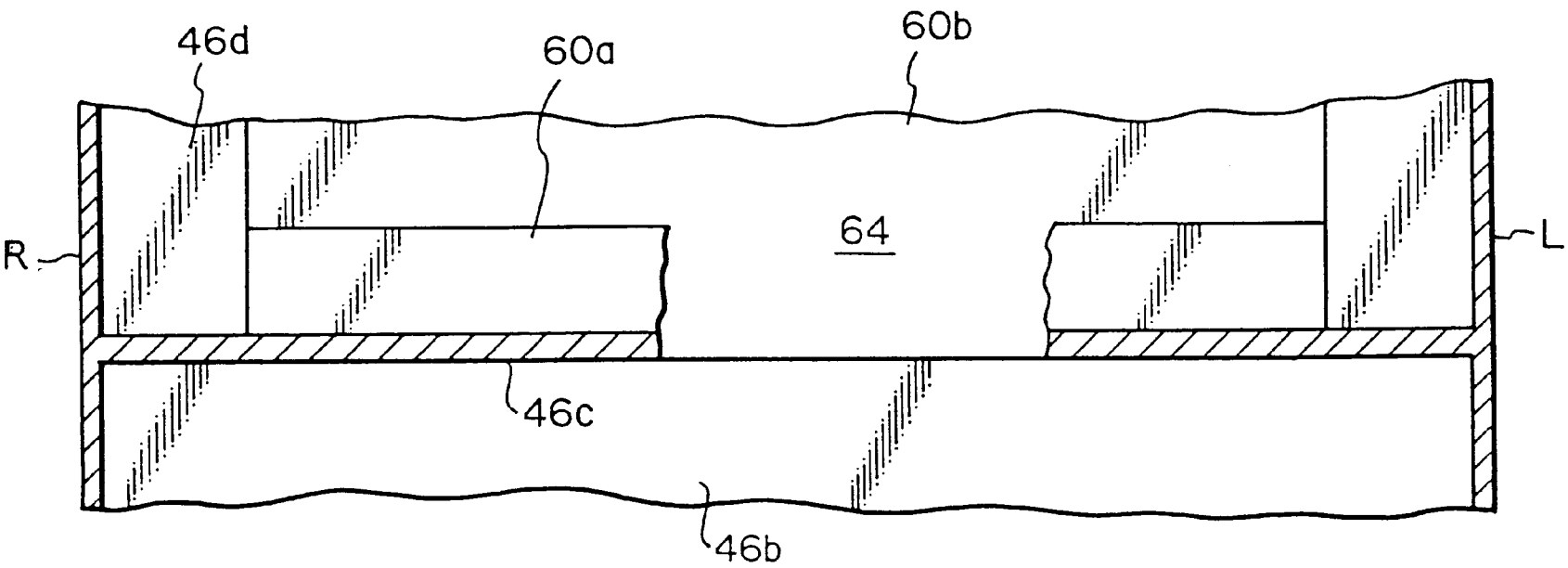
FIG. 35 is a sectional view taken along a line 35—35 of FIG. 34.

FIGS. 34 and 35 show a sixth embodiment of a developing device according to the present invention, which, similar to the third embodiment, is constituted so as to obviate an uneven distribution of the accumulated developer in the developer-accumulating chamber 50. In FIGS. 34 and 35, elements like or corresponding to those shown in FIGS. 4 and 5 are designated by the same references. In the sixth embodiment, an upper edge of a front partition plate 60*a* has a lower level than that of the top of a front screw conveyor 58*a*, and thus serves as an overflow edge for the developer thrust by a front screw conveyor 58*a*, and a rear partition plate 60*b* is extended upward beyond a level of the top of a rear screw conveyor 58*b* to thereby prevent the developer from overflowing over the rear partition plate 60*b*.

The inventors of the present invention actually fabricated two types of developing devices in accordance with the sixth embodiment, and experiments were conducted to examine how the developer was distributed in the developer-accumulating chamber 50 and how the developer was adhered to the developing roller 48 in accordance with variation of relevant parameters. The details of experiments will be explained hereinafter.

The developing device fabricated for the experiments has the following particulars:

(1) The longitudinal length of the developer container 46, i.e., the length along the axis of the developing roller 48, was 300 mm.

(2) The developing roller 48 was 40 mm in diameter and 300 in length.

(3) The screw conveyors 58*a* and 58*b* were 28 mm in diameter and 25 mm in screw pitch, and were rotated at 200 rpm.

(4) The developer-circulation rate, at which the developer was circulated in the developer container 46, was 8.7 g/s/cm (4.7 $cm^3$/s/cm as the developer-circulation volume).

(5) Although the particulars of Items (1) to (4) were common to the first-type and second-type developing devices, the front partition plate 60*a* of the first-type developing device was 11 mm in height (the ratio of the height of the front partition plate to the diameter of the screw conveyors 58*a* and 58*b* was 0.39), and the front partition plate 60*a* of the second-type developing device was 5 mm (the ratio of the height of the front partition plate to the diameter of the screw conveyors 58*a* and 58*b* was 0.18).

(6) The specific gravity of the developer was 1.85 g/cm.

Figure 36A:
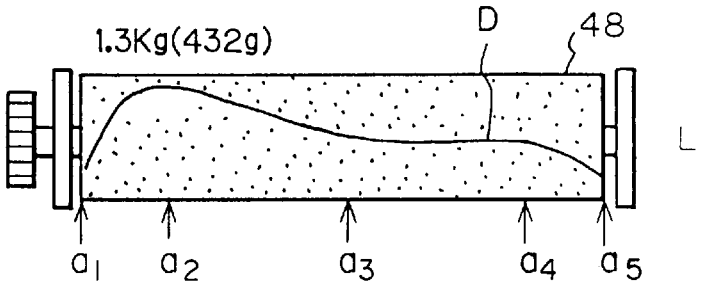
FIGS. 36A, 36B, 36C and 36D are diagrammatic views showing the distribution of accumulated developer and the adhesion of developer to a developing roller in the developing device of FIG. 34 when the height of a front partition plate is set to be 11 mm and when the total quantity of developer is suitably varied.

In the first-type developing device (the height of the front partition 60*a* was 11 mm), the total quality of developer was set to be 1.3 kg, 1.4 kg, 1.6 kg, and 1.8 kg, and it was examined how the developer was distributed in the developer-accumulating chamber 50 and how the developer was adhered to the developing roller 48 in accordance with the variation of the total quantity of developer. FIGS. 36A, 36B, 36C and 36D show the results of the experiments, the details of which are as follows:

When the total quantity of developer held in the developer container 46 was 1.3 kg, the quantity of the developer accumulated in the developer-accumulating chamber 50 was 432 g, and the distribution of developer with respect to the developing roller 48 is represented by the curve D shown in FIG. 36A. At each of the locations along the developing roller 48 at arrows $a_1$, $a_2$, $a_3$, $a_4$, $a_5$, in the order of the arrows, the height of accumulated developer at the location of the arrows is, as follows: 16 mm, 36 mm, 20 mm, 18 mm and 9 mm. In this case, the developer was adhered to the entire surface of the developing roller 48.

Figure 36B:
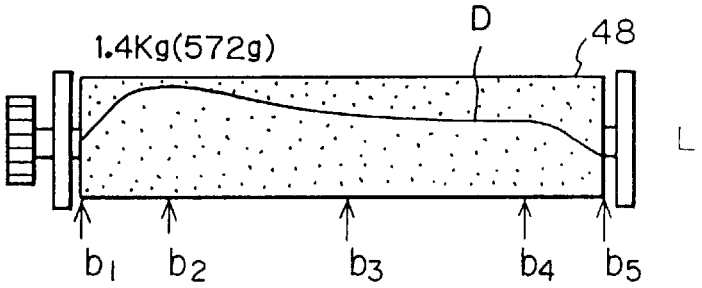

When the total quantity of developer held in the developer container 46 was 1.4 kg, the quantity of the developer accumulated in the developer-accumulating chamber 50 saw 572 g, and the distribution of developer with respect to the developing roller 48 is represented by the curve D shown in FIG. 36B. At each of the locations along the developing roller 48 at arrows $b_1$, $b_2$, $b_3$, $b_4$, $b_5$, in the order of the arrows is the height of accumulated developer at the location of the arrows is, as follows: 25 mm, 37 mm, 26 mm, 25 mm and 16 mm. In this case, the developer was adhered to the entire surface of the developing roller 48.

Figure 36C:
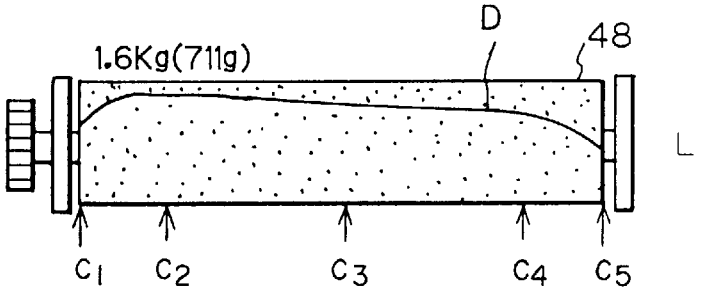

When the total quantity of developer held in the developer container 46 was 1.6 kg, the quantity of the developer accumulated in the developer-accumulating chamber 50 was 711 g, and the distribution of developer with respect to the developing roller 48 is represented by the curve D shown in FIG. 36C. At each of the locations above the developing roller 48 at arrows $c^1$, $c^2$, $c^3$, $c_4$, $c_5$, in the order of the arrows, is the height of accumulated developer at the location of the arrows, as follows: 30 mm, 36 mm, 33 mm, 30 mm and 22 mm. In this case, the developer was adhered to the entire surface of the developing roller 48.

Figure 36D:
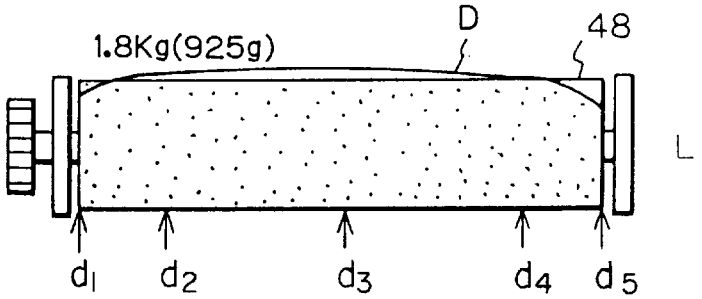

When the total quantity of developer held in the developer container 46 was 1.8 kg, the quantity of the developer accumulated in the developer-accumulating chamber 50 was 925 g, and the distribution of developer with respect to the developing roller 48 is represented by the curve D shown in FIG. 36D. At each of the locations above the developing roller 48 at arrows $d^1$, $d^2$, $d^3$, $d_4$, $d_5$, in the order of the arrows, is the height of accumulated developer at the location of the arrows, as follows: 39 mm, 42 mm, 43 mm, 41 mm and 34 mm. In this case, the developer was adhered to the entire surface of the developing roller 48.

Then, in the second-type developing device (the height of the front partition plate 60*a* was 5 mm), the total quantity of developer was set to be 1.0 kg, 1.23 kg, 1.4 kg, 1.6 kg, and 1.8 kg and it was examined how the developer was distributed in the developer-accumulating chamber 50 and how the developer was adhered to the developing roller 48 in accordance with the variation of the total quantity of developer.

Figure 37A:
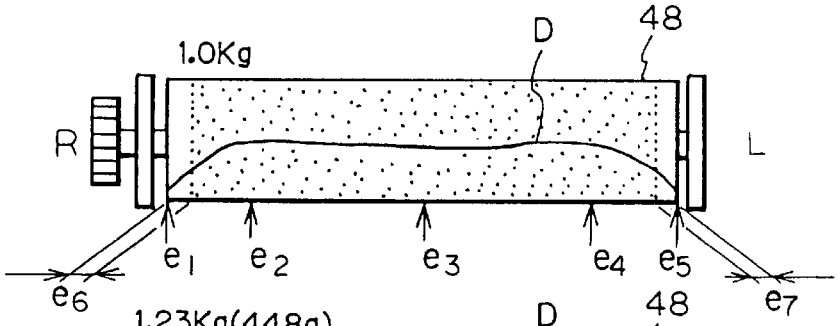
FIGS. 37A, 37B, 37C, 37D and 37E are diagrammatic views showing the distribution of accumulated developer and the adhesion of developer to a developing roller in the developing device of FIG. 34 when the height of a front partition plate is set to be 5 mm and when the total quantity of developer is suitably varied.

FIGS. 37A, 37B, 37C, 37D and 37E show the results of the experiments, the details of which are as follows:

When the total quantity of developer held in the developer container 46 was 1.0 kg, the distribution of developer with respect to the developing roller 48 is represented by the curve D shown in FIG. 37A. At each of the locations above the developing roller 48 at arrows $e^1$, $e^2$, $e^3$, $e_4$, $e_5$, in the order of the arrows, is the height of accumulated developer at the location of the arrows, as follows: 7 mm, 19 mm, 18 mm, 17 mm and 17 mm. In this case, the non-developer regions (as shown as a blank region at opposite ends of developing roller 48 between arrows $e^6$—$e^6$ and $e_7$—$e_7$) of about 10 mm in width were produced.

Figure 37B:
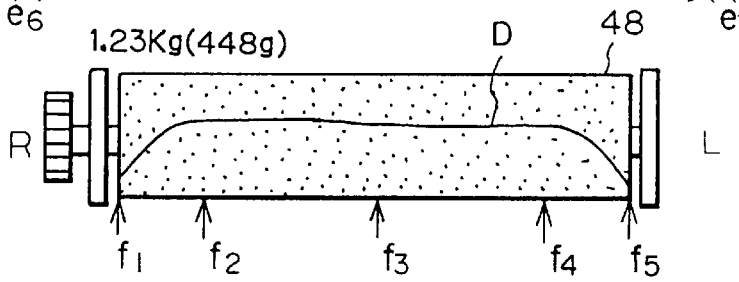
Figure 37C:
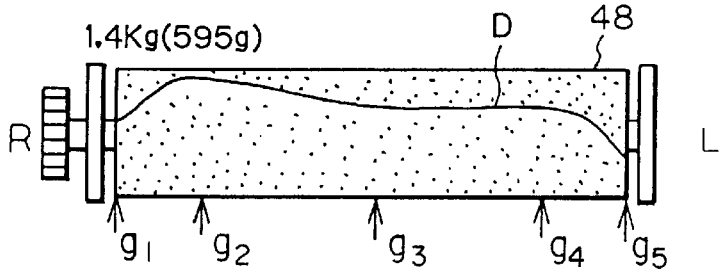

When the total quantity of developer held in the developer container 46 was 1.23 kg, the quantity of the developer accumulated in the developer-accumulating chamber 50 was 448 g, and the distribution of developer with respect to the developing roller 48 is represented by the curve D shown in FIG. 37B. At each of the locations above the developing roller 48 at arrows $f^1$, $f^2$, $f^3$, $f_4$, and $f_5$, the height of accumulated developer at the location of the arrows, as follows: 12 mm, 25 mm, 24 mm, 22 mm and 7 mm. In this case, the developer was adhered to the entire surface of the developing roller 48.

When the total quantity of developer held in the developer container 46 was 1.4 kg. The quantity of the developer accumulated in the developer-accumulating chamber 50 was 595 g, and the distribution of developer with respect to the developing roller 48 is represented by the curve D shown in FIG. 37C. At each of the locations above the developing roller 48 at arrows $g^1$, $g^2$, $g^3$, $g_4$, and $g_5$, the height of accumulated developer at the each arrow is, as follows: 25 mm, 37 mm, 28 mm, 27 mm and 15 mm. In this case, the developer was adhered to the entire surface of the developing roller 48.

Figure 37D:
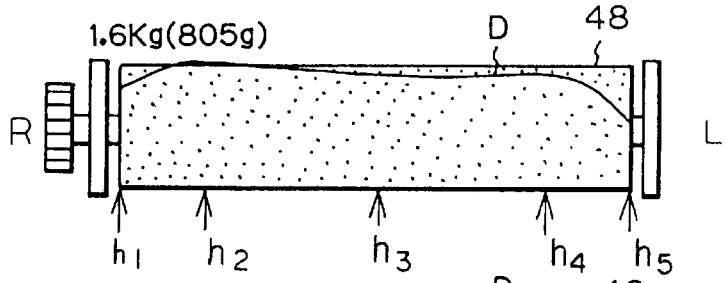

When the total quantity of developer held in the developer container 46 was 1.6 kg, the quantity of the developer accumulated in the developer-accumulating chamber 50 was 977 g, and the distribution of developer with respect to the developing roller 48 is represented by the curve D shown in FIG. 37D. At each of the locations the developing roller 48, at arrows $h_1$, $h_2$, $h_3$, $h_4$, and $h_5$ the height of accumulated developer at the location of the arrows are, as follows: 34 mm, 40 mm, 37 mm, 36 mm and 26 mm. In this case, the developer was adhered to the entire surface of the developing roller 48.

Figure 37E:
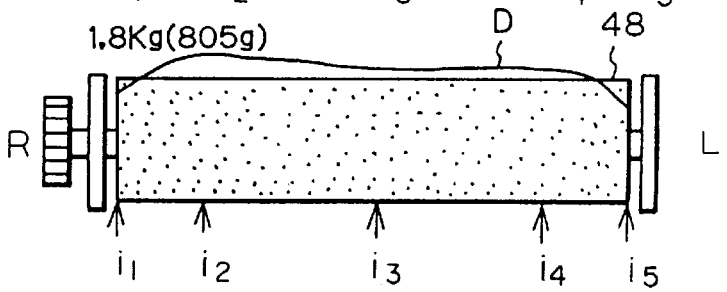

When the total quantity of developer held in the developer container 46 was 1.8 kg, the quantity of the developer accumulated in the developer-accumulating chamber 50 was 977 g, and the distribution of developer with respect to the developing roller 48 is represented by the curve D shown in FIG. 37E. At each of the locations above the developing roller 48 at arrows $i_1$, $i_2$, $i_3$, $i_4$, and $i_5$ the height of accumulated developer at the location of the arrows are as follows: 37 mm, 47 mm, 44 mm, 43 mm, and 34 mm. In this case, the developer was adhered to the entire surface of the developing roller 48.

As is apparent from the results of the above-mentioned the experiments, in the sixth embodiment, when the height of the front partition plate 60*a* is set to be 11 mm (the ratio of the height of the front partition plate to the diameter of the screw conveyors 58*a* and 58*b* is 0.39), the total quantity of developer to be held in the developer container 46 should bed at least 1.3 kg before the developer can be adhered to the entire surface of the developing roller 48. In other words, the quantity of developer to be accumulated in the developer-accumulating chamber should be at least about 430 g. Note, when the quantity of the accumulated developer is 250 g, the quantity of developer onto the developing roller 48 per unit length was 14 g/cm, and this value of the quantity of developer forms a standard for determining a necessary total quantity of developer to be held in a developer container when a different type of developing device is designed. On the other hand, in the sixth embodiment, when the height of the front partition plate 60*a* is set to be 5 mm (the ratio of the height of the front partition plate to the diameter of the screw conveyors 58*a* and 58*b* is 0.18), the total quantity of developer to be held in the developer container 46 should be at least 1.2 kg before the developer can be adhered to the entire surface of the developing roller 48. In this case, the quantity of the accumulated developer is more than about 450 g, and the quantity of developer onto the developing roller 48 per unit length is 15 g/cm. Furthermore, it can be found from FIGS. 36A to 36D and FIGS. 37A to 37E that the height of the accumulated developer should be more than about 10 mm before the developer can be adhered to the entire surface of the developing roller 48.

Figure 38:
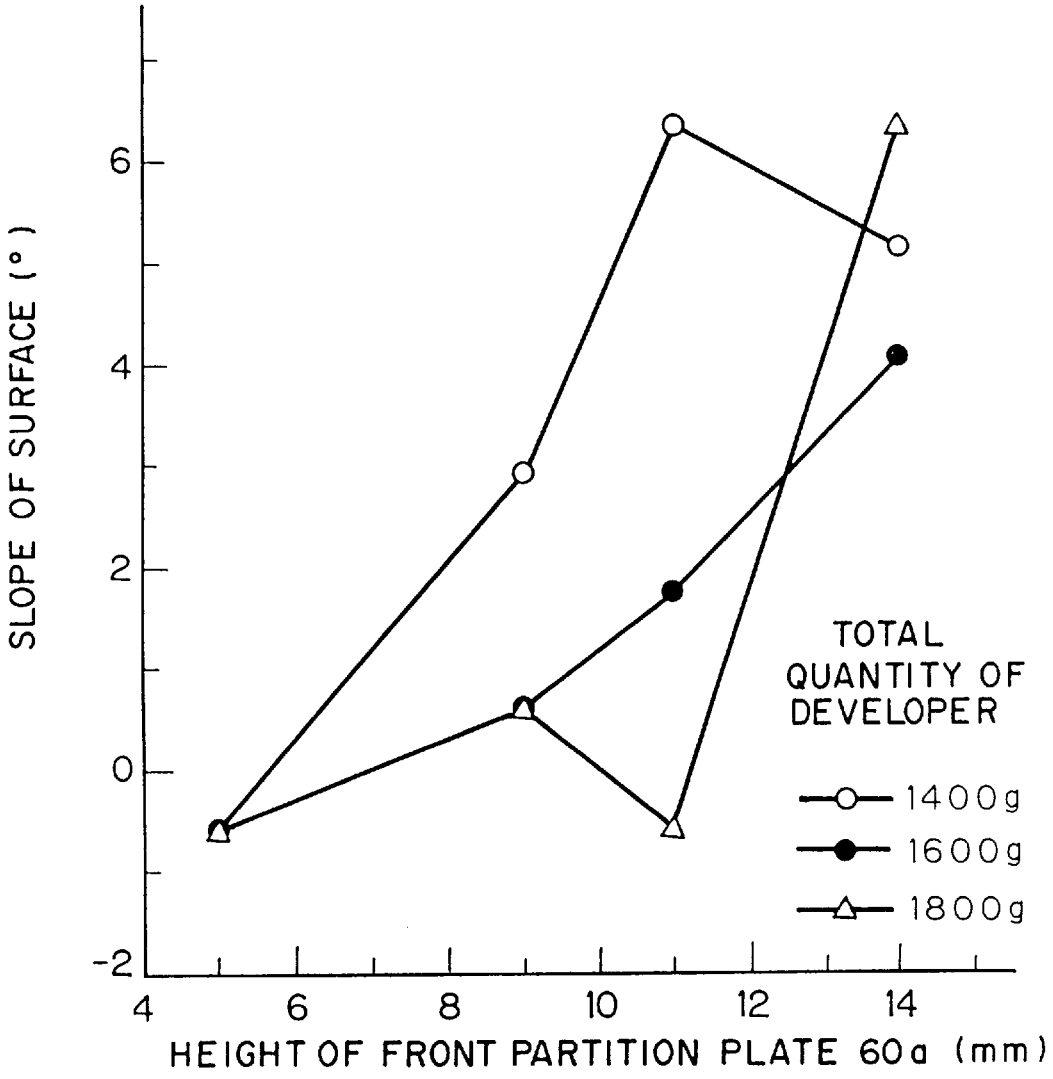
FIG. 38 is a graph showing the relationship between the height of a front partition plate and the slope of the surface of the accumulated developer in the developing device of FIG. 34.

As is apparent from FIGS. 36A to 36D and 37A to 37E, in the sixth embodiment, the surface of the accumulated developer in the developer-accumulating chamber 50 tends to slope down from one end of the developing roller 48 toward the other end thereof. A graph of FIG. 38 shows a relationship between the slope of the surface of the accumulated developer and the height of the front partition plate 60*a*. The results shown in FIG. 38 were obtained through experiments in which the height of the front partition plate 60*a* was varied in the above-mentioned developing device. In the graph of FIG. 38, when the surface of the accumulated developer slopes down from the side R toward the side L, this slope is conveniently defined as a negative slope. Also, when a total quantity of the developer is 1.4 kg, the slopes of the surface of the accumulated developer is indicted by a symbol "○"; when a total quantity of the developer is 1.6 kg, the slopes of the surface of the accumulated developer is indicated by a symbol "●"; and when a total quantity of the developer of 1.8 kg, the slopes of the surface of the accumulated developer is indicated by a symbol "Δ". Of course, preferably, the slope of the surface of the accumulated developer should fail to the least possible slope before a uniform toner density of recording can be ensured along the axis of the developing roller 48. As is apparent from the graph of FIG. 38, in the case where the height of the front partition plate 60*a* is set to be 14 mm within the range of the total quantity of 1.4 to 1.8 kg (the ratio of the height of the front partition plate to the diameter of the screw conveyors 58*a* and 58*b* is 0.50), although the slope of the surface of the accumulated developer is as large as about 5°, that slope can be made −0.50° by reducing the height of the front partition plate 60*a* to 4 mm. Also, when the height of the front partition plate 60*a* is selected within the range of 1 to 11 mm, the slope of the surface of the accumulated developer can be generally deemed to be zero in the range of the total quantity of 1.4 to 1.8 kg.

Figure 39:
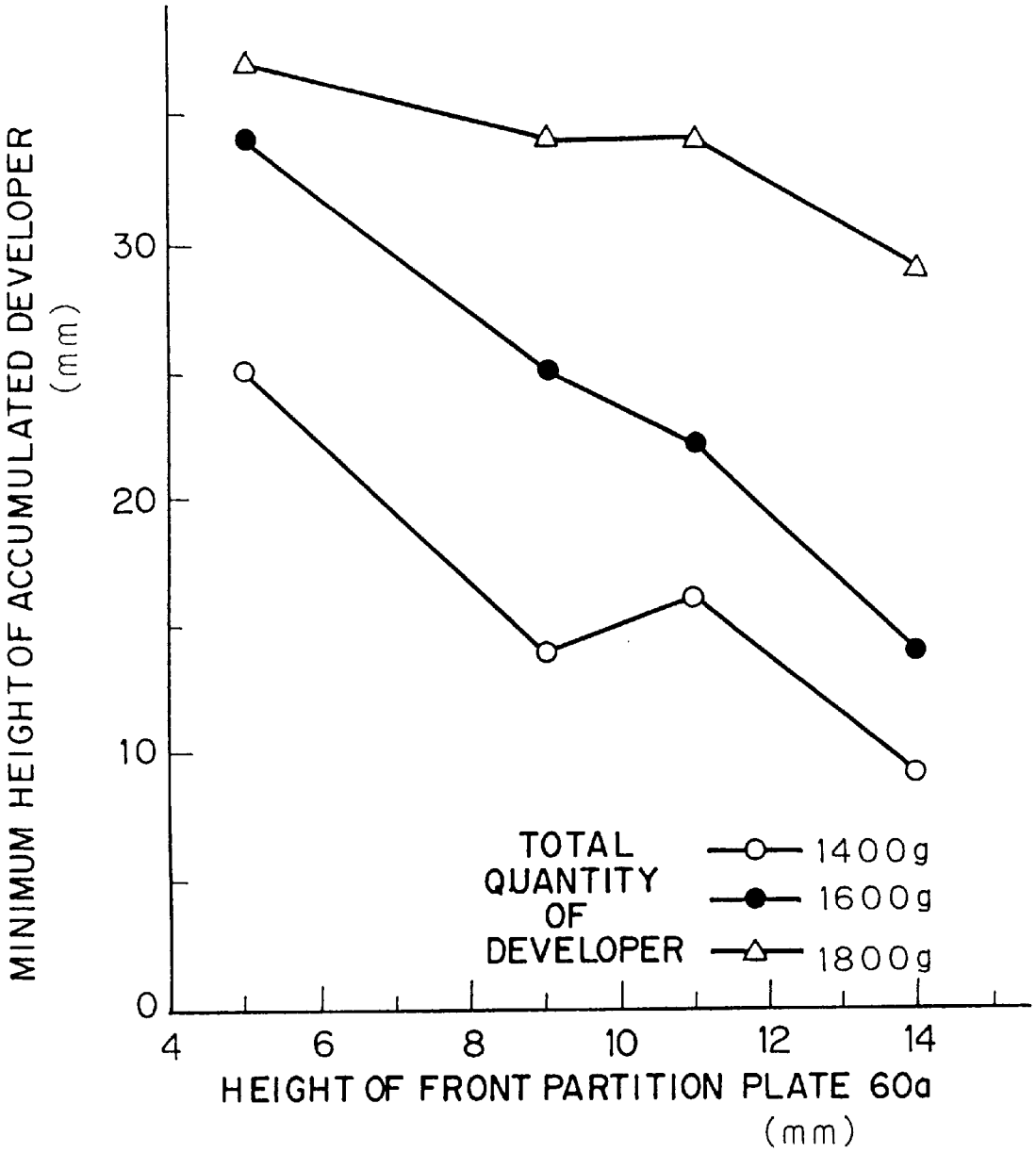
FIG. 39 is a graph showing the relationship between a front partition plate and the minimum height of the accumulated developer in the developing device of FIG. 34.

A graph of FIG. 39 also shows a relationship between the height of the front partition plate 60*a* and the minimum height of the accumulated developer on the sixth embodiment. The results shown in FIG. 39 also were obtained through experiments in which the height of the front partition plate 60*a* was varied in the above-mentioned developing device. Similar to the graph of FIG. 38, in the graph of FIG. 39, when a total quantity of the developer is 1.4 kg, the minimum height of the accumulated developer is indicted by a symbol "○"; when a total quantity of the developer is 1.6 kg, the minimum height of the accumulated developer is indicted by a symbol "●"; and when a total quantity of the developer of 1.8 kg, the minimum height of the accumulated developer is indicted by a symbol "Δ". As is apparent from FIG. 38, the minimum height of the accumulated developer is substantially in inverse proportion to the height of the front partition plate 60*a*. Namely, the height the front partition plate 60*a*, the smaller the minimum height of the accumulated developer. For example, in the case where the total quantity of developer is 1.4 kg, although the minimum height of the accumulated developer is about 9 mm when the height of the accumulated developer can be increased to about 25 mm by making the height of the front partition plate 60*a* 5 mm.

Figure 40:
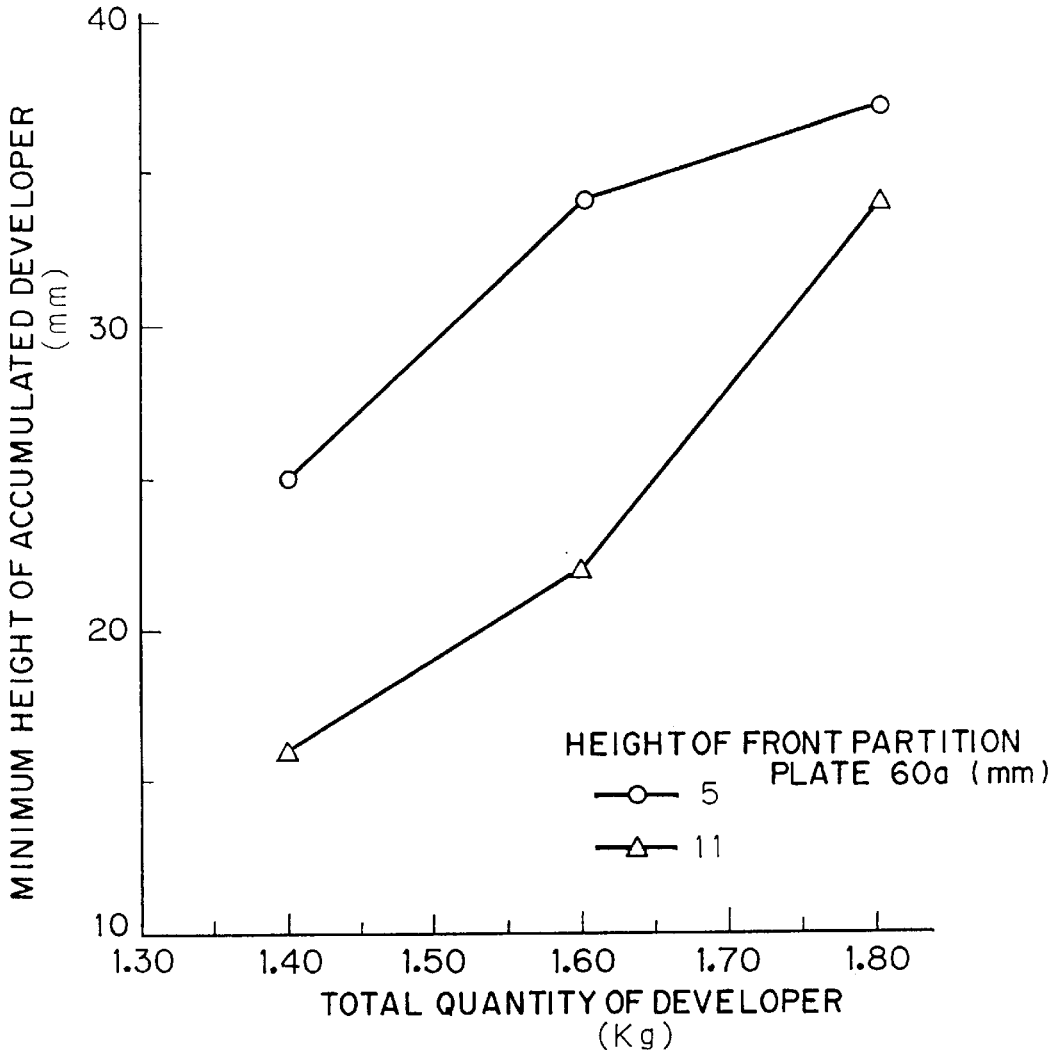
FIG. 40 is a graph showing the relationship between the total quantity of developer and the minimum height of the accumulated developer in the developing device of FIG. 34.
Figure 41:
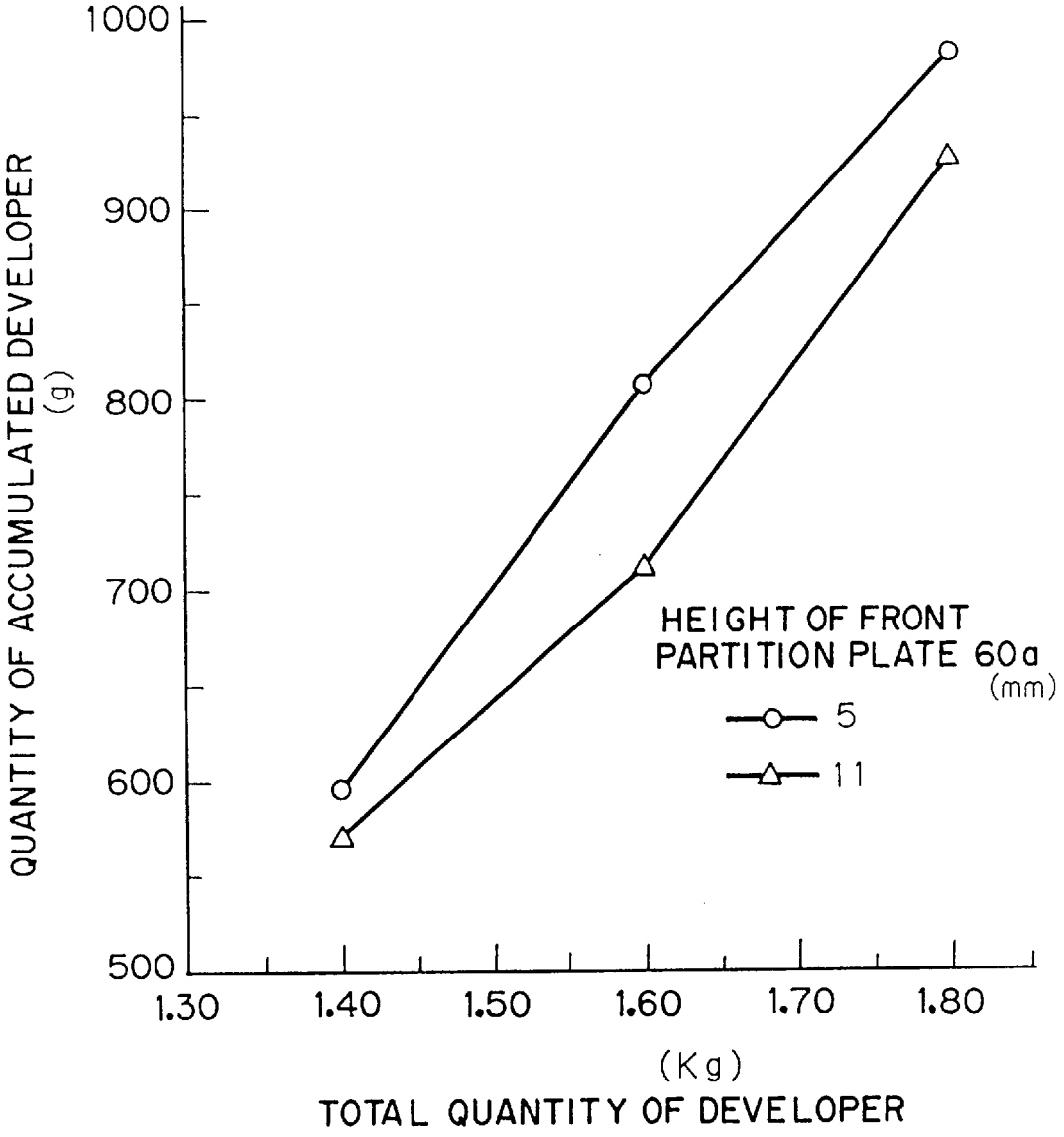
FIG. 41 is a graph showing the relationship between the total quantity of the developer and the quantity of the accumulated developer in the developing device of FIG. 34.

The graphs in FIGS. 40 and 41 show relationship between the total quantity of developer and the minimum height of the accumulated developer and a relationship between the total quantity of developer and a relationship between the total quantity of developer and the quantity of the accumulated developer, and these graphs were made on the basis of the experimental results shown in FIGS. 36 and 37. As is apparent from the two graphs, the total quantity of developer is in proportion to the minimum height of the accumulated developer, and the total quantity of developer is in proportion to the quantity of the accumulated developer, and thus it can be found that the slope of the surface of the accumulated developer can be reduced by increasing the total quantity of developer.

Figure 42A:
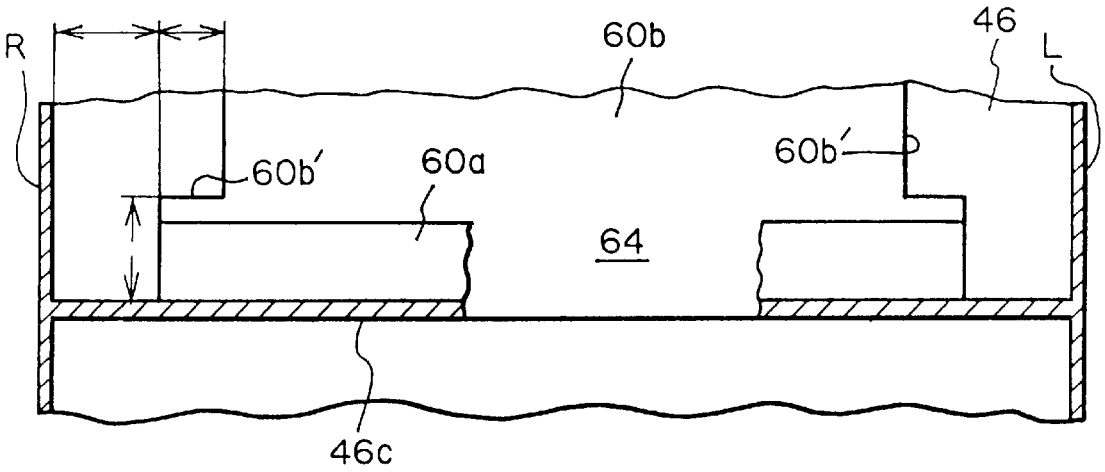
FIG. 42A is a sectional view, similar to FIG. 35, showing a modification of the developing device of FIG. 35, and FIGS. 42B, 42C and 42D are diagrammatic views showing the distribution of accumulated developer and the adhesion of developer to a developing roller in the developing device of FIG. 42A when the total quantity of developer is suitably varied.

In the sixth embodiment shown in FIGS. 34 and 35, as the height of the front partition plate 60*a* is increased, the slope of the surface of the accumulated developer becomes larger. Accordingly, the height of the front partition plate 60*a* should be at most 11 mm before the height of the accumulated developer can be made uniform. Nevertheless, when the height of the front partition plate 60*a* is made small, the developer cannot be sufficiently agitated by the screw conveyors 58*a* and 58*b*. This is because the developer is prematurely fed to the developer-accumulating chamber 10 as the height of the front partition plate 60*a* is made smaller. FIG. 42A shows a modification of the sixth embodiment shown in FIGS. 34 and 35, which is constituted so as to resolve the issue discussed above. As shown in FIG. 42A, the opposite ends of a rear partition plate 60*b* are partially cut away so as to form rectangular notches 60*b*'. In this modified embodiment, the height of a front partition plate 60*a* is 14 mm, and the rectangular notches 60*b*' have sizes indicated by the values written in the left-hand side of FIG. 42A. Namely, the opposite ends of the rear partition plate 60*b* are spaced apart 22 mm from the side walls R and L. of a developer container 46; the rectangular notches 60*b*' have a horizontal depth of 10 mm; and the horizontal edges of the recesses 60*b*' have a height of 25 mm. With this arrangement, the quantity of developer, which overflows into the opposite end regions of a communication passage 64, is increased to some extent due to the existence of the rectangular notches 60*b*', which contributes to leveling the height of the accumulated developer. On the other hand, the height of the front partition plate 60*b* is as large as 14 mm, and thus a sufficient agitation of developer can be ensured.

Figure 43A:
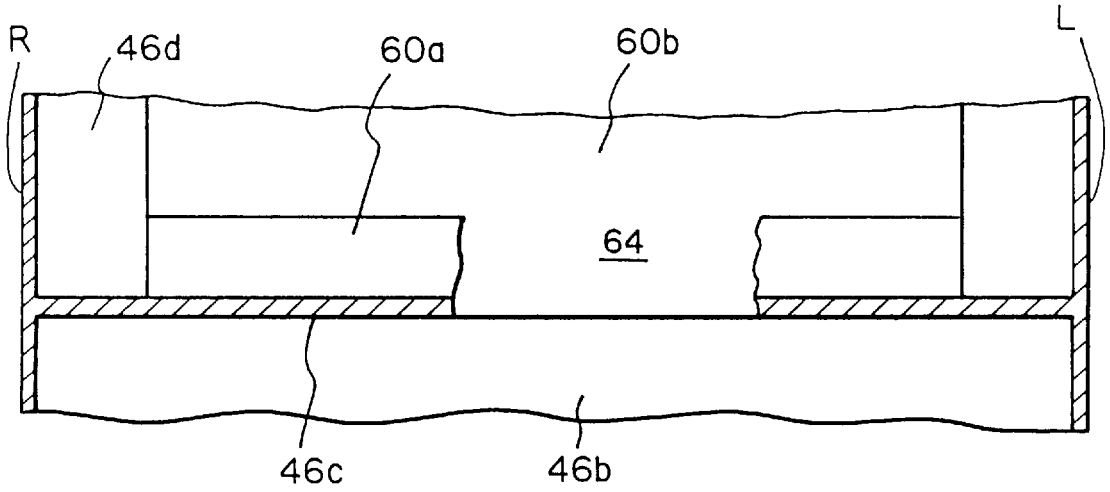
FIG. 43A is a sectional view of a comparative example to the developing device of FIG. 42A, and FIGS. 43B, 43C and 43D are diagrammatic views showing the distribution of accumulated developer and the adhesion of developer to a developing roller in the developing device of FIG. 43A when the total quantity of developer is suitably varied.

FIG. 43A which shows a part of a developing device constituted in accordance with the sixth embodiment is shown in FIG. 43A for comparison with the modified embodiment shown in FIG. 42A. The developing device shown in FIG. 43A is the same in construction as the developing device shown in FIG. 42A, except that the rear partition plate in FIG. 43A has no corresponding rectangular notches 60*b*'.

Experiments similar to those conducted for the sixth embodiment were carried out in the developing devices as shown in FIGS. 42A and 43A to examine how the developer is distributed in the developer-accumulating chambers 50 thereof and how the developer is adhered to the developing rollers 48 thereof. FIGS. 42B to 42D and 43B to 43D show the results of the experiments.

Figure 42B:
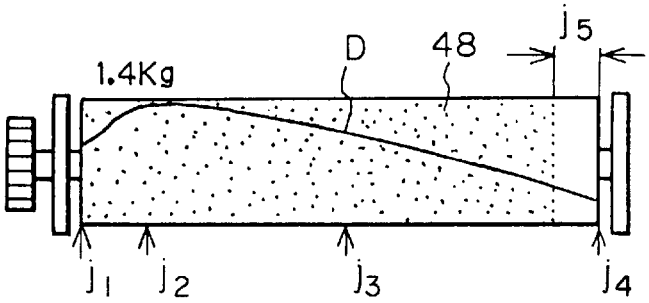

First, in the developing device shown in FIG. 42A, the total quantity of developer held in the developer container 46 was set to be 1.4 kg, 1.6 kg, and 1.8 kg, and it was examined how the developer was distributed in the developer accumulating chamber 50 and how the developer adhered to the developing roller 48 in accordance with the variation of the total quantity of developer. The details of the experiments are as follows:

When the total quantity of the developer was set to be 1.4 kg, the distribution of the accumulated developer with respect to the developing roller 48 is represented by the curve D shown in FIG. 42B. At each location the developing roller 48 at arrows, $j_1$, $j_2$, j3, and $j_4$ the height of the accumulated developer at a location above the arrow is as follows: 29 mm, 38 mm, 38 mm, and 8 mm. In this case, a non-developer region (shown as a blank region between arrows $j_5$ and $j_6$) of about 25 mm in width and about the end of the developing roller 48 was produced.

Figure 42C:
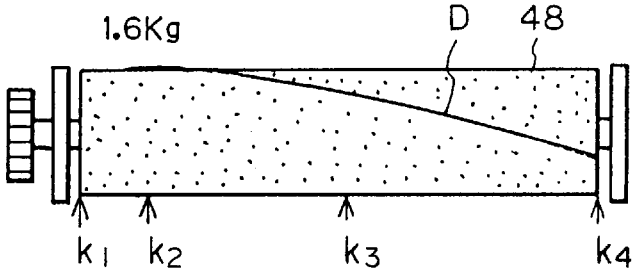

When the total quantity of the developer was set to be 1.6 kg, the distribution of the accumulated developer with respect to the developing roller 48 is represented by the curve D shown in FIG. 42C. At each location above the developing roller 48 at arrows $k_1$, $k_2$, $k_3$, and $k_4$ the height of the accumulated developer at a location above the arrow is, as follows: $l_1$, $l_2$, $l_3$, and $l_4$. In this case, the developer was adhered to the entire surface of the developing roller 48.

Figure 42D:
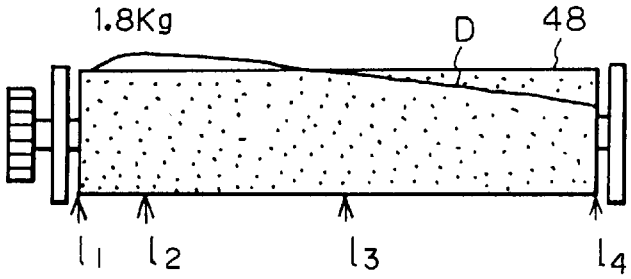

When the total quantity of the developer was set to be 1.8 kg, the distribution of the accumulated developer with respect to the developing roller 48 is represented by the curve D shown in FIG. 42D. At each location above the developing roller at arrows $m_1$, $m_2$, $m_3$, and $m_4$ the height of the accumulated developer at a location of the arrows is as follows 41 mm, 45 mm, 37 mm, and 28 mm. In this case, the developer was adhered to the entire surface of the developing roller 48.

Then, in the developing device shown in FIG. 43A, the total quantity of developer was set to be 1.4 kg, 1.6 kg, and 1.8 kg in the developer container 46, and it was examined how the developer was distributed in the developer-accumulating chamber 50 and how the developer was adhered to the developing roller 48 in accordance with the variation of the total quantity of developer.

Figure 43B:
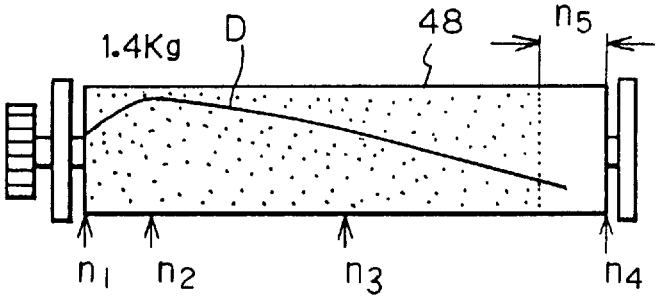

When the total quantity of the developer was set to be 1.4 kg, the distribution of the accumulated developer with respect to the developing roller 48 is represented by the curve D shown in FIG. 43B. At each location above the developing roller 48 at arrows $n_1$, $n_2$, and $n_3$ the height of the accumulated developer at the location of the arrow is, as follows: 28 mm, 36 mm, and 24 mm. In this case, a non-developer region (as shown as a blank region between arrows $n_1$–$n_4$ of about 40 mm in width about one end of the developing roller 48 was produced.

Figure 43C:
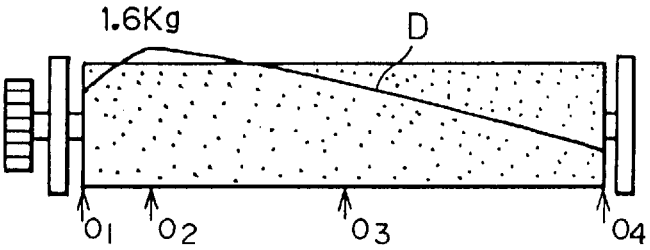

When the total quantity of the developer was set to be 1.6 kg, the distribution of the accumulated developer with respect to the developing roller 48 is represented by the curve D shown in FIG. 43C. At each location above the developing roller 48 at arrows $o_1$, $o_2$, $o_3$, and $o_4$ the height of the accumulated developer at the location of the arrow is, as follows: 34 mm, 44 mm, 3 mm, and 11 mm. In this case, the developer was adhered to the entire surface of the developing roller 48.

Figure 43D:
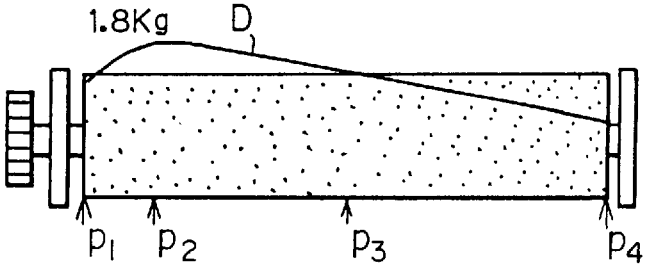

When the total quantity of the developer was set to be 1.8 kg, the distribution of the accumulated developer with respect tot he developing roller 48 is represented by the curve D shown in FIG. 43D. At each location above the developing roller 48 at arrows $p_1$, $p_2$, $p_3$, and $p_4$ the height of the accumulated developer at the location of the arrow is, as follows: 40 mm, 50 mm, 39 mm, and 24 mm. In this case, the developer was adhered to the entire surface of the developing roller 48.

Figure 44:
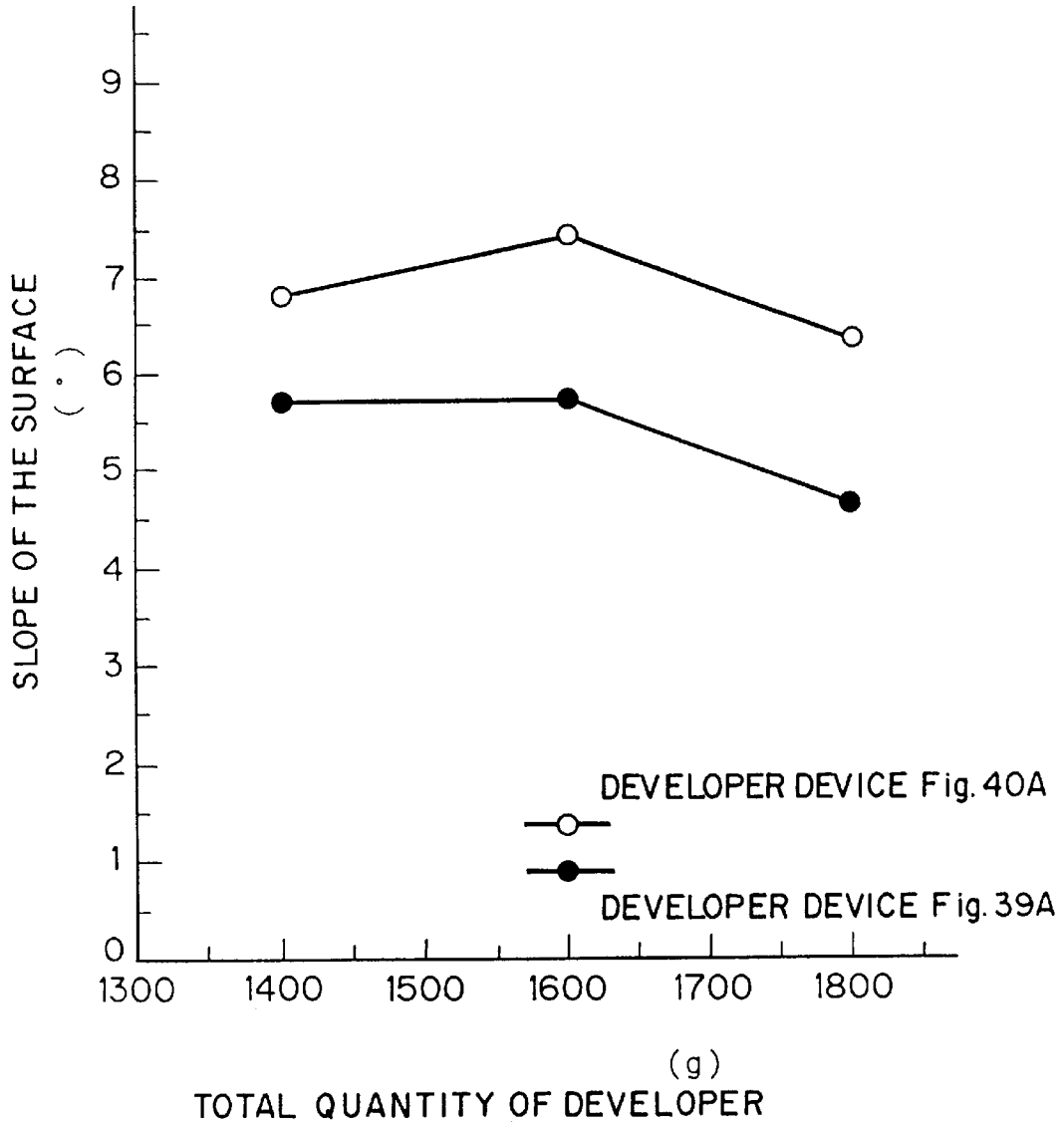
FIG. 44 is a graph showing the relationsip between the total quantity of developer and the slope of the surface of accumulated developer in each of the developing devices of FIGS. 42A and 43A.

A graph of FIG. 44 is made on the basis of the experimental results shown in FIGS. 42B to 42D and FIGS. 43B to 43D, and shows a relationship between the total quantity of developer and the slope of the surface of the accumulated developer. In the graph of FIG. 44, symbols "●" indicate the slope of the surface of the accumulated developer on the case of the developing device shown in FIG. 42A, and symbols "○" indicate the slope of the surface of the accumulated developer on the case of the developing device shown in FIG. 43A. As is apparent from the graph of FIG. 44, the developing device of FIG. 42A is superior to the developing device of FIG. 43A in performance for leveling the surface of the accumulated developer.

On the other hand, the distribution of the accumulated developer in the developer-accumulating chamber 50 can be uniformized by giving the paddle roller 52 a developer-stirring function.

Figure 45B:
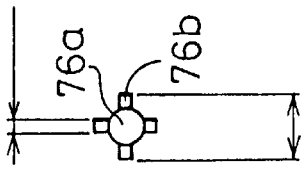
FIG. 45B is an end view of FIG. 45A.
Figure 45A:
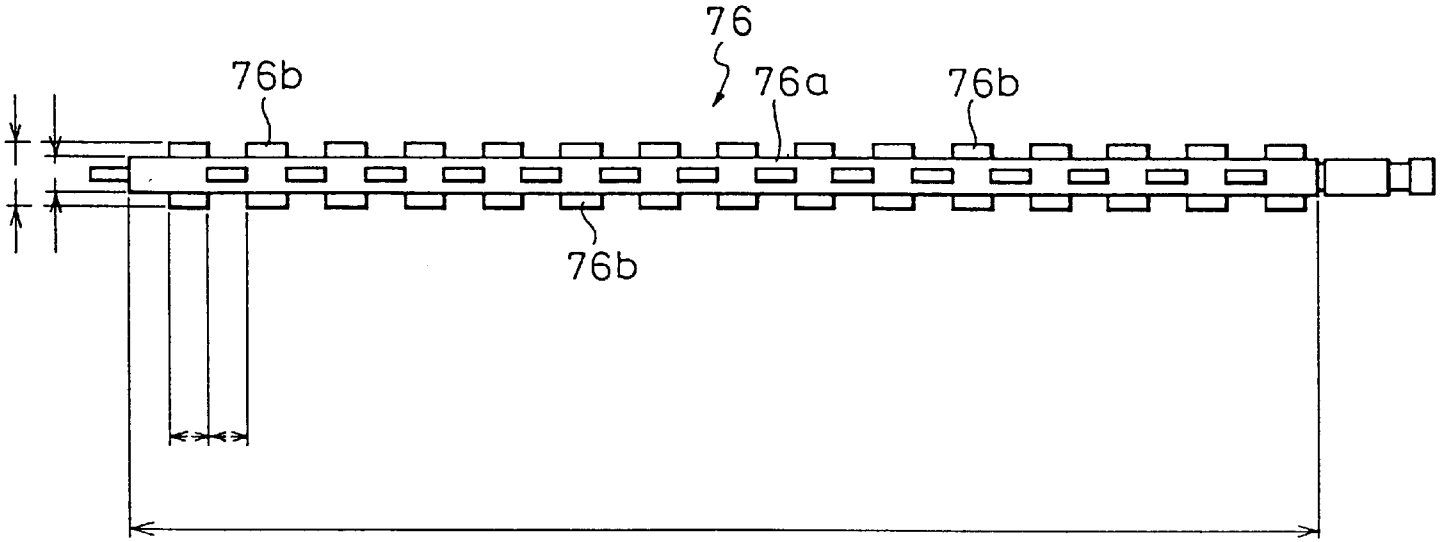
FIG. 45A is a front view of a paddle roller provided with stirring-paddle elements for leveling the surface of an accumulated developer.

FIGS. 45A and 45B show an embodiment of a paddle roller having such a developer-stirring function, generally indicated by reference 76. The paddle roller 76 comprises a roller body 76*a* 300 mm in length and 8 mm in diameter, and a plurality of stirring-paddle elements 76*b* attached to the roller body 76*a* along a longitudinal axis thereof, each element having a length of 10 mm and a thickness of 2 mm. Each stirring-paddle element is 8 mm high, and thus the overall diameter of the paddle roller 76 is 16 mm. The stirring-paddle elements 76*b* are arranged in four rows along the longitudinal axis of the paddle roller 76, with the rows being angularly offset from each other by an angle of 90°, and the stirring-paddle elements 76*b* included in each row are spaced from each other at regular intervals of 10 mm. Also, the stirring-paddle elements 76*b* included in one pair of diametrically-opposite rows are longitudinally offset by 10 mm with respect to the stirring-paddle elements 76*b* included in the other pair of diametrically-opposite rows. By rotating the paddle roller 76 so constituted, it is possible to even a distribution of the accumulated developer in the developer-accumulating chamber 50. The ability to even-out the distribution of the accumulated developer is dependent upon a speed of rotation of the paddle roller 76. The higher the speed of rotation of the paddle roller 76, the more even the distribution of the accumulated developer. When the paddle roller 76 is rotated at an excessively high speed, the developer prematurely deteriorates, resulting in a drop in printing quality. Also, the deterioration of the developer entails not only an electrophotographic fog but also an insufficient printing density. On the other hand, when the paddle roller 76 is rotated at an excessively low speed, the distribution of the accumulated developer in the developer-accumulating chamber 50 is not sufficiently even. The relationship between the printing quality and the speed of rotation of the paddle roller 76, as shown in FIGS. 45(*a*) and 45(*b*), was examined through experiment.

The results of each experiment are as follows:

(1) With the speed of rotation at 100 rpm, an even distribution of the accumulated developer in the developer-accumulating chamber 50 could not be obtained, and thus a printing density was not constant along the longitudinal axis of the developing roller 48.

(2) With the speed of rotation at 200 rpm, an even distribution of the accumulated developer in the developer-accumulating changer 50 could be obtained, and thus a printing density was substantially constant along the longitudinal axis of the developing roller 48.

When a number of printed sheets was in excess of 120,000, the developer was deteriorated, resulting in a loss of printing quality.

(3) With the speed of rotation at 300 rpm, the results were substantially the same as in the case where the speed of rotation was 200 rpm.

(4) With the speed of rotation at 400 rpm, the results were also substantially the same as in the case where the speed of rotation of 200 rpm.

(5) With the speed of rotation at 500 rpm, the developer was deteriorated when the number of printed sheets was in excess of 70,000, resulting in a loss of printing quality.

(6) With the speed of rotation at 600 rpm, the developer was deteriorated with the number of printed sheets was in excess of 50,000 resulting in a loss of printing quality.

(7) With the speed of rotation at 700 rpm, the developer was deteriorated when the number of printed sheets was in excess of 20,000, resulting in a loss of printing quality.

(8) With the speed of rotation at 800 rpm, the developer was deteriorated when the number of printed sheets was in excess of 10,000, resulting in a loss of printing quality.

Figure 46B:
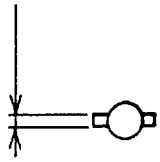
FIG. 46B is an end view of FIG. 46A.
Figure 46A:
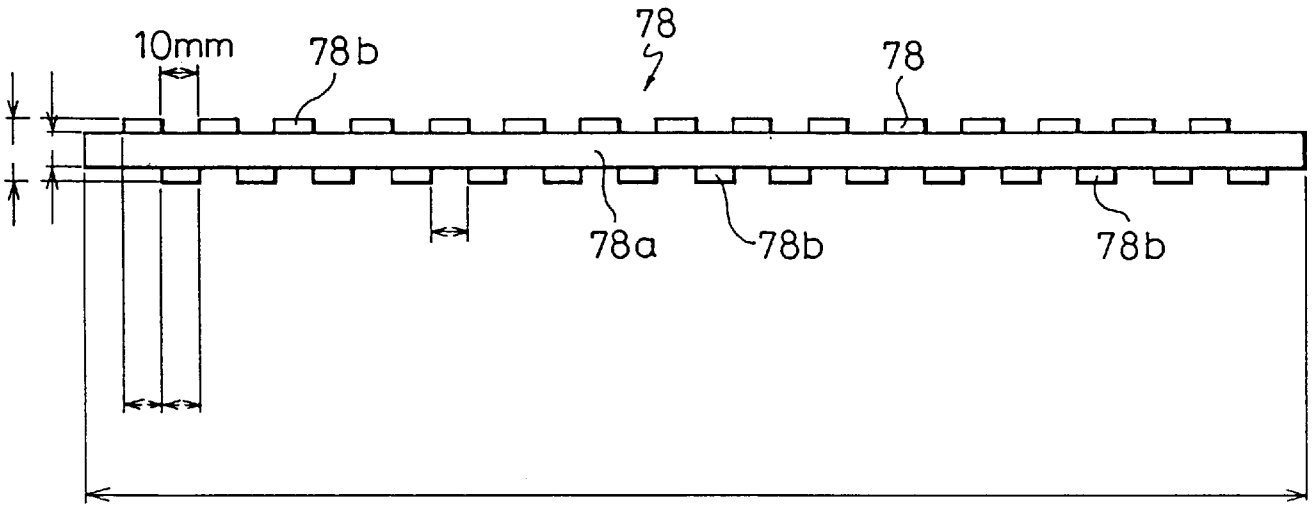
FIG. 46A is a front view of another paddle roller provided with stirring-paddle elements for leveling the surface of an accumulated developer.

FIGS. 46(*a*) and 46(*b*) shoe another type of paddle roller 78 comprising a roller body 78*a*, 8 mm in diameter, and a plurality of stirring-paddle elements 78*b* attached to the roller body 78*a* along a longitudinal axis thereof and each being 10 mm wide and 2 mm thick. The stirring-paddle elements were 8 mm high, and thus the overall diameter of the paddle roller 78 is 16 mm. Also, the stirring-paddle elements 78*b* included in one row are longitudinally offset by 10 mm with respect to the stirring-paddle elements 78*b* included in the other row. The relationship between printing quality and speed of rotation of the paddle roller 78 was examined through experiment.

The results are as follows:

(1) With the speed of rotation at 100 rpm, an even distribution of the accumulated developer in the developer-accumulating chamber 50 could not be obtained, and thus a printing density was not constant along the longitudinal axis of the developing roller 48.

(2) With the speed of rotation at 200 rpm, an even distribution of the accumulated developer in the developer-accumulating chamber 50 could be obtained, and thus the printing density was substantially along the longitudinal axis of the developing roller 48. When the number of printed sheets was in excess of 120,000, the developer was deteriorated, resulting in a loss of printing quality.

(3) With the speed of rotation of 300 rpm, the results were substantially the same as in the case of the speed of rotation at 200 rpm.

(4) With the speed of rotation of 400 rpm, the results were also substantially the same as in the case of the speed of rotation at 200 rpm.

(5) With the speed of rotation of 500 rpm, the results were also substantially the same as in the case of the speed of rotation at 200 rpm.

(6) With the speed of rotation of 600 rpm, the developer was deteriorated when a number of printed sheets was in excess of 70,000, resulting in a loss of printing quality.

(7) With the speed of rotation at 700 rpm, the developer was deteriorated when the number of printed sheets was in excess of 50,000, resulting in a loss of printing quality.

(8) With the speed of rotation at 800 rpm, the developer was deteriorated when the number of printed sheets was in excess of 20,000, resulting in a loss of printing quality.

Figure 47B:
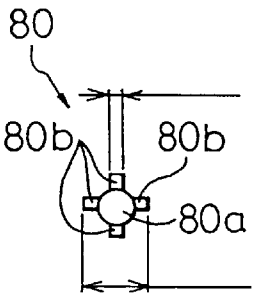
FIG. 47B is an end view of FIG. 47A.
Figure 47A:
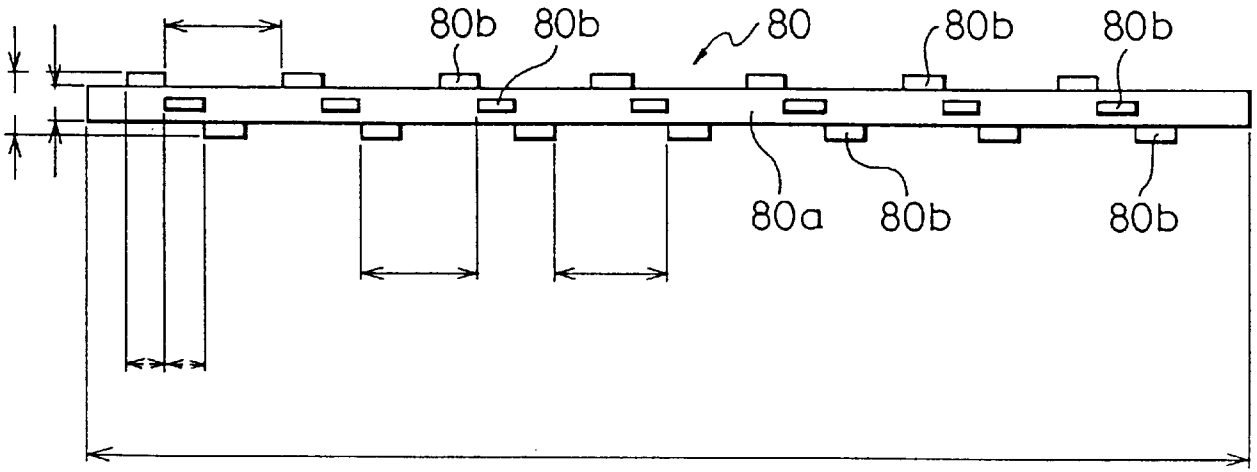
FIG. 47A is a front view of yet another paddle roller provided with stirring-paddle elements for leveling the surface of an accumulated developer.

FIGS. 47(*a*) and 47(*b*) show yet another type of paddle roller 80 comprising a roller body 80*a* 8 mm in diameter and a plurality of stirring-paddle elements 80*b* attached to the roller body 80*a* along a longitudinal axis thereof and being 10 mm wide and 2 mm thick. The stirring-paddle elements 80*b* were 8 mm in height, and thus the overall diameter of the paddle roller 80 is 16 mm. More particularly, the stirring-paddle elements 80*b* are arranged in four rows along the longitudinal axis of the paddle roller 80, with the rows being angularly offset from each other by an angle of 90°, and the stirring-paddle elements 80*b* included in each row are spaced from each other at regular intervals of 30 mm. Also, the stirring-paddle elements 80*b* included in one of the two adjacent rows are longitudinally offset by 10 mm with respect to the stirring-paddle elements 80*b* included in the other row. In other words, the paddles 80*b* are helically arranged around the roller body 80*a* at a pitch of 40 mm. The relationship between printing quality and the speed of rotation of the paddle roller 80 was substantially the same as the case of the paddle 78 shown in FIGS. 46(*a*) and 46(*b*).

Figure 48B:
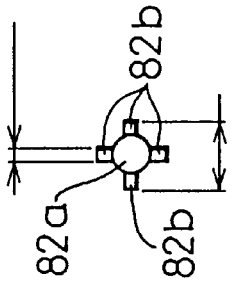
FIG. 48B is an end view of FIG. 48A.
Figure 48A:
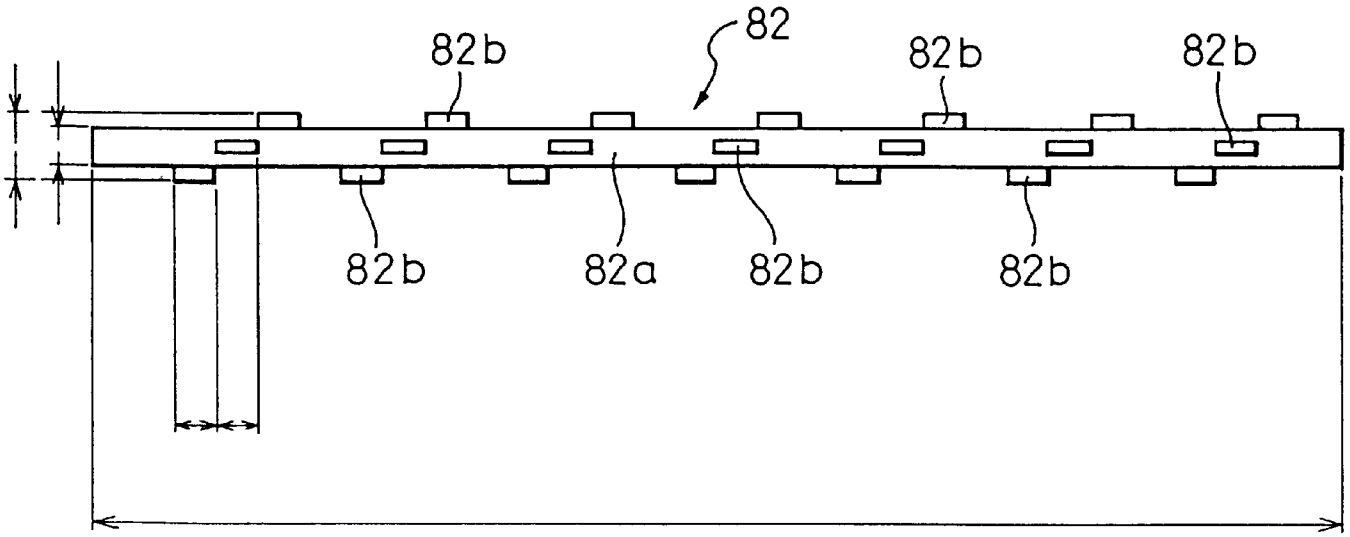
FIG. 48A is a front view of yet another paddle roller provided with stirring-paddle elements for leveling the surface of an accumulated developer.

FIGS. 48(*a*) and 48(*b*) show yet another type of paddle roller 82 comprising a roller body 82*a* 8 mm in diameter and a plurality of stirring-paddle elements 82*b* attached to the roller body 82*a* along a longitudinal axis thereof and being 10 mm wide and 2 mm thick. The stirring-paddle elements 82*b* are 8 mm high, and thus the overall diameter of the paddle roller 82 is 16 mm. An arrangement of the stirring-paddle elements 82*b* is similar to that of the stirring-paddle elements 78*b* shown in FIGS. 47(*a*) and 47(*b*), but a helical direction of the stirring-paddle elements 82*b* is in reversed with respect to that of the stirring-paddle elements 80*b* shown in FIGS. 47(*a*) and 47(*b*). The relationship between the printing quality and the speed of rotation of the paddle roller 82 was substantially the same as the case of the paddle 78 shown in FIGS. 46(*a*) and 46(*b*).

Figure 49B:
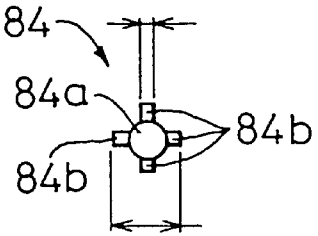
FIG. 49B is an end view of FIG. 49A.
Figure 49A:
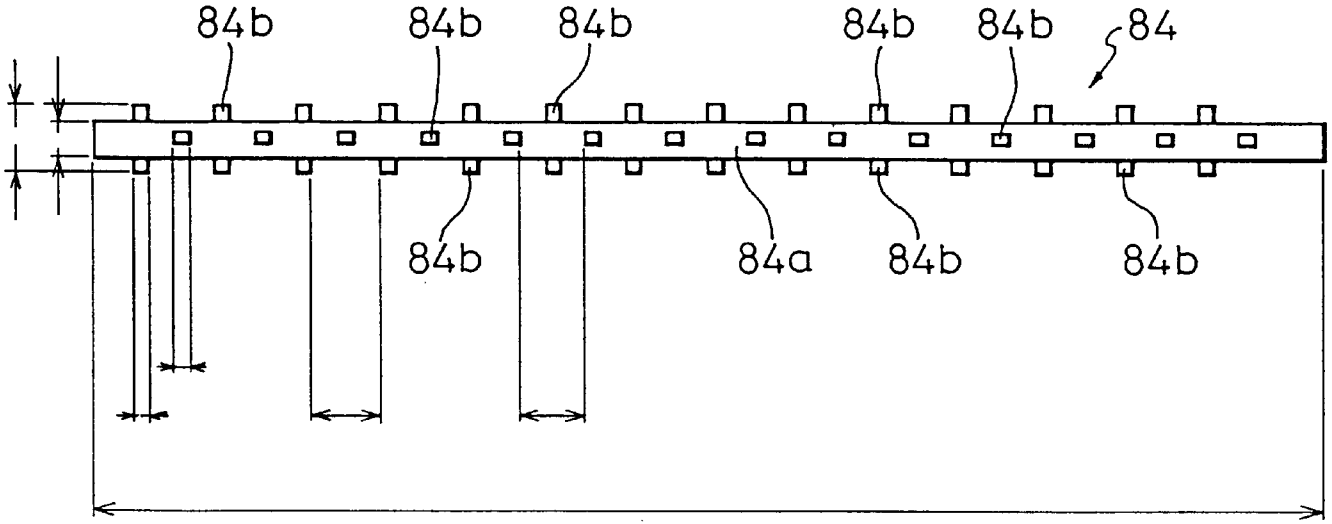
FIG. 49A is a front view of yet another paddle roller provided with stirring-paddle elements for leveling the surface of an accumulated developer.

FIGS. 49(*a*) and 49(*b*) show yet another type of paddle roller 84 comprising a roller body 84*a* 8 mm in diameter and a plurality of stirring-paddle elements 84*b* attached to the roller body 84*a* along a longitudinal axis thereof and being 4 mm wide and 2 mm thick. The stirring-paddle elements are 8 mm in height, and thus the overall diameter of the paddle roller 84 is 16 mm. More particularly, the stirring-paddle elements 84*b* are arranged in four rows along the longitudinal axis of the paddle roller 76, with the rows being angularly offset from each other by an angle of 90°, and the stirring-paddle elements 84*b* included in each row are spaced from each other at regular interval of 10 mm. Also, the stirring-paddle elements 84*b* included in one pair of diametrically-opposite rows are longitudinally offset by 10 mm with respect to the stirring-paddle elements 84*b* included in the other pair of diametrically-opposite rows. The stirring-paddle element 84*b* included in one pair of diametrically-opposite rows are longitudinally offset by 10 mm with respect to the stirring-paddle elements 84*b* included in the other pair of diametrically-opposite rows. The stirring-paddle elements 84*b* are arranged in four rows along the longitudinal axis of the paddle roller 84, with the rows being angularly offset from each other by an angle of 900, and the stirring-paddle elements 84*b* included in each row are spaced from each other at regular intervals of 10 mm. Also, the stirring-paddle elements 84*b* included in one pair of diametrically-opposite rows are longitudinally offset by 10 mm with respect to the stirring-paddle elements 84*b* included in the other pair of diametrically-opposite rows. The relationship between the printing quality and the speed of rotation of the paddle roller 84 were examined through experiments. The results are as follows:

(1) With the speed of rotation at 100 rpm, an even distribution of the accumulated developer in the developer-accumulating chamber 50 could not be obtained, and thus the printing density was not constant along the longitudinal axis of the developing roller 48.

(2) With the speed of rotation of 200 rpm, an even distribution of the accumulated developer in the developer-accumulating chamber 50 could be obtained, and thus the printing density was substantially constant along the longitudinal axis of the developing roller 48.

When a number of printed sheets was in excess of 120,000, the developer was deteriorated, resulting in a loss of printing quality.

(3) With the speed of rotation at 300 rpm, the results were substantially the same as when the speed of rotation was 200 rpm.

(4) With the speed of rotation at 400 rpm, the results were also substantially the same as when the speed of rotation was 200 rpm.

(5) With the speed of rotation at 500 rpm, the results were also substantially the same as when the speed of rotation was 200 rpm.

(6) With the speed of rotation at 600 rpm, the results were also substantially the same as when the speed of rotation was 200 rpm.

(7) With the speed of rotation at 700 rpm, the results were also substantially the same as when the speed of rotation was 200 rpm.

(8) With the speed of rotation at 800 rpm, the developer was deteriorated when the number of printed sheets was in excess of 80,000, resulting in a loss of printing quality.

Figure 50B:
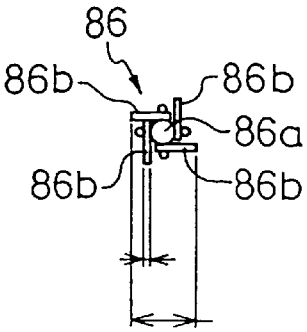
FIG. 50B is an end view of FIG. 50A.
Figure 50A:
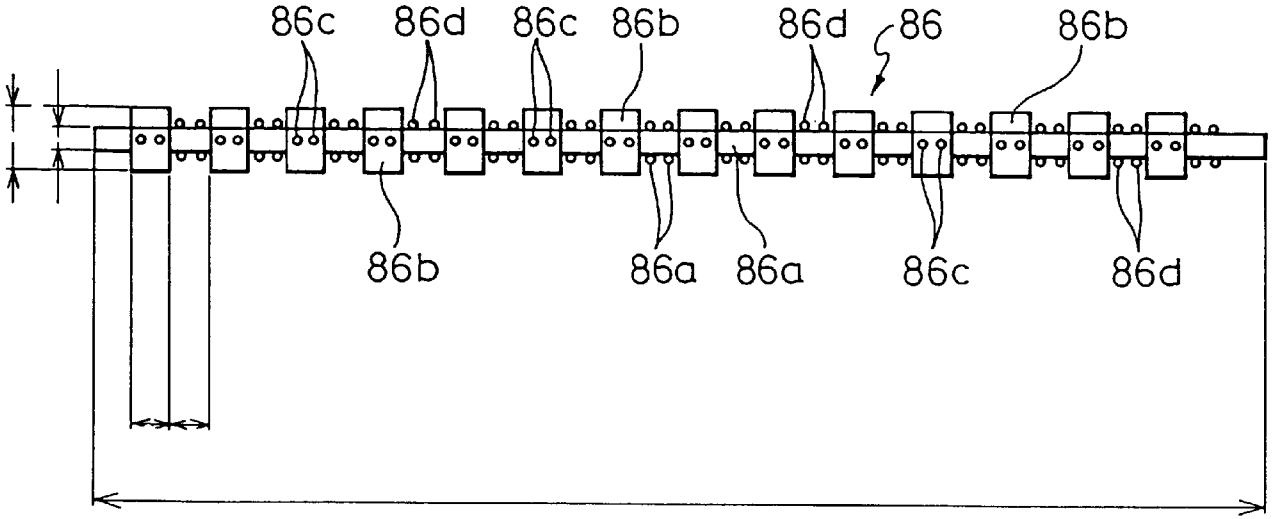
FIG. 50A is a front view of yet another paddle roller provided with stirring-paddle elements for leveling the surface of an accumulated developer.

FIGS. 50(*a*) and 50(*b*) show yet another type of paddle roller 86 comprising a roller body 86*a* 8 mm in diameter, and plurality of stirring-paddle elements 86*b* attached to the roller body 86*a* by small screws 86*c*. Each of the stirring-paddle elements 86*b* is 10 mm wide and 0.6 mm thick. More particularly, a set of four stirring-paddle elements 86*b* are tangentially attached to a periphery of the roller body 86*a* at locations spaced from each other at an angular intervals of 90°. Also, the four stirring-paddle elements 86*b* are projected in the same rotational direction such that a horizontal distance between the free end edges of the two diametrically-opposite stirring-paddle elements 86*b* is 15 mm. The plural sets of four stirring-paddle elements 86*b* are longitudinally spaced from each other at regular intervals of 10 mm. To further enhance the stirring-action of the paddle roller 86, stirring-screws 86*d* are directly screwed into the roller body 86*a* at a zone between the two adjacent sets of stirring-paddle elements 86*b*. The relationship between the printing quality and the speed of the rotation of the paddle roller 86 was substantially the same as in the case of the paddle 76 shown in FIGS. 46(*a*) and 46(*b*).

Figure 51B:
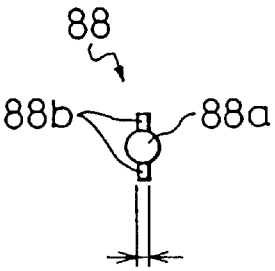
FIG. 51B is an end view of FIG. 51A.
Figure 51A:
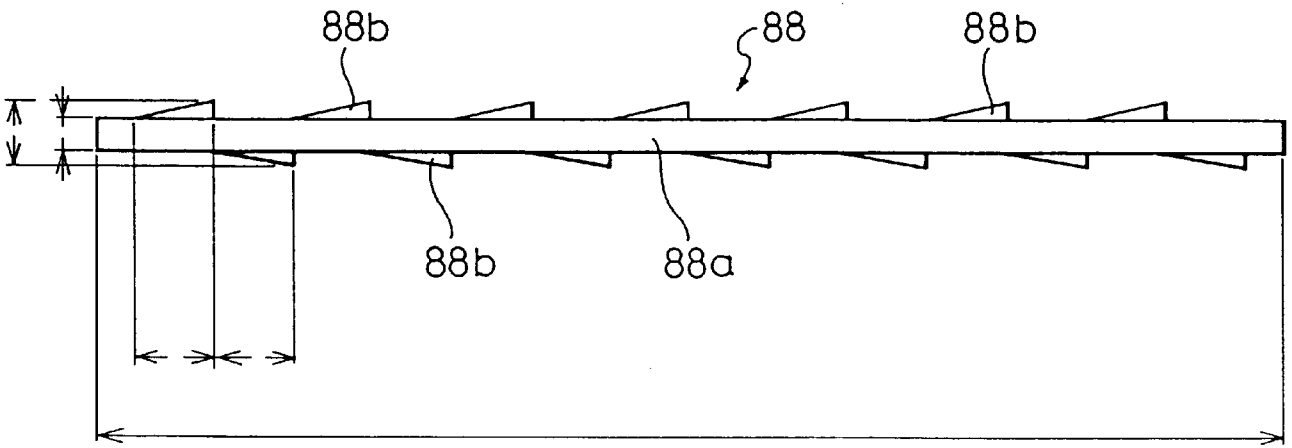
FIG. 51A is a front view of yet another paddle roller provided with stirring-paddle elements for leveling the surface of an accumulated developer.

FIGS. 51(*a*) and 51(*b*) show yet another paddle roller 88 comprising a roller body 88*a* 8 mm in diameter, and a plurality of triangularly-shaped stirring-paddle elements 88*b* attached to the roller body 88*a* along a longitudinal axis thereof. The stirring-paddle elements 88*b* are diametrically arranged in two rows along the longitudinal axis of the paddle roller 88, and the stirring-paddle elements 88*b* included in each row are spaced from each other at regular intervals of 10 mm and are oriented in the same direction. Each of the stirring-paddles 88*b* is 2 mm thick, and the foot thereof is 10 mm wide. The stirring-paddle elements 88*b* have a maximum height of 8 mm, and thus the overall diameter of the paddle roller 88 is 16 mm. The stirring-paddle elements 88*b* included in one row are longitudinally offset by 10 mm with respect to the stirring-paddle elements 88*b* included in the other row.

The relationship between the printing quality and the speed of rotation of the paddle roller 88 was substantially the same as in the case of the paddle 84 shown in FIGS. 49(*a*) and 49(*b*).

Figure 52C:
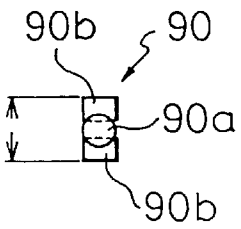
FIG. 52C is an end view of FIG. 52A.
Figure 52B:
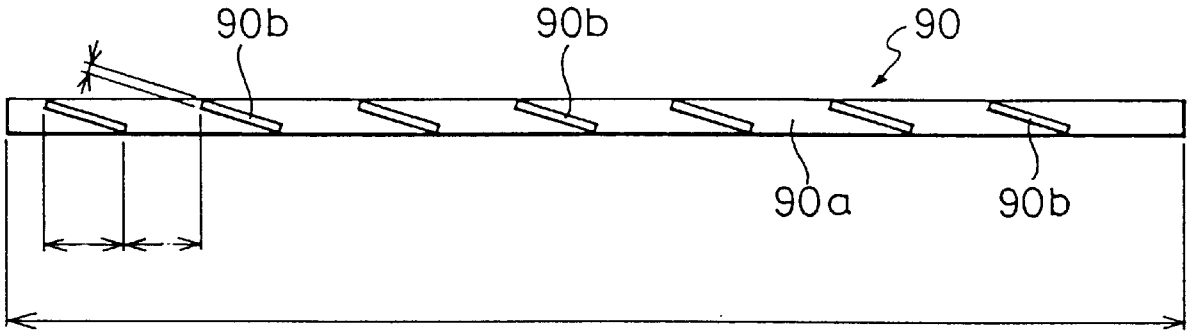
FIG. 52B is a plane view of FIG. 52A.
Figure 52A:
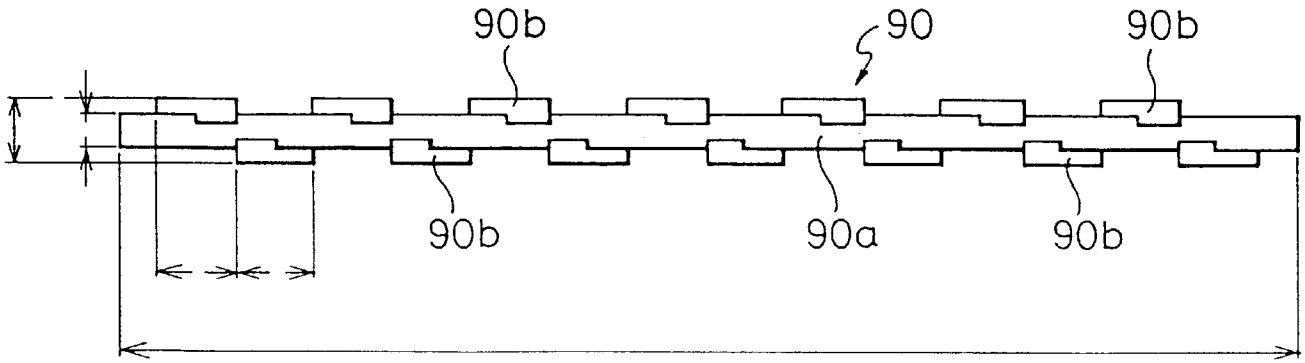
FIG. 52A is a front view of yet another paddle roller provided with stirring-paddle elements for leveling the surface of an accumulated developer.
Figure 53B:
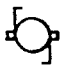
FIG. 53B is an end view of FIG. 53A.
Figure 53A:
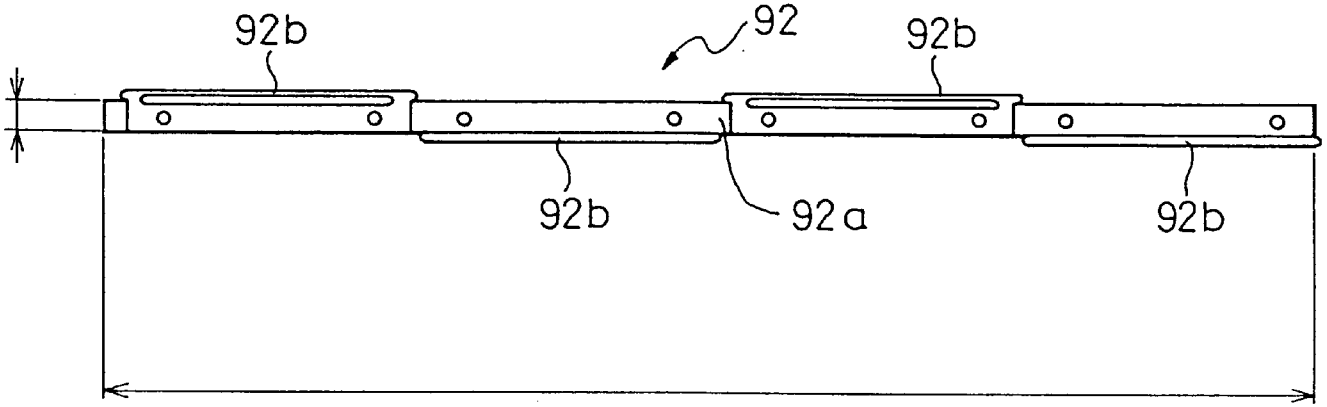
FIG. 53A is a front view of yet another paddle roller provided with stirring-paddle elements for leveling the surface of an accumulated developer.
Figure 53D:
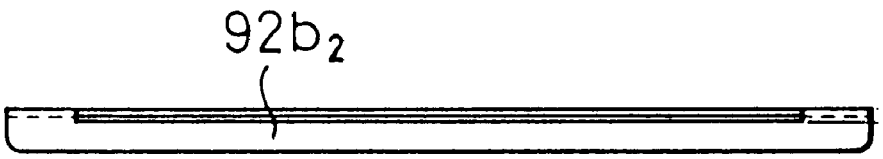
FIG. 53D is a plane view of FIG. 53C.
Figure 53C:
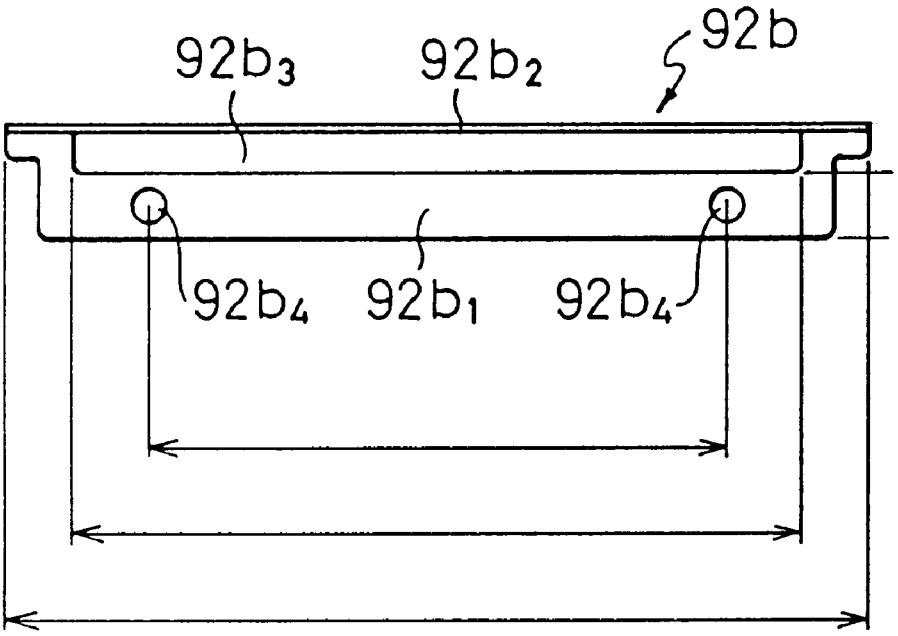
FIG. 53C is an enlarged front view of the stirring-paddle element showing in FIG. 53A.

FIGS. 52(*a*), 52(*b*) and 52(*c*) show yet another type of paddle roller 90 comprising a roller body 90*a* 8 mm in diameter, and a plurality of stirring-paddle 90*b*, attached to the roller body 90*a*, having a width of somewhat greater than 20 mm, a thickness of 2 mm, and a height of somewhat greater than 8 mm. More particularly, the stirring-paddle elements 90*b* are diametrically arranged in two rows along the longitudinal axis of the paddle roller 90, and the stirring-paddle elements 90*b* included in each row are spaced from each other at regular intervals of 10 mm and are obliquely oriented in the same direction with respect to the longitudinal axis of the roller body 90*a*. Each of the stirring-paddle elements 90*b* is securely mounted in a groove obliquely formed in the roller body 90*a* with respect to the longitudinal axis thereof, such that the overall diameter of the paddle roller 88 is 16 mm. The relationship between the printing quality and the speed of rotation of the paddle roller 90 was substantially the same as in the case of the paddle 84 shown in FIGS. 49(*a*) and 49(*b*).

FIGS. 53(*a*) and 53(*b*) shown yet another paddle roller 92 comprising a roller body 92*a* 6 mm in diameter and a plurality of stirring-paddle elements 92*b* attached to the roller body 92*a* and diametrically arranged in two rows along a longitudinal axis thereof. Each of the stirring-paddle elements 92*b* has an appearance as shown in FIGS. 53(*c*) and 53(*d*) in detail. In particular, the stirring paddle 92*b* comprises an elongated thin plate $\mathbf{92}b_1$, 79 mm in length. The top of the thin plate $\mathbf{92}b_1$, is perpendicularly bent as a bent portion $\mathbf{92}b_2$ 3.5 mm in width, such that a height hereof is 10.5 mm in height. The thin plate $\mathbf{92}b_1$, has an opening $\mathbf{92}b_3$ longitudinally formed therein just below the bent portion $\mathbf{92}b_2$, and the opening $\mathbf{92}b_3$ is 67 mm long and 4.5 mm high. The thin plate 92*b*, has a pair of screw holes $\mathbf{92}b_4$ formed therein, and the distance therebetween is 53 mm. As shown in 53(*a*) and 53(*b*), stirring-paddle elements 92*b* are alternately arranged along two diametrically-opposite sides of the paddle roller 92 at a given regular intervals, and each of the stirring-paddle elements 92*b* is fixed to the roller body 92*a* by threading two screws $\mathbf{92}b_5$ into the roller body 92*a* through the screw holes $\mathbf{92}b_4$ thereof, such that the top portions of the thin plates $\mathbf{92}b_1$, included in the two diametrically-opposite rows are alternately and reversely projected about 4.6 mm from the roller body 92*b*. The relationship between the printing quality and the speed of rotation of the paddle roller 92 was substantially the same as in the case of the paddle 84 shown in FIGS. 49(*a*) and 49(*b*).

Regarding a service life of the developing device 16', FIG. 9, more than 100,000 sheets could be printed as a general standard. Accordingly, when designing a paddle roller to even out the distribution of the accumulated developer in the developer-accumulating chamber 50, FIG. 14, the above-mentioned requirements should be taken into account.

It is desirable that the screw conveyors 58*a* and 58*b* disposed in the developer-agitating chamber 56, FIG. 16, are rotated at as low a speed of rotation as possible and enabled to efficiently move the developer. In a high-speed printer, since the consumption of the toner component of the developer per unit time is large, the developer should be rapidly moved in the developer-agitating chamber 56, before a sufficient amount of developer is fed to the developing roller 48. Also, the speed of movement of the developer by the screw conveyors 58*a* and 58*b* should be made large before the toner component of the developer can be sufficiently subjected to triboelectrification. When the speed of rotation of the screw conveyors 58*a* and 58*b* is fixed, the speed of movement of the developer is dependent upon the screw pitch of the screw conveyors 58*a* and 58*b*. Namely, the speed of movement of the developer is raised as the screw pitch becomes larger, whereas the speed of movement of the developer is lowered as the screw pitch becomes smaller. However, as is generally known, an excessively large or small screw pitch reduces the ability to move developer. Although the speed of movement of the developer can be increased by a speed-up of rotation of the screw conveyors 58*a* and 58*b*, this approach results in not only shortening of the life of the developer and but also a rapid abrasion of bearings, or the like, used for the screw conveyors 58*a* and 58*b*.

Accordingly, the present invention is further directed to a developing device in which not only can the developer be efficiently moved by rotation the screw conveyors at as low a speed of rotation as possible, but also the toner component of the developer can be sufficiently subjected to triboelectrification. The inventors of the present invention have elucidated, through experiment, the relationship between the diameter and the pitch of a screw of the screw conveyors or efficiently moving the developer and for sufficiently subjecting the toner component of the developer to triboelectrification. Note, in general, it is natural that the screw of the screw conveyor has a diameter equal to the pitch thereof.

Figure 54:
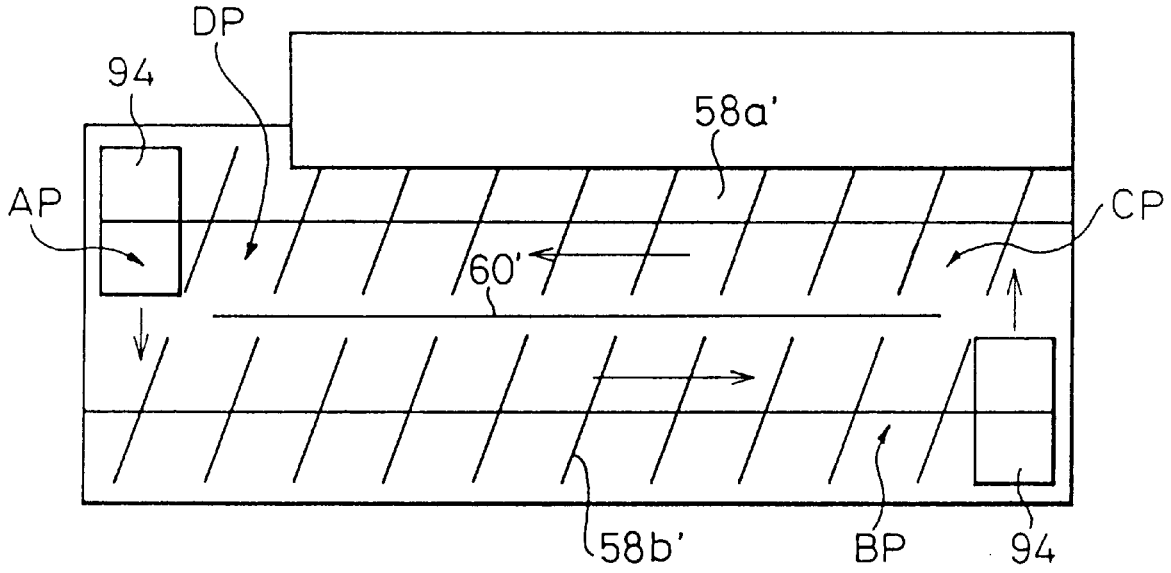
FIG. 54 is a schematic plan view of a developer-agitating chamber of a developing device in accordance with another aspect of the present invention.

Referring to FIG. 54, the developer-agitation chamber 59' of a developing device used in the above-mentioned experiments is schematically shown as a plan view. In the developer-agitating chamber 56', a pair of screw conveyors 58*a*' and 58*b*' are disposed in parallel with each other, and partition plate 60' is intervened therebetween. The screw conveyors 58*a*' and 58*b*' are rotationally driven such that the developer is circulated in a direction indicated by the arrows. Note, in FIG. 54, reference 94 indicated a scraper member through which the developer lifted from a developing roller is returned to the developer-agitating chamber 56'.

Figure 55:
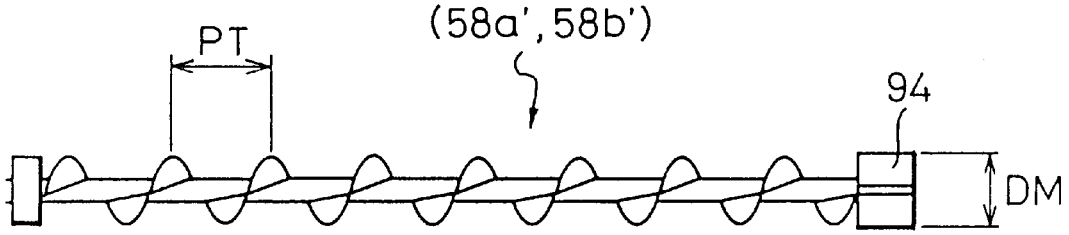
FIG. 55 is a plan view of a feed screw conveyor used in the developer-agitating chamber of FIG. 54.

FIG. 55 shows details of the screw conveyors 58*a*', 58*b*' which have a diameter indicated by DM and a screw pitch indicated by PIT, and which are provided with a vane wheel 94 mounted on one end thereof. As shown in FIG. 54, each of the screw conveyors 58*a*' and 58*b*' are rotated such that the developer is moved toward the vane wheel 94, and then this vane wheel 94 transfers the developer to the other screw conveyor.

Figure 56:
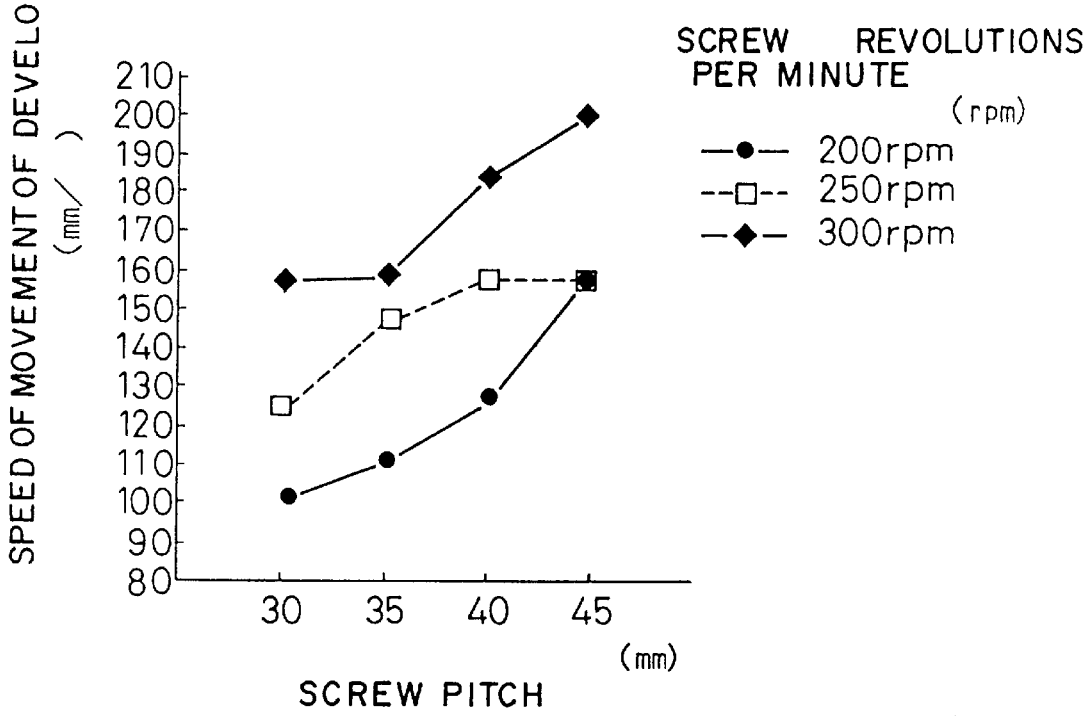
FIG. 56 is a graph showing the relationship between a developer-moving speed and the pitch of the screw of the screw conveyor.

For the experiments, four pairs of screw conveyors 30 mm in diameter DM, of 30, 35, 40, and 45 mm screw pitches PT, respectively, were prepared, and each pair of screw conveyors was installed in the developer-agitating chamber 56' as shown in FIG. 54. Each pair of screw conveyors were rotated at 200, 250 or 300 rpm to measure a speed of movement of the developer. The results are shown in a graph of FIG. 56. As is apparent from the graph of FIG. 56, the speed of movement of the developer increases as the screw pitch PT becomes larger. Also, the higher the speed of rotation of the screw conveyors, the larger the speed of movement of the developer.

Also, while the developer was moved by each of the pairs of screw conveyors (P=30, 35, 40, and 45 mm), a given amount of fresh toner component was added to the moving developer at a location AP, FIG. 54. Then, when the section of the moving developer, to which the fresh toner component was added, reaches each of locations BP and CP, an amount of electrical charge of the toner component of the developer was measured at the section concerned. Further, an amount of electrical charge of the toner component of the developer was measured at a location DP where was just upstream with respect to the location at which the fresh toner component was added. Note, the speed of rotation of the screw conveyors was 200 rpm. The results are shown in the following table:

| Screw Pitch PT | Loca. AP | Loca. BP | Loca. CP | Loca. DP |
|---|---|---|---|---|
| 30 mm | ○ | ○ | ○ | ○ |
| 35 mm | ○ | ○ | ○ | ○ |
| 40 mm | ○ | ○ | ○ | ○ |
| 45 mm | ○ | ○ | x | x |

In the table, a symbol "o indicates that the measured electrical charge was 10 $\mu$c/g or more, and "x" indicates that the measured electrical charge was less than 10 $\mu$c/g. Before a proper development can be carried out, the electrical charge of the toner component should be at least 10 $\mu$c/g.

We claim:

1. A developing device for developing an electrostatic latent image with a two-component developer, comprising:

a developer container (46) including a developer-accumulating chamber (50), and a developer-agitating chamber (56) provided above said developer-accumulating chamber (50), a communication passage (64) being formed between said developer-agitating chamber and said developer-accumulating chamber, and said communication passage being opened to said developer-agitating chamber to form an overflow opening for the developer;

a developer carrying body (48) provided within the developer-accumulating chamber of said developer container, said developer carrying body being partially exposed and facing an electrostatic latent image carrying body (10) to bring the developer from said developer-accumulating chamber to a facing zone therebetween for development of an electrostatic latent image formed on said electrostatic latent image carrying body;

a developer-lifting means (68, 68', 70) for lifting the developer, brought to the developing zone by said developer carrying body, to the developer-agitating chamber of said developer container; and a developer-agitating means (58) for agitating the developer in the developer-agitating chamber of said developer container, a part of the developer agitated by said developer-agitating means being fed to said developer-accumulating chamber through the overflow opening and the communication passage.

2. A developing device as set forth in claim 1, wherein the communication passage (64) is disposed adjacent to said developer-lifting means (68, 68', 70).

3. A developing device as set forth in claim 2, wherein the developer-lifting means comprises at least one magnet roller (68, 70) having magnetic poles which are arranged such that the developer is lifted on the side of the exposed surface of said developer-carrying body (48).

4. A developing device as set forth in claim 1, wherein said developer-lifting means comprises a mechanical developer-lifting means (68') provided above said developer-carrying body (48), and a magnet roller (70) provided above the mechanical developer-lifting means.

5. A developing device as set forth in claim 4, wherein said mechanical developer-lifting means (68') comprises a vane wheel (68') which is arranged so as to lift the developer from the developer-carrying body (48) at a location at which said developer-carrying body produces no magnetic field.

6. A developing device as set forth in claim 1, wherein said communication passage (64) is substantially extended through a middle part of the developer-agitating chamber (56) of the developer container (46), the developer-lifting means comprises at least two magnet (68, 70) which have magnetic poles arranged such that the developer is lifted from said developer-carrying body (48) along an S-shaped path.

7. A developing device as set forth in claim 1, wherein the communication passage (64) is substantially extended through a middle part of the developer-agitating chamber (56) of the developer container (46), and said developer-lifting means comprises a mechanical developer raising means (68') provided above said developer-carrying body (48), and a magnet roller (70) provided above said mechanical developer-lifting means, said mechanical developer-lifting means and said magnet roller being arranged such that the developer is lifted from said developer-carrying means (48) along an S-shaped path.

8. A developing device as set forth in claim 7, wherein said mechanical developer-lifting means (68') comprises a vane wheel (68') which is arranged so as to lift the developer from the developer-carrying body (48) at a location at which said developer-carrying body produces no magnetic field.

9. A developing device as set forth in claim 1, wherein said developer-agitating means (58) comprises a first developer-conveying screw conveyor (58*a*) disposed in the developer-agitating chamber (50) of the developer container (46) so as to be longitudinally in parallel with said developer-carrying body (48), a second developer-conveying screw conveyor (58*b*) disposed so as to be in parallel with said first developer-conveying screw conveyor (58*a*) on a side thereof opposite to said developer-carrying body, a first partition plate (60*a*) disposed between said first and second developer-conveying screw conveyors on a side adjacent to said first developer conveying screw conveyor, and a second partition plate (60*a*) disposed between said first and second developer-conveying screw conveyors on a side adjacent said developer-conveying screw conveyor;

said first and second developer conveying screw conveyors are driven in reverse directions with respect to each other such that the developer is circulated in said developer-agitating chamber, an the overflow opening of said communication passage (64) is defined by said first and second partition plates.

10. A developing device as set forth in claim 9, wherein said second partition plate (69*b*) defines an overflow edge of said overflow opening having a height gradually decreasing along a direction in which the developer is moved by said second developer-conveying screw conveyor (58*b*).

11. A developing devices as set forth in claim 10, wherein said first partition plate (60*a*) has a projected edge which is positioned above the overflow edge of said overflow opening such that an overflow outlet port having a given width is defined therebetween.

12. A developing device as set forth in claim 9, further comprising:

a first scraper (72*a*) for returning the developer from said developer-lifting means to said first developer-conveying screw conveyor (58*a*), said first scraper member being disposed at a downstream side in a direction in which the developer is moved by said first developer-conveying screw conveyor (58*a*) said first partition plate (60*a*) defining an overflow edge of said overflow opening having a length corresponding to that of said first scraper member;

and a second scraper member (72*b*) for returning the developer from said developer-lifting means to said second developer-conveying screw conveyor (58*b*), said second scraper member being disposed at a downstream side in a direction in which the developer is moved by said second developer-conveying screw (58*b*), said second partition plate (60*b*) defining an overflow edge of said overflow opening having a length corresponding to that of said second scraper member.

13. A developing device as set forth in claim 9, wherein said first partition plate (60*a*) defines an overflow edge of said overflow opening.

14. A developing device as set forth in claim 13, wherein said second partition plate (60*b*) defines overflow edges of said overflow opening which are formed at the opposite side ends thereof and which have a given width.

15. A developing device as set forth in claim 1, further comprising a paddle roller (76, 78, 80, 82, 84, 86, 88, 80, 92) disposed in said developer-accumulating chamber (50) for feeding the developer from said developer-accumulating chamber to said developer-carrying body (48), said paddle roller having a plurality of stirring-paddle elements (76*b*, 78*b*, 80*b*, 82*b*, 84*b*, 86*b*, 88*b*, 90*b*, 92*b*) for stirring the developer accumulated in said developer-accumulating chamber, during the rotation of said paddle roller, to even-out the distribution of the developer accumulated therein.

16. A developing device as set forth in claim 15, wherein said stirring-paddle elements (76*b*, 78*b*, 80*b*, 82*b*, 84*b*, 86*b*, 88*b*, 90*b*, 92*b*) are arranged such that at least 100,000 printed sheets can be printed.

17. A developing device for developing an electrostatic latent image with a two-component developer, comprising:

a developer-agitating chamber (30, 56) for agitating the developer such that a toner component of the developer is subjected to triboelectrification, and for feeding the developer to a developing roller (32, 48);

and at least two screw conveyors (58*a*', 58*b*') disposed in said the developer-agitating chamber to carry out the agitation of the developer, wherein an outer diameter (DM) and a screw pitch (PT) of said screw conveyors satisfy the requirements defined by the formula below:

$$1.0 < PT/DM \leqq 1.5.$$

18. A developing device for developing an electrostatic latent image with a two-component developer, comprising:

a developer-agitating chamber (30, 56) for agitating the developer such that a toner component of the developer is subjected to triboelectrification, and for feeding the developer to a developing roller (32, 48); and at least two screw conveyors (58*a*', 58*b*') disposed in said the developer-agitating chamber to carry out the agitation of developer, wherein an outer diameter (DM) and a screw pitch (PT) of said screw conveyors satisfy the requirements defined by the formula below:

$$1.3 < PT/DM \leqq 1.5.$$

* * * * *